US008610627B2

(12) United States Patent
Puente Baliarda et al.

(10) Patent No.: US 8,610,627 B2
(45) **Date of Patent: *Dec. 17, 2013**

(54) SPACE-FILLING MINIATURE ANTENNAS

(75) Inventors: Carles Puente Baliarda, Tiana (ES); Edouard Jean Louis Rozan, Barcelona (ES); Jaime Anguera Pros, Vinaros (ES)

(73) Assignee: Fractus, S.A., Barcelona (ES)

( * ) Notice: Subject to any disclaimer, the term of this patent is extended or adjusted under 35 U.S.C. 154(b) by 93 days.

This patent is subject to a terminal disclaimer.

(21) Appl. No.: 13/038,883

(22) Filed: Mar. 2, 2011

(65) Prior Publication Data

US 2011/0181478 A1 Jul. 28, 2011

Related U.S. Application Data

(60) Continuation of application No. 12/498,090, filed on Jul. 6, 2009, now Pat. No. 8,207,893, which is a continuation of application No. 12/347,462, filed on Dec. 31, 2008, now Pat. No. 8,212,726, which is a continuation of application No. 11/686,804, filed on Mar. 15, 2007, now Pat. No. 7,554,490, which is a division of application No. 11/179,250, filed on Jul. 12, 2005, now Pat. No. 7,202,822, which is a continuation of application No. 11/110,052, filed on Apr. 20, 2005, now Pat. No. 7,148,850, which is a continuation of application No. 10/182,635, filed as application No. PCT/EP00/00411 on Jan. 19, 2000, now abandoned.

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702, 795, 792.5, 806
See application file for complete search history.

(56) References Cited

U.S. PATENT DOCUMENTS

| | | | |
|---|---|---|---|
| 3,079,602 | A | 2/1963 | Duhamel |
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |

(Continued)

FOREIGN PATENT DOCUMENTS

| | | |
|---|---|---|
| AU | 5984099 | 4/2001 |
| CN | 2224466 | 4/1996 |

(Continued)

OTHER PUBLICATIONS

Notice of Allowance of U.S. Appl. No. 12/498,090 dated on Mar. 10, 2011.

(Continued)

*Primary Examiner* — Hoang V Nguyen
(74) *Attorney, Agent, or Firm* — Howison & Arnott, L.L.P.

(57) ABSTRACT

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

53 Claims, 25 Drawing Sheets

(56) References Cited

U.S. PATENT DOCUMENTS 3,683,379 A 8/1972 Pronovost
3,689,929 A 9/1972 Moody
3,818,490 A 6/1974 Leahy
3,967,276 A 6/1976 Goubau
3,969,730 A 7/1976 Fuchser
4,021,810 A 5/1977 Urpo et al.
4,024,542 A 5/1977 Ikawa et al.
4,038,662 A 7/1977 Turner
4,072,951 A 2/1978 Kaloi
4,131,893 A 12/1978 Munson et al.
4,141,016 A 2/1979 Nelson
4,318,109 A 3/1982 Weathers
4,356,492 A 10/1982 Kaloi
4,381,566 A 4/1983 Kane
4,471,358 A 9/1984 Glasser
4,471,493 A 9/1984 Schober
4,504,834 A 3/1985 Garay et al.
4,536,725 A 8/1985 Hubler
4,543,581 A 9/1985 Nemet
4,571,595 A 2/1986 Phillips et al.
4,584,709 A 4/1986 Kneisel et al.
4,590,614 A 5/1986 Erat
4,608,572 A 8/1986 Blakney
4,623,894 A 11/1986 Lee et al.
4,628,322 A 12/1986 Marko
4,673,948 A 6/1987 Kuo
4,723,305 A 2/1988 Phillips et al.
4,730,195 A 3/1988 Phillips et al.
4,752,968 A 6/1988 Lindenmeier
4,827,266 A 5/1989 Sato
4,827,271 A 5/1989 Berneking
4,839,660 A 6/1989 Hadzoglou
4,843,468 A 6/1989 Drewery
4,847,629 A 7/1989 Shimazaki
4,849,766 A 7/1989 Inaba et al.
4,857,939 A 8/1989 Shimazaki
4,860,019 A 8/1989 Jiang
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,030,963 A 7/1991 Tadama
5,138,328 A 8/1992 Zibrik et al.
5,168,472 A 12/1992 Lockwood
5,172,084 A 12/1992 Fiedziuszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,307,075 A 4/1994 Huynh
5,337,065 A 8/1994 Bonnet
5,347,291 A 9/1994 Moore
5,355,144 A 10/1994 Walton et al.
5,355,318 A 10/1994 Dionnet et al.
5,363,114 A 11/1994 Shoemaker
5,373,300 A 12/1994 Jenness et al.
5,402,134 A 3/1995 Miller et al.
5,410,322 A 4/1995 Sonoda
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al.
5,453,752 A 9/1995 Wang
5,457,469 A 10/1995 Diamond et al.
5,471,224 A 11/1995 Barkeshli
5,493,702 A 2/1996 Crowley et al.
5,495,261 A 2/1996 Baker et al.
5,508,709 A 4/1996 Krenz et al.
5,534,877 A 7/1996 Sorbello et al.
5,537,367 A 7/1996 Lockwood et al.
5,557,293 A 9/1996 McCoy
5,569,879 A 10/1996 Gloton et al.
H1631 H 2/1997 Montgomery et al.
5,608,417 A 3/1997 De Vall
5,619,205 A 4/1997 Johnson
5,684,672 A 11/1997 Karidis et al.
5,712,640 A 1/1998 Andou et al.
5,767,811 A 6/1998 Mandai et al.
5,784,032 A 7/1998 Johnston et al.
5,790,080 A 8/1998 Apostolos
5,798,688 A 8/1998 Schofield
5,809,433 A 9/1998 Thompson
5,821,907 A 10/1998 Zhu et al.
5,838,285 A 11/1998 Tay
5,841,402 A 11/1998 Dias et al.
5,841,403 A 11/1998 West
5,870,066 A 2/1999 Asakura et al.
5,872,546 A 2/1999 Ihara et al.
5,898,404 A 4/1999 Jou
5,903,240 A 5/1999 Kawahata et al.
5,918,183 A 6/1999 Janky
5,926,139 A 7/1999 Korisch
5,926,141 A 7/1999 Lindenmeier et al.
5,929,825 A 7/1999 Niu
5,936,583 A 8/1999 Sekine et al.
5,936,587 A 8/1999 Gudilev
5,943,020 A 8/1999 Liebendoerfer et al.
5,966,098 A 10/1999 Qi et al.
5,973,651 A 10/1999 Suesada et al.
5,986,609 A 11/1999 Spall
5,986,610 A 11/1999 Miron
5,986,615 A 11/1999 Westfall et al.
5,990,838 A 11/1999 Burns et al.
5,995,052 A 11/1999 Sadler et al.
6,002,367 A 12/1999 Engblom et al.
6,005,524 A 12/1999 Hayes et al.
6,011,518 A 1/2000 Yamagishi
6,011,699 A 1/2000 Murray
6,016,130 A 1/2000 Annamaa
6,028,567 A 2/2000 Lahti
6,028,568 A 2/2000 Asakura et al.
6,031,499 A 2/2000 Dichter
6,031,505 A 2/2000 Qi et al.
6,040,803 A 3/2000 Spall
6,058,211 A 5/2000 Bormans
6,069,592 A 5/2000 Wass
6,075,489 A 6/2000 Sullivan
6,075,500 A 6/2000 Kurz et al.
6,078,294 A 6/2000 Mitarai
6,087,990 A 7/2000 Thill
6,091,365 A 7/2000 Derneryd et al.
6,094,179 A 7/2000 Davidson
6,097,339 A 8/2000 Filipovic
6,097,345 A 8/2000 Walton
6,104,349 A * 8/2000 Cohen ..... 343/702
6,111,545 A 8/2000 Saari
6,122,533 A 9/2000 Zhang
6,127,977 A 10/2000 Cohen
6,130,651 A 10/2000 Yanagisawa
6,131,042 A 10/2000 Lee et al.
6,140,966 A 10/2000 Pankinaho
6,140,969 A 10/2000 Lindenmeier et al.
6,140,975 A 10/2000 Cohen
6,141,540 A 10/2000 Richards
6,147,649 A 11/2000 Ivrissimtzis
6,147,652 A 11/2000 Sekine
6,147,655 A 11/2000 Roesner
6,157,344 A 12/2000 Bateman
6,160,513 A 12/2000 Davidson et al.
6,166,694 A 12/2000 Ying
6,172,618 B1 1/2001 Hakozaki et al.
6,181,281 B1 1/2001 Desclos et al.
6,181,284 B1 1/2001 Madsen et al.
6,195,048 B1 2/2001 Chiba
6,198,442 B1 3/2001 Rutkowski
6,201,501 B1 3/2001 Arkko
6,204,826 B1 3/2001 Rutkowski

(56) References Cited

U.S. PATENT DOCUMENTS

| | | | |
|---|---|---|---|
| 6,211,824 | B1 | 4/2001 | Holden et al. |
| 6,211,826 | B1 | 4/2001 | Aoki |
| 6,211,889 | B1 | 4/2001 | Stoutamire |
| 6,215,474 | B1 | 4/2001 | Shah |
| 6,218,992 | B1 | 4/2001 | Sadler et al. |
| 6,236,366 | B1 | 5/2001 | Yamamoto |
| 6,236,372 | B1 | 5/2001 | Lindenmeier et al. |
| 6,239,765 | B1 | 5/2001 | Johnson et al. |
| 6,243,592 | B1 | 6/2001 | Nakada |
| 6,259,407 | B1 | 7/2001 | Tran |
| 6,266,023 | B1 | 7/2001 | Nagy et al. |
| 6,266,538 | B1 | 7/2001 | Waldron |
| 6,272,356 | B1 | 8/2001 | Dolman et al. |
| 6,281,846 | B1 | 8/2001 | Puente Baliarda et al. |
| 6,281,848 | B1 | 8/2001 | Nagumo |
| 6,285,342 | B1 | 9/2001 | Brady et al. |
| 6,288,680 | B1 | 9/2001 | Tsuru |
| 6,292,154 | B1 | 9/2001 | Deguchi et al. |
| 6,300,910 | B1 | 10/2001 | Kim |
| 6,300,914 | B1 | 10/2001 | Yang |
| 6,301,489 | B1 | 10/2001 | Winstead et al. |
| 6,307,511 | B1 | 10/2001 | Ying et al. |
| 6,307,512 | B1 | 10/2001 | Geeraert |
| 6,327,485 | B1 | 12/2001 | Waldron |
| 6,329,951 | B1 | 12/2001 | Wen et al. |
| 6,329,954 | B1 | 12/2001 | Fuchs et al. |
| 6,329,962 | B2 | 12/2001 | Ying |
| 6,333,716 | B1 | 12/2001 | Pontoppidan |
| 6,343,208 | B1 | 1/2002 | Ying |
| 6,346,914 | B1 | 2/2002 | Annamaa |
| 6,352,434 | B1 | 3/2002 | Emmert |
| 6,353,443 | B1 | 3/2002 | Ying |
| 6,360,105 | B2 | 3/2002 | Nakada et al. |
| 6,366,243 | B1 | 4/2002 | Isohatala |
| 6,367,939 | B1 | 4/2002 | Carter et al. |
| 6,373,447 | B1 | 4/2002 | Rostoker et al. |
| 6,380,902 | B2 | 4/2002 | Duroux |
| 6,384,790 | B2 | 5/2002 | Dishart |
| 6,388,626 | B1 | 5/2002 | Gamalielsson et al. |
| 6,396,444 | B1 | 5/2002 | Goward et al. |
| 6,407,710 | B2 | 6/2002 | Keilen et al. |
| 6,408,190 | B1 | 6/2002 | Ying |
| 6,417,810 | B1 | 7/2002 | Huels et al. |
| 6,417,816 | B2 | 7/2002 | Sadler et al. |
| 6,421,013 | B1 | 7/2002 | Chung |
| 6,431,712 | B1 | 8/2002 | Turnbull |
| 6,445,352 | B1 | 9/2002 | Cohen |
| 6,452,549 | B1 | 9/2002 | Lo |
| 6,452,553 | B1 | 9/2002 | Cohen |
| 6,476,766 | B1 | 11/2002 | Cohen |
| 6,483,462 | B2 | 11/2002 | Weinberger |
| 6,496,154 | B2 | 12/2002 | Gyenes |
| 6,525,691 | B2 | 2/2003 | Varadan et al. |
| 6,538,604 | B1 | 3/2003 | Isohatala |
| 6,552,690 | B2 | 4/2003 | Veerasamy |
| 6,603,434 | B2 | 8/2003 | Lindenmeier |
| 6,664,932 | B2 | 12/2003 | Sabet |
| 6,697,024 | B2 | 2/2004 | Fuerst |
| 6,707,428 | B2 | 3/2004 | Gram |
| 6,756,944 | B2 | 6/2004 | Tessier |
| 6,784,844 | B1 | 8/2004 | Boakes et al. |
| 6,831,606 | B2 | 12/2004 | Sajadinia |
| 6,839,040 | B2 | 1/2005 | Huber et al. |
| 6,928,413 | B1 | 8/2005 | Pulitzer |
| 7,015,868 | B2 | 3/2006 | Puente et al. |
| 7,123,208 | B2 | 10/2006 | Puente et al. |
| 7,148,850 | B2 | 12/2006 | Puente Baliarda |
| 7,202,822 | B2 | 4/2007 | Baliarda et al. |
| 7,394,432 | B2 | 7/2008 | Puente et al. |
| 7,397,431 | B2 | 7/2008 | Puente et al. |
| 7,511,675 | B2 | 3/2009 | Puente-Baliarda |
| 7,528,782 | B2 | 5/2009 | Puente et al. |
| 2001/0002823 | A1 | 6/2001 | Ying |
| 2001/0050636 | A1 | 12/2001 | Weinberger |
| 2002/0000940 | A1 | 1/2002 | Moren et al. |
| 2002/0109633 | A1 | 8/2002 | Ow et al. |
| 2002/0140615 | A1 | 10/2002 | Carles et al. |
| 2002/0175879 | A1 | 11/2002 | Sabet |
| 2002/0190904 | A1 | 12/2002 | Cohen |
| 2003/0090421 | A1 | 5/2003 | Sajadinia |
| 2005/0195112 | A1 | 9/2005 | Baliarda |

FOREIGN PATENT DOCUMENTS

| | | | |
|---|---|---|---|
| DE | 3337941 | | 5/1985 |
| DE | 101 42 965 | | 3/2003 |
| EP | 0096847 | | 12/1983 |
| EP | 0253608 | | 1/1988 |
| EP | 0297813 | | 1/1989 |
| EP | 0358090 | | 3/1990 |
| EP | 0396033 | A2 | 11/1990 |
| EP | 0543645 | | 5/1993 |
| EP | 0571124 | | 11/1993 |
| EP | 0620677 | A1 | 10/1994 |
| EP | 0688040 | | 12/1995 |
| EP | 0736926 | A1 | 10/1996 |
| EP | 0749176 | | 12/1996 |
| EP | 0765001 | | 3/1997 |
| EP | 0823748 | A2 | 8/1997 |
| EP | 0825672 | A2 | 8/1997 |
| EP | 0590671 | B1 | 12/1997 |
| EP | 0814536 | | 12/1997 |
| EP | 0 843 905 | | 5/1998 |
| EP | 0871238 | | 10/1998 |
| EP | 0892459 | | 1/1999 |
| EP | 0902472 | | 3/1999 |
| EP | 0929121 | | 7/1999 |
| EP | 0932219 | | 7/1999 |
| EP | 0938158 | A2 | 8/1999 |
| EP | 0942488 | | 9/1999 |
| EP | 1223637 | B1 | 9/1999 |
| EP | 0969375 | | 1/2000 |
| EP | 0986130 | | 3/2000 |
| EP | 0997974 | | 5/2000 |
| EP | 1011167 | A1 | 6/2000 |
| EP | 1016158 | B1 | 7/2000 |
| EP | 1018777 | | 7/2000 |
| EP | 1018779 | | 7/2000 |
| EP | 1 024 552 | | 8/2000 |
| EP | 1 026 774 | | 8/2000 |
| EP | 1071161 | | 1/2001 |
| EP | 1079462 | | 2/2001 |
| EP | 1 083 623 | | 3/2001 |
| EP | 1083624 | | 3/2001 |
| EP | 1 091 446 | | 4/2001 |
| EP | 1094545 | | 4/2001 |
| EP | 1096602 | | 5/2001 |
| EP | 1 126 522 | | 8/2001 |
| EP | 1148581 | | 10/2001 |
| EP | 1198027 | | 4/2002 |
| EP | 0749176 | B1 | 9/2002 |
| EP | 1237224 | | 9/2002 |
| EP | 1258054 | | 11/2002 |
| EP | 1267438 | | 12/2002 |
| EP | 0924793 | B1 | 3/2003 |
| EP | 1 317 018 | | 6/2003 |
| EP | 1 326 302 | | 7/2003 |
| EP | 1 374 336 | | 1/2004 |
| EP | 1 396 906 | | 3/2004 |
| EP | 1 414 106 | | 4/2004 |
| EP | 1 453 140 | | 9/2004 |
| EP | 0843905 | B1 | 12/2004 |
| EP | 1515392 | A2 | 3/2005 |
| EP | 0909089 | | 8/2005 |
| EP | 1592083 | | 11/2005 |
| ES | 2112163 | | 3/1998 |
| ES | 2142280 | | 5/1998 |
| ES | 200001508 | | 1/2002 |
| ES | 2174707 | | 11/2002 |
| FI | 972897 | | 1/1999 |
| FR | 2543744 | | 10/1984 |
| FR | 2704359 | | 10/1994 |
| FR | 2837339 | | 9/2003 |
| GB | 1313020 | | 8/1971 |

(56) References Cited

FOREIGN PATENT DOCUMENTS

| | | | |
|---|---|---|---|
| GB | 1313020 | | 4/1973 |
| GB | 2 161 026 | | 1/1986 |
| GB | 2215136 | | 9/1989 |
| GB | 2 293 275 | | 3/1996 |
| GB | 2317994 | | 4/1998 |
| GB | 2330951 | | 5/1999 |
| GB | 2355116 | | 4/2001 |
| JP | 55-147806 | | 11/1980 |
| JP | 5007109 | | 1/1993 |
| JP | 5129816 | | 5/1993 |
| JP | 05-283928 | | 10/1993 |
| JP | 5267916 | | 10/1993 |
| JP | 5-308223 | | 11/1993 |
| JP | 5347507 | | 12/1993 |
| JP | 60-85530 | | 3/1994 |
| JP | 6204908 | | 7/1994 |
| JP | H6-252629 | | 9/1994 |
| JP | 773310 | | 3/1995 |
| JP | 8052968 | A1 | 2/1996 |
| JP | 09-069718 | | 3/1997 |
| JP | 9 199 939 | | 7/1997 |
| JP | 9-246852 | | 9/1997 |
| JP | H10-163748 | | 6/1998 |
| JP | 10209744 | | 8/1998 |
| JP | 10-303637 | | 11/1998 |
| JP | 11-004113 | | 1/1999 |
| JP | 11-27042 | | 1/1999 |
| JP | 11-220319 | | 8/1999 |
| JP | 11-136015 | | 4/2005 |
| SE | 5 189 88 | | 12/2002 |
| WO | 88/09065 | | 11/1988 |
| WO | 93/12559 | | 6/1993 |
| WO | 95/11530 | | 4/1995 |
| WO | 96/27219 | | 9/1996 |
| WO | 96/29755 | | 9/1996 |
| WO | 96/68881 | | 12/1996 |
| WO | 97/06578 | | 2/1997 |
| WO | 97/07557 | | 2/1997 |
| WO | 97/11507 | | 3/1997 |
| WO | 97/32355 | | 9/1997 |
| WO | 97/33338 | | 9/1997 |
| WO | 97/35360 | | 9/1997 |
| WO | 97/47054 | | 12/1997 |
| WO | 98/05088 | | 2/1998 |
| WO | 98/12771 | | 3/1998 |
| WO | 98/20578 | | 5/1998 |
| WO | 98/36469 | | 8/1998 |
| WO | 99/03166 | | 1/1999 |
| WO | 99/03167 | | 1/1999 |
| WO | 99/25042 | | 5/1999 |
| WO | 99/25044 | | 5/1999 |
| WO | 99/27608 | | 6/1999 |
| WO | 9943039 | A1 | 8/1999 |
| WO | 99/56345 | | 11/1999 |
| WO | 99/65102 | | 12/1999 |
| WO | 00/01028 | | 1/2000 |
| WO | 00/03167 | | 1/2000 |
| WO | 00/03453 | | 1/2000 |
| WO | 00/22695 | | 4/2000 |
| WO | 0025266 | A1 | 5/2000 |
| WO | 00/36700 | | 6/2000 |
| WO | 0034916 | A1 | 6/2000 |
| WO | 00/49680 | | 8/2000 |
| WO | 00/52784 | | 9/2000 |
| WO | 00/52787 | | 9/2000 |
| WO | 00/65686 | | 11/2000 |
| WO | 00/67342 | A1 | 11/2000 |
| WO | 00/77884 | | 12/2000 |
| WO | 0077728 | A1 | 12/2000 |
| WO | 01/03238 | | 1/2001 |
| WO | 01/05048 | | 1/2001 |
| WO | 01/82410 | | 1/2001 |
| WO | 01/08254 | | 2/2001 |
| WO | 01/08257 | | 2/2001 |
| WO | 01/08260 | | 2/2001 |
| WO | 01/11721 | | 2/2001 |
| WO | 01/13464 | | 2/2001 |
| WO | 0108093 | A1 | 2/2001 |
| WO | 01/15271 | | 3/2001 |
| WO | 01/17063 | | 3/2001 |
| WO | 01/17064 | | 3/2001 |
| WO | 01/20714 | | 3/2001 |
| WO | 01/20927 | | 3/2001 |
| WO | 01/22528 | | 3/2001 |
| WO | 01/24314 | | 4/2001 |
| WO | 01/26182 | | 4/2001 |
| WO | 01/28035 | | 4/2001 |
| WO | 01/31739 | | 5/2001 |
| WO | 01/33663 | | 5/2001 |
| WO | 01/33664 | | 5/2001 |
| WO | 01/33665 | | 5/2001 |
| WO | 01/35491 | | 5/2001 |
| WO | 01/35492 | | 5/2001 |
| WO | 01/037369 | | 5/2001 |
| WO | 01/37370 | | 5/2001 |
| WO | 0131747 | A1 | 5/2001 |
| WO | 01/41252 | | 6/2001 |
| WO | 01/47056 | | 6/2001 |
| WO | 01/48860 | | 7/2001 |
| WO | 01/48861 | | 7/2001 |
| WO | 01/54225 | | 7/2001 |
| WO | 01/65636 | | 9/2001 |
| WO | 01/73890 | | 10/2001 |
| WO | 01/78192 | | 10/2001 |
| WO | 01/86753 | | 11/2001 |
| WO | 01/89031 | | 11/2001 |
| WO | 02/35646 | | 5/2002 |
| WO | 02/35652 | | 5/2002 |
| WO | 02/078121 | | 10/2002 |
| WO | 02/078123 | | 10/2002 |
| WO | 02/078124 | | 10/2002 |
| WO | 02/080306 | | 10/2002 |
| WO | 02/084790 | | 10/2002 |
| WO | 02/091518 | | 11/2002 |
| WO | 02/095874 | | 11/2002 |
| WO | 02/096166 | | 11/2002 |
| WO | 03/017421 | | 2/2003 |
| WO | 03/023900 | | 3/2003 |
| WO | 2005/076933 | | 8/2005 |
| WO | 2005/081358 | | 9/2005 |

OTHER PUBLICATIONS

Falconer , K., Fractal Geometry: Mathematical Foundations and Applications, John Wiley & Sons, 1990, pp. 38-44.

Falconer , K., Fractal Geometry: Mathematical Foundations and Applications, John Wiley & Sons, 1990, pp. 38-45.

Defendants, LG Electronics Inc., LG Electronics USA, Inc., and LG Electronics Mobilecomm USA Inc. First Amended Answer and Counterclaim to Second Amended Complaint in the case of *Fractus SA* v. *Samsung Electornics Co. Ltd. et al.* Case No. 6:09-cv-00203 (E.D. Tex.) dated Jan. 24, 2010.

Defendants, Research in Motion Ltd, and Research in Motion Corporation's Amended Answer, Defenses and Counterclaims to Plaintiff's Amended Complaint in the case of *Fractus SA* v. *Samsung Electornics Co. Ltd. et al.* Case No. 6:09-cv-00203 (E.D. Tex.) dated Nov. 24, 2009.

Defendants, Research in Motion LTD, and Research in Motion Corporation's Answers, Defenses and Counterclaims to Plaintiffs Amended Complaint in the case of *Fractus SA* v. *Samsung Electornics Co. Ltd. et al.* Case No. 6:09- cv-00203 (E.D. Tex.) dated Oct. 1, 2009.

Defendants, RIM, Samsung, HTC, LG and Pantech's Response to Fractus SA's Opening Claim Construction Brief and Chart of Agreed Terms and Disputed Terms in the case of *Fractus SA* v. *Samsung Electornics Co. Ltd. et al.* dated Jul. 30, 2010.

Defendants, Samsung Electronics Co., Ltd.'s; Samsung Electronics Research Institute's and Samsung Semiconductor Europe GMBH' s Answer; and Samsung Telecommunications America LLC' s Answer and Counterclaim to Second Amended Complaint in the case of *Fractus SA* v. *Samsung Electornics Co. Ltd. et al.* Case No. 6:09-cv-00203 (E.D. Tex.) dated Dec. 23, 2009.

(56) References Cited

OTHER PUBLICATIONS

Defendants, Samsung Electronics Co., Ltd.'s; Samsung Electronics Research Institute's and Samsung Semiconductor Europe GMBH' s Answer; and Samsung Telecommunications America LLC' s Answer and Counterclaim to the Amended Complaint of Plaintiff in the case of *Fractus SA* v. *Samsung Electornics Co. Ltd. et al.* Case No. 6:09-cv-00203 (E.D. Tex.) dated Oct. 1, 2009.
Defendants, Samsung Electronics Co., Ltd.'s; Samsung Electronics Research Institute's and Samsung Semiconductor Europe GMBH' s First Amended Answer; and Samsung Telecommunications America LLC' s First Amended Answer and Counterclaim to the Second Amended Complaint in the case of *Fractus SA* v. *Samsung Electornics Co. Ltd. et al.* Case No. 6:09-cv-00203 (E.D. Tex.) dated Feb. 24, 2010.
European Patent Convention, Article 123(2).
Falconer, Kenneth , Fractal Geometry: Mathematical Foundations and Applications, pp. 38-41, Jonh Wiley & Sons 1st ed dated Jan. 1, 1990.
Feder, J. , Fractals , Plenum Press, pp. 10-11, 15-17, and 25, Plenum Press dated Jan. 1, 1988.
Felgel-Farnholz, W. D. International Preliminary Examination Report for the PCT patent application EP00/00411. European Patent Office dated on Aug. 29, 2002.
Felgel-Farnholz, W.D. Invitation to restrict or to pay additional fees for the PCT/EP00/00411. International Preliminary Examination Authority, EPO. Mar. 5, 2002.
Fleishmann , M. ; Tildesley , DJ ; Balls , RC, Fractals in the natural sciences, Royal Society of London dated Jan. 1, 1990.
Fractus, Amended Complaint for Patent Infringement in the case of *Fractus SA* v. *Samsung Electornics Co. Ltd. et al.* Case No. 6:09-cv-00203 (E.D. Tex.) dated May 6, 2009.
Fractus, Answer to Amended Counterclaims of Defendant HTC America, Inc. to Second Amended Complaint in the case of *Fractus SA* v. *Samsung Electornics Co. Ltd. et al.* Case No. 6:09-cv-00203 (E.D. Tex.) dated Apr. 1, 2010.
Fractus, Answer to Amended Counterclaims of Defendant HTC Corporation to Second Amended Complaint in the case of *Fractus SA* v. *Samsung Electornics Co. Ltd. et al.* Case No. 6:09-cv-00203 (E.D. Tex.) dated Apr. 1, 2010.
Fractus, Answer to Amended Counterclaims of Defendant LG Electronics Inc., LG Electronics USA, Inc., and LG Electronics Mobilecomm USA Inc's to Second Amended Complaint in the case of *Fractus SA* v. *Samsung Electornics Co. Ltd. et al.* Case No. 6:09-cv-00203 (E.D. Tex.) dated Apr. 1, 2010.
Fractus, Answer to Amended Counterclaims of Defendant Samsung Telecommunications america LLC's to Second Amended Complaint in the case of *Fractus SA* v. *Samsung Electornics Co. Ltd. et al.* Case No. 6:09-cv-00203 (E.D. Tex.) dated Apr. 1, 2010.
Fractus, Answer to Counterclaims of Defendant Kyocera Communications, Inc's Counterclaims to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Counterclaims of Defendant Pantech Wireless, Inc. to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Counterclaims of Defendant Samsung Telecommunications America LLC to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Counterclaims of Defendants HTC America, Inc to the Second Amended Complaint in the case of *Fractus SA* v. *Samsung Electornics Co. Ltd. et al.* Case No. 6:09-cv-00203 (E.D. Tex.) dated Jan. 14, 2010.
Fractus, Answer to Counterclaims of Defendants LG Electronics Inc., Electronics USA, Inc., and LG Electronics Mobilecomm USA, Inc. to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Defendant Kyocera Wireless Corp's Counterclaims to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Defendant Palm, Inc's Counterclaims to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Defendant Personal Communications Devices Holdings, LLC's Counterclaims to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to Defendant UTStarcom, Inc's Counterclaims to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Answer to the Counterclaims of Defendants Research in Motion LTD. and Research in Motion Corporation to the Second Amended Complaint in the case of *Fractus SA* v. *Samsung Electornics Co. Ltd. et al.* Case No. 6:09-cv-00203 (E.D. Tex.) dated Jan. 4, 2010.
Fractus, Civil Cover Sheet in the case of *Fractus SA* v. *Samsung Electornics Co. Ltd. et al.* Case No. 6:09-cv-00203 (Ed. Tex.) dated May 5, 2009.
Fractus, Claim Construction Presentation, Markman Hearing in the case of *Fractus SA* v. *Samsung Electornics Co. Ltd. et al.* Case No. 6:09-cv-00203 (Ed. Tex.) dated Sep. 2, 2010.
Fractus, Complaint for Patent Infringement in the case of *Fractus SA* v. *Samsung Electornics Co. Ltd. et al.* Case No. 6:09-cv-00203 (E.D. Tex.) dated May 5, 2009.
Fractus, Fractus SA's Opening Claim Construction Brief with Parties' Proposed and Agreed Constructions in the case of *Fractus SA* v. *Samsung Electornics Co. Ltd. et al.* Case No. 6:09-cv-00203 (E.D. Tex.) dated Jul. 16, 2010.
Fractus, Jaggard, Expert declaration by Dr. Jaggard including exhibits in the case of *Fractus SA* v. *Samsung Electornics Co. Ltd. et al.* Case No. 6:09-cv-00203 (E.D. Tex.) dated Aug. 16, 2010.
Fractus, Opposition to Defendants Motion for Summary Judment of Invalidity in the case of *Fractus SA* v. *Samsung Electornics Co. Ltd. et al.* Case No. 60:09cv203 (E.D. Tex.) dated Aug. 16, 2010.
Fractus, Second Amended Complaint for Patent Infringement in the case of *Fractus SA* v. *Samsung Electornics Co. Ltd. et al.* Case No. 6:09-cv-00203 (Ed. Tex.) dated Dec. 2, 2009.
Fractus, Second Amended Complaint for Patent Infringement in the case of *Fractus SA* v. *Samsung Electornics Co. Ltd. et al.* Case No. 6:09-cv-00203 (Ed. Tex.) dated Dec. 8, 2009.
Fractus's answer to defendant Pantech Wireless Inc. in the case of *Fractus SA* vs. *Samsung Electronics* cp. Jun. 24, 2009.
Fractus's answer to defendant UT Starcom, Inc. counterclaims. in the case of *Fractus SA* vs. *Samsung Electronics* cp. Jun. 29, 2009.
Fractus's opposition to defendants' motion for summary judgement of invalidity based on indefiniteness and lack of written description for certain terms. Fractus, Aug. 16, 2010.
Frequency-independent features of self-similar fractal antennas Radio Science, vol. 31, No. 6 (Nov.-Dec. 1996).
Frontiers in electromagnetics, IEEE Press, 2000. pp. 5-7 of Fractal Electrodynamics, IEEE Press, 2000.
Graf, R , Modern dictionary of electronics (6th Ed.), Butterworth-Heinemann, pp. 209, 644 dated Jan. 1, 1984.
Henderson , B. , The Prentice-Hall Encyclopedia of Mathematics, Prentice-Hall dated on Jan. 1, 1982.
http://www.fractus.com/main/fractus/corporate/ [Aug. 2010] Fractus.
IEEE Standard dictionary of electrical and electronics terms (6th ed.) IEEE Standard. 1996 Pags 229, 431, 595, 857.
Jaggard , D. , Diffraction by Bandlimited Fractal Screens, Optical Soc'y Am. A 1055 dated Jan. 1, 1987.
Jhonson, R. C. Antenna Engineering Handbook (3d ed. 1993).
Johnson, R , Antenna Engineering Handbook, Mc Graw Hill (3rd Ed.) pp. 4-26, 4-33 dated Jan. 1, 1993.
Kraus, Antennas, John Wiley and Sons dated Jan. 1, 1988.
Lancaster et al. Superconducting filters using slow wave transmission lines, Advances in superconductivity. New materials, critical current

(56) References Cited

OTHER PUBLICATIONS and devices. Proceedings of the international symposium. New age int, New Delhi, India, dated on Jan. 1, 1996.
Infringement Chart—Blackberry 8100. Patent: 7,148,850. Fractus, 2009.
Infringement Chart—Blackberry 8100. Patent: 7,202,822. Fractus, 2009.
Infringement Chart—Blackberry 8110. Patent: 7,148,850. Fractus, 2009.
Infringement Chart—Blackberry 8110. Patent: 7,202,822. Fractus, 2009.
Infringement Chart—Blackberry 8120. Patent: 7,148,850. Fractus, 2009.
Infringement Chart—Blackberry 8120. Patent: 7,202,822. Fractus, 2009.
Infringement Chart—Blackberry 8130. Patent: 7,148,850. Fractus, 2009.
Infringement Chart—Blackberry 8130. Patent: 7,202,822. Fractus, 2009.
Infringement Chart—Blackberry 8220. Patent: 7,148,850. Fractus, 2009.
Infringement Chart—Blackberry 8220. Patent: 7,202,822. Fractus, 2009.
Infringement Chart—Blackberry 8310. Patent: 7,148,850. Fractus, 2009.
Infringement Chart—Blackberry 8310. Patent: 7,202,822. Fractus, 2009.
Infringement Chart—Blackberry 8320. Patent: 7,148,850. Fractus, 2009.
Infringement Chart—Blackberry 8320. Patent: 7,202,822. Fractus, 2009.
Infringement Chart—Blackberry 8330. Patent: 7,148,850. Fractus, 2009.
Infringement Chart—Blackberry 8330. Patent: 7,202,822. Fractus, 2009.
Infringement Chart—Blackberry 8820. Patent: 7,148,850. Fractus, 2009.
Infringement Chart—Blackberry 8820. Patent: 7,202,822. Fractus, 2009.
Infringement Chart—Blackberry 8830. Patent: 7,148,850. Fractus, 2009.
Infringement Chart—Blackberry 8830. Patent: 7,202,822. Fractus, 2009.
Infringement Chart—Blackberry 8900. Patent: 7,148,850. Fractus, 2009.
Infringement Chart—Blackberry 8900. Patent: 7,202,822. Fractus, 2009.
Infringement Chart—Blackberry 9630. Patent: 7,148,850. Fractus, 2009.
Infringement Chart—Blackberry 9630. Patent: 7,202,822. Fractus, 2009.
Infringement Chart—Blackberry Bold 9000. Patent: 7,148,850. Fractus, 2009.
Infringement Chart—Blackberry Bold 9000. Patent: 7,202,822. Fractus, 2009.
Infringement Chart—Blackberry Storm 9530. Patent: 7,148,850. Fractus, 2009.
Infringement Chart—Blackberry Storm 9530. Patent: 7,202,822. Fractus, 2009.
Infringement Chart—HTC Dash. Fractus, 2009.
Infringement Chart—HTC Dash. Patent: 7,148,850. Fractus, 2009.
Infringement Chart—HTC Dash. Patent: 7,202,822. Fractus, 2009.
Infringement Chart—HTC Diamond. Fractus, 2009.
Infringement Chart—HTC Diamond. Patent: 7,148,850. Fractus, 2009.
Infringement Chart—HTC Diamond. Patent: 7,202,822. Fractus, 2009.
Infringement Chart—HTC G1 Google.. Fractus, 2009.
Infringement Chart—HTC G1 Google. Patent: 7,148,850. Fractus, 2009.
Infringement Chart—HTC G1 Google. Patent: 7,202,822. Fractus, 2009.
Infringement Chart—HTC My Touch.. Fractus, 2009.
Infringement Chart—HTC MyTouch. Patent: 7,202,822. Fractus, 2009.
Infringement Chart—HTC Ozone. Fractus, 2009.
Infringement Chart—HTC Ozone. Patent: 7,148,850. Fractus, 2009.
Infringement Chart—HTC Ozone. Patent: 7,202,822. Fractus, 2009.
Infringement Chart—HTC Pure. Fractus, 2009.
Infringement Chart—HTC Pure. Patent: 7,148,850. Fractus, 2009.
Infringement Chart—HTC Pure. Patent: 7,202,822. Fractus, 2009.
Infringement Chart—HTC Snap. Fractus, 2009.
Infringement Chart—HTC Snap. Patent: 7,148,850. Fractus, 2009.
Infringement Chart—HTC Snap. Patent: 7,202,822. Fractus, 2009.
Infringement Chart—HTC TILT 8925. Fractus, 2009.
Infringement Chart—Samsung SCH U700. Patent: 7,202,822. Fractus, 2009.
Infringement Chart—Samsung SCH U700. Patent:7,148,850. Fractus, 2009.
Infringement Chart—Samsung SCH UA10. Fractus, 2009.
Infringement Chart—Samsung SCH-A630. Fractus, 2009.
Infringement Chart—Samsung SCH-A630. Patent: 7,148,850. Fractus, 2009.
Infringement Chart—Samsung SCH-A630. Patent: 7,202,822. Fractus, 2009.
Infringement Chart—Samsung SCH-A645. Fractus, 2009.
Infringement Chart—Samsung SCH-A645. Patent: 7,148,850. Fractus, 2009.
Infringement Chart—Samsung SCH-A645. Patent: 7,202,822. Fractus, 2009.
Infringement Chart—Samsung SCH-A870. Fractus, 2009.
Infringement Chart—Samsung SCH-A887 Solstice. Patent: 7,148,850. Fractus, 2009.
Infringement Chart—Samsung SCH-A887 Solstice. Patent: 7,202,822. Fractus, 2009.
Infringement Chart—Samsung SCH-I910. Fractus, 2009.
Infringement Chart—Samsung SCH-I910. Patent: 7,148,850. Fractus, 2009.
Infringement Chart—Samsung SCH-I910. Patent: 7,202,822. Fractus, 2009.
Infringement Chart—Samsung SCH-R430. Fractus, 2009.
Infringement Chart—Samsung SCH-R430. Patent: 7,148,850. Fractus, 2009.
Infringement Chart—Samsung SCH-R430. Patent: 7,202,822. Fractus, 2009.
Infringement Chart—Samsung SCH-R500. Fractus, 2009.
Infringement Chart—Samsung SCH-R500. Patent: 7,148,850. Fractus, 2009.
Infringement Chart—Samsung SCH-R500. Patent: 7,202,822. Fractus, 2009.
Infringement Chart—Samsung SCH-R600. Fractus, 2009.
Infringement Chart—Samsung SCH-R600. Patent: 7,148,850. Fractus, 2009.
Infringement Chart—Samsung SCH-R600. Patent: 7,202,822. Fractus, 2009.
Infringement Chart—Samsung SCH-R800. Fractus, 2009.
Infringement Chart—Samsung SCH-R800. Patent: 7,148,850. Fractus, 2009.
Infringement Chart—Samsung SCH-R800. Patent: 7,202,822. Fractus, 2009.
Infringement Chart—Samsung SCH-U310. Fractus, 2009.
Infringement Chart—Samsung SCH-U310. Patent: 7,148,850. Fractus, 2009.
Infringement Chart—Samsung SCH-U310. Patent: 7,202,822. Fractus, 2009.
Infringement Chart—Samsung SCH-U430. Fractus, 2009.
Infringement Chart—Samsung SCH-U430. Patent: 7,148,850. Fractus, 2009.
Infringement Chart—Samsung SCH-U430. Patent: 7,202,822. Fractus, 2009.
Infringement Chart—Samsung SCH-U470. Fractus, 2009.
Infringement Chart—Samsung SCH-U470. Patent: 7,148,850. Fractus, 2009.

(56) References Cited

OTHER PUBLICATIONS

Infringement Chart—Samsung SCH-U470. Patent: 7,202,822. Fractus, 2009.
Infringement Chart—Samsung SCH-U520. Fractus, 2009.
Infringement Chart—Samsung SCH-U520. Patent: 7,148,850. Fractus, 2009.
Infringement Chart—Samsung SCH-U520. Patent: 7,202,822. Fractus, 2009.
Infringement Chart—Samsung SCH-U740. Fractus, 2009.
Infringement Chart—Samsung SCH-U740. Patent: 7,148,850. Fractus, 2009.
Infringement Chart—Samsung SCH-U740. Patent: 7,202,822. Fractus, 2009.
Infringement Chart—Samsung SCH-U750. Fractus, 2009.
Infringement Chart—Samsung SCH-U750. Patent: 7,148,850. Fractus, 2009.
Infringement Chart—Samsung SCH-U750. Patent: 7,202,822. Fractus, 2009.
Infringement Chart—Samsung SCH-U940. Fractus, 2009.
Infringement Chart—Samsung SCH-U940. Patent. 7,202,822. Fractus, 2009.
Infringement Chart—Samsung SCH-U940. Patent: 7,148,850. Fractus, 2009.
Infringement Chart—Samsung SGH A117. Fractus, 2009.
Infringement Chart—Samsung SGH A117. Patent: 7,148,850. Fractus, 2009.
Response to Fractus Opposition to Defendants motion for summary judgement of invalidity in the case of *Fractus SA* v. *Samsung Electronics Co. Ltd. et al* Case No. 60:09cv203.
Response to the office action dated on Feb. 16, 2007 for the Chinese patent application 01823716. Fractus dated on Aug. 21, 2007.
Response to the office action dated on Nov. 5, 2004 for the Chinese patent application 00818542 CcCPIT Patent and Trademark Law Office March dated on Mar. 31, 2005.
Response to the office action dated on Sep. 21, 2007 for the Chinese patent application 01823716. Fractus dated on Dec. 3, 2007.
Rich , B., Review of Elementary Mathematics, 2nd ed. McGraw-Hill dated Jan. 1, 1997.
Sauer , J. M. Response to the office action dated on Jan. 26, 2006 for the U.S. Appl. No. 10/422,579. Jones Day dated on May 1, 2006.
Sauer , J. M. Response to the office action dated on Apr. 7, 2005 for the U.S. Appl. No. 10/422,578. Jones Day dated on Aug. 8, 2005.
Sauer , J. M. Response to the office action dated on Aug. 27, 2004 for the U.S. Appl. No. 10/181,790. Jones Day dated on Dec. 10, 2004.
Sauer , J. M. Response to the office action dated on Jun. 2, 2005. Jones Day dated on Jul. 20, 2005.
Sauer , J. M. Response to the office action dated on Mar. 2, 2005 for the U.S. Appl. No. 11/181,790. Jones Day dated on Mar. 14, 2005.
Sauer, J. M., Amendment in File History of U.S. Patent No. 7,015,868, Jones Day dated Dec. 10, 2004.
Sawaya, K, A simplified Expression of Dyadic Green's Function for a Conduction Half Sheet, IEEE Transactions on Antennas & Propagation, vol. AP-29, No. 5 (Sep. 1981) dated Sep. 1, 1981.
Sclater , N. , McFraw-Hill Electroncs Dictionary, Mc Graw-Hill dated on Jan. 1, 1997.
Stutzman , W. ; Thiele , G., Antenna theory and design, John Wiley and Sons, pp. 18, 36 dated Jan. 1, 1981.
Stutzman , W. , Antenna theory and design, 2nd ed. John Wiley and Sons dated Jan. 1, 1998.
The American Heritage College Dictionary (3d ed. 1997), Houghton Mifflin Comp.; pp. 684 and 1060 dated Jan. 1, 1997.
The American Heritage Dictionary (2d College ed.). Morris William, pp. 960 dated Jan. 1, 1982.
The American Heritage Dictionary, New College ed. (2nd ed. 1982). pp. 311, 1208, dated Jan. 1, 1982.
The Random House Dictionary, Random House, 1984. pp. 1029, 1034, dated Jan. 1, 1984.
Theiler, J, Estimating Fractal Dimension, Journal Optical Society Am. A, 7(6), pp. 1055-1073 dated on Jun. 1, 1990.
Tinker , J. A. Response to the office action dated on Oct. 30, 2007 for the U.S. Appl. No. 11/021,597. Winstead dated on Dec. 28, 2007.
Walker, B.D., Preliminary Amendment for U.S. Appl. No. 11/110,052. Howison & Arnott, dated on Apr. 20, 2005.
Walker, B.D., Preliminary Amendment for U.S. Appl. No. 11/780,932. Howison & Arnott, dated Jul. 20, 2007.
Walker, B.D., Response to Office Action for U.S. Appl. No. 11/179,250, Howison & Arnott, dated on Jul. 12, 2005.
Watson , T. ; Friesser , J., A phase shift direction finding technique, Annual Symposium on the USAF antenna research and development program dated Oct. 21, 1957.
West , B.H. et al., The Prentice-Hall Encyclopedia of Mathematics. Prentice-Hall, pp. 404-405 dated on Jan. 1, 1982.
Wikka , K., Letter to FCC that will authorize the appointment of Morton Flom Eng and/or Flomassociates Inc to act as their Agent in all FCC matters, Nokia Mobile Phones dated Aug. 5, 1999.
Wimer, M. Office Action for the U.S. Appl. No. 10/422,578. USPTO dated on Aug. 23, 2007.
Wimer, M. Office Action for the U.S. Appl. No. 10/422,578. USPTO dated on Jan. 26, 2006.
Wimer, M. Office Action for the U.S. Appl. No. 10/422,578. USPTO dated on Mar. 12, 2007.
Wimer, M. Office Action for the U.S. Appl. No. 10/422,578. USPTO dated on Mar. 26, 2008.
Wimer, M. C. Office action for the U.S. Appl. No. 11/021,597. USPTO dated on Mar. 12, 2007.
Wimer, M. C. Office action for the U.S. Appl. No. 11/021,597. USPTO dated on Oct. 30, 2007.
Wimer, M. Office Action for the U.S. Appl. No. 10/422,578. USPTO dated on Aug. 24, 2005.
Wimer, M., Notice of Allowance of U.S. Appl. No. 10/822,933. USPTO, dated on Oct. 18, 2007.
www.tsc.upc.es/fractalcoms/ [Aug. 2010]. UPC.
Request for inter partes reexamination for US patent 7,202,822 (95/001,414) including claim charts from CC-A-1 to CCD—Samsung. Aug. 4, 2010.
Defendants Rim, Samsung, HTC, LG and Pantech's response to plantiff Fractus SA's opening claim construction brief in Case 6:09-cv-00203-LED-JDL—Exhibit 33—Excerpt from Plaintiff's '868 pat. inf. cont. for Samsung SPH M540.
Defendants Rim, Samsung, HTC, LG and Pantech's response to plantiff Fractus SA's opening claim construction brief in Case 6:09-cv-00203-LED-JDL—Exhibit 34—Excerpts from Plaintiffs '431 patent Infringement Contentions of HTC Diamond.
Defendants Rim, Samsung, HTC, LG and Pantech's response to plantiff Fractus SA's opening claim construction brief in Case 6:09-cv-00203-LED-JDL—Exhibit 41—Demonstrative re: counting segments.
Defendants Rim, Samsung, HTC, LG and Pantech's response to plantiff Fractus SA's opening claim construction brief in Case 6:09-cv-00203-LED-JDL—Exhibit 42—Demonstrative showing how straight segments can be fitted over a curved surface.
Defendants Rim, Samsung, HTC, LG and Pantech's response to plantiff Fractus SA's opening claim construction brief in Case 6:09-cv-00203-LED-JDL—Exhibit 57—Excerpts from Plaintiffs '868 and '762 Pat. Infr. cont. for Rim 8310.
Defendants Rim, Samsung, HTC, LG and Pantech's response to plantiff Fractus SA's opening claim construction brief in "Case 6:09-cv-00203-LED-JDL"—Exhibit 1—Chart of Agreed Terms and Disputed Terms.
Defendants Rim, Samsung, HTC, LG and Pantech's response to plantiff Fractus SA's opening claim construction brief in "Case 6:09-cv-00203-LED-JDL"—Exhibit 2—Family Tree of Asserted Patents.
Fontenay , P. Communication of the board of appeal. Rules of procedure of the boards of appeal. EPO. Dec. 30, 2010.
Menefee , J. Office action for the U.S. Appl. No. 95/001,413. USPTO dated on Aug. 10, 2010.
Fractus's Objections to Claim Construction Memorandum and Order. Jan. 14, 2011.
Addison , P. S. Fractals and chaos—An illustrated course. Institute of Physics Publishing, 1997.
Infringement Chart—Pantech C740. Fractus, 2009.

(56) References Cited

OTHER PUBLICATIONS

Infringement Chart—Pantech C740. Patent: 7,202,822. Fractus, 2009.
Infringement Chart—Pantech DUO C810. Fractus, 2009.
Infringement Chart—Pantech DUO C810. Patent: 7,148,850. Fractus, 2009.
Infringement Chart—Pantech DUO C810. Patent: 7,202,822. Fractus, 2009.
Infringement Chart—Pantech Slate C530. Fractus, 2009.
Infringement Chart—Patench C740. Patent: 7,148,850. Fractus, 2009.
Infringement Chart—RIM Blackberry 8110. Fractus, 2009.
Infringement Chart—RIM Blackberry 8120. Fractus, 2009.
Infringement Chart—RIM Blackberry 8130. Fractus, 2009.
Infringement Chart—RIM Blackberry 8220. Fractus, 2009.
Infringement Chart—RIM Blackberry 8310. Fractus, 2009.
Infringement Chart—RIM Blackberry 8320. Fractus, 2009.
Infringement Chart—RIM Blackberry 8330. Fractus, 2009.
Infringement Chart—RIM Blackberry 8820. Fractus, 2009.
Infringement Chart—RIM Blackberry 8830. Fractus, 2009.
Infringement Chart—RIM Blackberry 8900. Fractus, 2009.
Infringement Chart—RIM Blackberry 9630. Fractus, 2009.
Infringement Chart—RIM Blackberry Bold 9000. Fractus, 2009.
Infringement Chart—RIM Blackberry Pearl 8100. Fractus, 2009.
Infringement Chart—RIM Blackberry Storm 9530. Fractus, 2009.
Infringement Chart—Samsung Blackjack II SCH-I617. Patent: 7,148,850. Fractus, 2009.
Infringement Chart—Samsung Blackjack II SCH-I617. Patent: 7,202,822. Fractus, 2009.
Infringement Chart—Samsung Blackjack II SGH-i617. Fractus, 2009.
Infringement Chart—Samsung Blast SGH T729. Fractus, 2009.
Infringement Chart—Samsung Blast SGH-T729. Patent: 7,148,850. Fractus, 2009.
Infringement Chart—Samsung Blast SGH-T729. Patent: 7,202,822. Fractus, 2009.
Infringement Chart—Samsung EPIX SGH-1907. Fractus, 2009.
Infringement Chart—Samsung FlipShot SCH-U900. Fractus, 2009.
Infringement Chart—Samsung FlipShot SCH-U900. Patent: 7,148,850. Fractus, 2009.
Infringement Chart—Samsung FlipShot SCH-U900. Patent: 7,202,822. Fractus, 2009.
Infringement Chart—Samsung Instinct M800. Fractus, 2009.
Infringement Chart—Samsung Instinct M800. Patent: 7,148,850. Fractus, 2009.
Infringement Chart—Samsung Instinct M800. Patent: 7,202,822. Fractus, 2009.
Infringement Chart—Samsung M320. Fractus, 2009.
Infringement Chart—Samsung M320. Patent: 7,148,850. Fractus, 2009.
Infringement Chart—Samsung M320. Patent: 7,202,822. Fractus, 2009.
Infringement Chart—Samsung Messager. Fractus, 2009.
Infringement Chart—Samsung Messager. Patent: 7,148,850. Fractus, 2009.
Infringement Chart—Samsung Messager. Patent: 7,202,822. Fractus, 2009.
Infringement Chart—Samsung Omnia SGH-I900. Fractus, 2009.
Infringement Chart—Samsung Omnia SGH-I900. Patent: 7,148,850. Fractus, 2009.
Infringement Chart—Samsung Omnia SGH-I900. Patent: 7,202,822. Fractus, 2009.
Infringement Chart—Samsung SCH A127. Fractus, 2009.
Infringement Chart—Samsung SCH U340. Fractus, 2009.
Infringement Chart—Samsung SCH U340. Patent: 7,148,850. Fractus, 2009.
Infringement Chart—Samsung SCH U340. Patent: 7,202,822. Fractus, 2009.
Infringement Chart—Samsung SCH U410. Patent: 7,148,850. Fractus, 2009.
Infringement Chart—Samsung SCH U410. Patent: 7,202,822. Fractus, 2009.
Infringement Chart—Samsung SCH U700. Fractus, 2009.
Felgel-Farnholz, W. Office Action for US patent application EP00909089, dated on Feb. 7, 2003.
Response Office Action for CN patent application 00818542.5 dated Nov. 5, 2004; Mar. 31, 2005.
Wimer, M. Office Action for US patent application 7,312,762 dated Oct. 5, 2006.
Sauer, J. Response to Office Action for US patent application 7,312,762 dated on Dec. 27, 2006 ; Jan. 4, 2007.
Howe , Micah J. Fractus, S.A.'s objections to the Court's Mar. 9, 2011, Order—Document 768. Susman Godfrey LLP Mar. 25, 2011.
Jones, Michael E. Defendants' opposition to Fractus SA objections to the Court's Mar. 9, 2011 Order—Document 780. Baker Botts, LLP Mar. 31, 2011.
NA Stipulation of Dismissal of all Claims and Counterclaims re '850 and '822—Document 841. Defendants Apr. 15, 2011.
NA Joint Motion to Dismiss Claims and Counterclaims re '850 and '822—Document 843. Defendants Apr. 15, 2011.
NA Defendants' Motion to Clarify Claim Construction—Document 854. Defendants Apr. 18, 2011.
Love , J. D. Order—Document 868. United States Magristrate Judge, Apr. 19, 2011.
Behncke , M. Fractus's surreply to defendants' Motion for Summary Judgment re publication dates of three references—Document 876. Susman Godfrey LLP, Apr. 20, 2011.
Howe , M. Fractus's Response to Defendants' Motion to Clarify Claim Construction—Document 887. Susman and Godfrey, Apr. 25, 2011.
NA Reply in support of defendants' motion to clarify claim construction—Document 889. Defendants, Apr. 27, 2011.
Document 901—Report and recommendation of United States Magistrate Judge. Court, Feb. 5, 2011.
Document 902—Fractus SA's objections to defendants' prior art notice. Susman Godfrey, Feb. 5, 2011.
Document 915—Defendants' response to plaintiffs objections to defendants notice of prior art. Defendants, May 5, 2011.
Document 933—Defendants' motion for reconsideration of, and objections to, the May 2, 2011 report and recommendation clarifying claim construction. Defendants, Sep. 5, 2011.
Document 939—Fractus's response to defendants' motion for reconsideration of and objections to the May 2, 2011, report and recommendations clarifying claim construction. Susman Godfrey, Oct. 5, 2011.
Harrington , R.F. Effect of antenna size on gain, bandwidth, and efficiency. Journal of Research of the National Bureau of Standards—D. Radio Propagation, 1960.
Adcock, M. D., "New Type Feed for High Speed Conical Scanning," The Second Symposium of the USAF Antenna Research and Development Program, Oct. 19-23, 1952.
Andersen, J. B., "Low- and Medium-Gain Microwave Antennas," in A. W. Rudge, K. Milne, A. D. Olver, and P. Knight (eds.), The Handbook of Antenna Design, vols. 1 and 2, London, Peter Peregrinus Ltd., 1986.
Barrick, William, "A Helical Resonator Antenna Diplexer," The Tenth Symposium on the USAF Antenna Research and Development Program, Oct. 3-7, 1960.
Batson, D. et al., "VHF Unfurlable Turnstile Antennas," The Nineteenth Symposium on the USAF Antenna Research and Development Program, Oct. 14-16, 1969.
Besthom, J.W., "1.0-to 21.0-GHz Log-Periodic Dipole Antenna," presented at the Eighteenth Annual Symposium on the USAF Antenna Research and Development Program, Oct. 15-17, 1968.
Blackband, W. T., "Coaxial Transmission Lines and Components," in A. W. Rudge, K. Milne, A. D. Olver, and P. Knight (eds.), The Handbook of Antenna Design, vols. 1 and 2, London, Peter Peregrinus Ltd., 1986.
Bokhari, S.A., Zurcher, J.F., Mosig, J.R. and Gardiol, F. E., "A Small Microstrip Patch Antenna with a Convenient Tuning Option," IEEE Transactions on Antennas and Propagation, vol. 44, No. 11, Nov. 1996.

(56) References Cited

OTHER PUBLICATIONS

"Broadband Passive Electrically Small Antennas for TV Application," presented at the Proceedings of the 1977 Antenna Applications Symposium on Apr. 27-29, 1977 at Robert Allerton Park at the University of Illinois.
Brown, A. R. and Rebeiz, G. M. "A High-Performance Integrated K-Band Diplexer," IEEE Transactions on Microwave Theory and Techniques, 47, Aug. 8, 1999.
Burnett, G. F., "Antenna Installations on Super Constellation Airborne Early Warning and Control Aircraft," The Fourth Symposium on the USAF Antenna Research and Development Program, Oct. 17-21, 1954.
Bushman, F. W. et al., "The Boeing B-52 All Flush Antenna System," The Fifth Symposium on the USAF Antenna Research and Development Program, Oct. 16-20, 1955.
Campi, M., "Design of Microstrip Linear Array Antennas," 1981 Antenna Applications Symposium, Sep. 23-25, 1981.
Chen, "Square-Ring Microstrip Antenna with a Cross Strip for Compact Circular Polarization Operation", IEEE Transactions on Antennas and Propagation, vol. 47, No. 10, Oct. 1999.
Chen, M. H., Tung, T. X. and Yodokawa, T. "A Compact EHF/SHF Dual Frequency Antenna," IEEE International Symposium on Antennas and Propagation Digest, 4, May 7-11, 1990.
Chiba, N., Amano, T. and Iwasaki, H., "Dual-Frequency Planar Antenna for Handsets," Electronics Letters, 34, 35, Dec. 10, 1998, pp. 2362-2363.
Cohen, "NEC4 Analysis of a Fractalized Monofilar Helix in an Axial Mode," Conference Proceedings vol. II for the 14th Annual Review of Progress in Applied Computational Electromagnetics at the Naval Postgraduate School in Montery, CA, Mar. 16-20, 1998.
Cohen, Nathan, "Fractal Element Antennas," Journal of Electronic Defense, Jul. 1997.
Cohn, S. B., "Flush Airborne Radar Antennas," The Third Symposium on the USAF Antenna Research and Development Program, Oct. 18-22, 1953.
Collier and Shnitkin, "Summary of the Monopole as a Wideband Array Antenna Element," presented at the 1993 Antenna Applications Symposium on Sep. 23, 1993.
Contreras, "Fractal Miniature Antenna" UPC Baix Llobregat Polytechnic University Project Research (Sep. 1997).
Daniel, Kumar, "Rectangular Microstrip Antennas with stub along the non-radiating edge for Dual Band Operation," IEEE Antennas and Propagation Society International Symposium 1995 Digest, vol. 4, p. 2136-2139.
Deng, A T-Strip Loaded Rectangular Microstrip Patch Antenna for Dual-Frequency Operation IEEE Antennas and Propagation Society International Symposium, Aug. 1999, vol. 2, pp. 940-943.
Deschamps, G. et al., "Microstrip Microwave Antenna," The Third Symposium on the USAF Antenna Research and Development Program, Oct. 18-22, 1953.
Dickstein, Harold D., "Antenna System for a Ground Passive Electronic Reconnaissance Facility," The Eighth Symposium on the USAF Antenna Research and Development Program, Oct. 20-24, 1958.
DuHamel R. H. and Isbell, D. E., "Broadband Logarithmically Periodic Antenna Structures," IRE International Convention Record, 5, Part 1, Mar. 1957, pp. 119-128.
Du Plessis, "Tuning Stubs for Microstrip Patch Antennas," IEEE Antennas and Propagation Magazine, vol. 36, issue 6, pp. 52-56, 1993.
Dyson, J.D., "The Non-Planar Equiangular Spiral Antenna," The Eighth Symposium on the USAF Antenna Research and Development Program, Oct. 20-24, 1958.
Dyson, J.D., "The Equiangular Spiral Antenna," The Fifth Symposium on the USAF Antenna Research and Development Program, Oct. 16-20, 1955.
Ellis, A.R., "Airborne U-H-F Antenna Pattern Improvements," The Third Symposium on the USAF Antenna Research and Development Program, Oct. 18-22, 1953.
Esteban, J. and Rebollar, J. M., "Design and Optimization of a Compact Ka-Band Antenna Diplexer," IEEE International Symposium on Antennas and Propagation Digest, 1, Jun. 18-23, 1995, pp. 148-151.
Etsi, "Global System for Mobile Communications: Digital cellular telecommunications system (Phase 2); Mobile Station (MS) conformance specification; Conformance specification (GSM 11.10-1)," European Telecommunication Standard, Mar. 1996.
Etsi, "Global System for Mobile Communications: Digital cellular telecommunications system (Phase 2+); Abbreviations and acronyms (GSM 01.04)," GSM Technical Specification, Version 5.0.0, Mar. 1996.
Etsi, "Global System for Mobile Communications: Digital cellular telecommunications system (Phase 2); Types of Mobile Stations (MS) (GSM 02.06)," European Telecommunication Standard, 3rd ed., May 1996.
Etsi, "Global System for Mobile Communications: Digital cellular telecommunications system (Phase 2+); Radio transmission and reception (GSM 05.05)," GSM Technical Specification, Version 5.2.0, Jul. 1996.
Etsi, "Global System for Mobile Communications: Digital cellular telecommunications system (Phase 2); Mobile Station (MS) conformance specification; Part 1: Conformance specification (GSM 11.10-1 version 4.21.1)," European Telecommunication Standard, 8th ed., Aug. 1998.
Fenwick, R., "A New Class of Electrically Small Antennas," Presented at the Fourteenth Annual Symposium on USAF Antenna Research and Development, presented Oct. 6-8, 1964.
Ferris, J. E. et al., "A Status report of an Azimuth and Elevation Direction Finder" The Eighteenth Symposium on the USAF Antenna Research and Development Program, Oct. 15-17, 1968.
Force, R.D., et al. "Synthesis of Multilayer Walls for Radomes of Aerospace Vehicles," The Seventeenth Symposium on the USAF Antenna Research and Development Program, Nov. 14-17, 1967.
Gilbert, R., Structurally-Integrated Optically-Reconfigurable Antenna Array 1995 Antenna Applications Symposium, Sep. 20-22, 1995.
Gillespie, Edmond S., "Glide Slope Antenna in the Nose Radome of the F104A and B," The Seventh Symposium on the USAF Antenna Research and Development Program, Oct. 21-25, 1957.
Gray, "Electronically Steerable Yagi-Uda Microstrip Patch Antenna," IEEE Transactions on Antennas and Propagation, vol. 46, No. 5, May 1998.
Greiser, J. W. and Brown, G. S., "A 500:1 Scale Model of Warla—A Wide Aperture Radio Location Array," presented at the Thirteenth Symposium on the USAF Antenna Research and Development Program on Oct. 14-18, 1963 at the University of Illinois Antenna Laboratory in Urbana, Illinois.
Guo, Y.X. et al., "Double U-slot rectangular patch antenna," Electronics Letters, vol. 34, No. 19, pp. 1805-1806 (Sep. 17, 1998).
Gupta, K.C., "Broadbanding Techniques for Microstrip Patch Antennas—A Review," Antenna Applications Symposium, Sep. 21-23, 1988.
Gupta, Microstrip Antenna Design, Norwood, MA, Artech House 1988.
Hagstrom, P., "Novel Ceramic Antenna Filters for GSM/DECT and GSM/PCN Network Terminals," The 8th IEEE International Symposium on Personal, Indoor, and Mobile Radio Communications, vol. 3, Sep. 1-4, 1997.
Halloran, T.W. et al. "A Dual Channel VHF Telemetry Antenna System for Re- Entry Vehicle Applications," The Eleventh Symposium on the USAF Antenna Research and Development Program, Oct. 16-20, 1961.
Hikata, M., Shibagaki, N., Asai, K., Sakiyama, K. and Sumioka, A., "New Miniature SAW Antenna Duplexer Used in GHz-Band Digital Mobile Cellular Radios," 1995 IEEE Ultrasonics Symposium, 1, Nov. 7-10, 1995.
Hill, J.E. et al., "An Integrated Strip-Transmission-Line Antenna System for JBand," The Twenty-Third Symposium on the USAF Antenna Research and Development Program, Oct. 10-12, 1973.
Chu, J.L., Physical limitations of omni-directional antennas, Journal of Applied Physics, Dec. 1948.
Wheeler, Fundamental limitations of small antennas, Proceedings of the I.R.E., 1947.

(56) References Cited

OTHER PUBLICATIONS

Addison, P. S., Fractals and chaos, Institute of Physics Publishing, 1997.
Falconer, K., Fractal geometry. Mathematical foundations and applications, Wiley, 2003.
Carver, K.R.; Mink, J.W., "Microstrip antenna technology", IEEE Transactions on Antennas and Propagation, Jan. 1981 in Microstrip antennas. The analysis and design of microstrip antennas and arrays, Pozar-Schaubert, 1995.
Chapters: 6) Wheeler, H.A. "Small antennas", 7) Munson, R.E. "Microstrip antennas", 14) Duhamel, R.H.; Scherer, J.P. "Frequency-independent antennas", 23) Offutt, W.B.; Desize, L.K. "Methods of polarization synthesis" in Antenna engineering handbook, McGraw-Hill, 1993.
Kraus, J.D., Antennas, McGraw-Hill, 1988, p. 354-358.
Garg, R.; Bahl, I.J., Characteristics of coupled microstriplines, IEEE Transactions on microwave theory and techniques, Jul. 1979.
Tang, Y.Y. et al, The application of fractal analysis to feature extraction, IEEE, 1999.
Ng, V.; Coldman, A., Diagnosis of melanoma withn fractal dimensions, IEEE Tencon'93, 1993.
Kobayashi, K. et al, Estimation of 3D fractal dimension of real electrical tree patterns, Proceedings of the 4th International Conference on Properties and Applications of Dielectric Materials, Jul. 1994.
Feng. J. et al, Fractional box-counting approach to fractal dimension estimation, IEEE, 1996.
Rouvier, R. et al, Fractal analysis of bidimensional profiles and application to electromagnetic scattering from soils, IEEE, 1996.
Sarkar, N.; Chaudhuri, B.B., An efficient differential box-counting approach to compute fractal dimension of image, IEEE Transactions on System, Man and Cybernetics, Jan. 3, 1994.
Chen, S., et al, On the calculation of Fractal features from images, IEEE Transactions on Pattern Analysis and Machine Intelligence, Oct. 1993.
Penn, A.I., et al, Fractal dimension of low-resolution medical images, 18th annual international conference of the IEEE Engineering in Medicine and Biology Society, 1996.
Berizzi, F.; Dalle-Mese, E., Fractal analysis of the signal scattered from the sea surface, IEEE Transactions on Antennas and Propagation, Feb. 1999.
Boshoff, H.F.V., A fast box counting algorithm for determining the fractal dimension of sampled continuous functions, IEEE, 1992.
Chapters: 1) "Counting and number systems", 3) "Meanders and fractals" and 5) "The analysis of a fractal" in Lauwerier, H., Fractals. Endlessly repeated geometrical figures, Princeton University Press, 1991.
Romeo, J. et al, Small fractal antennas, Fractals in engineering conference, India, Jun. 1999.
Russell, D. A., Dimension of strange attractors, Physical Review Letters, vol. 45, No. 14, Oct. 1980.
So, P. et al, Box-counting dimension without boxes—Computing D0 from average expansion, Physical Review E, vol. 60, No. 1, Jul. 1999.
Prokhorov, A.M., Bolshaya Sovetskaya Entsiklopediya, Sovetskaya Entsiklopediya, 1976, vol. 24, Book 1, p. 67.
Model, A.M., Microwave filters in radio relay systems, Moscow, Svyaz, 1967, p. 108-109.
Pozar, D.M., Microstrip antennas, Proceedings of the IEEE, 1992.
G. James, J.R.; Hall, P.S., Handbook of microstrip antennas, IEE, 1989, vol. 1, p. 355-357.
Navarro, M., Diverse modifications applied to the Sierpinski antenna, a multi-band fractal antenna (final degree project), Universitat Politècnica de Catalunya, Oct. 1997.
Neary, D., Fractal methods in image analysis and coding, Dublin City University—School of Electronic Engineering, Jan. 22, 2001.
Breden , R. et al, Printed fractal antennas, National conference on antennas and propagation, Apr. 1999.
Cohen , N. et al, Fractal loops and the small loop approximation—Exploring fractal resonances, Communications quarterly, Dec. 1996.
Gobien, Andrew T., "Investigation of Low Profile Antenna Designs for Use in Hand-Held Radios" (Thesis), Aug. 1, 1997, Faculty of the Virginia Polytechnic Institute and State University, Blacksburg, Virginia, U.S.A.
Werner et al. Radiation characteristics of thin-wire ternary fractal trees, Electronics Letters, 1999, vol. 35, No. 8.
Hoffmeister, M., The dual frequency inverted f monopole antenna for mobile communications, 1999.
Kutter, R.E., Fractal antenna design, BEE, University of Dayton, Ohio, 1996.
Davidson, B. et al. Wideband helix antenna for PDC diversity, International Congress, Molded Interconnect Devices, Sep. 1998.
Breden, R. et al. Multiband printed antenna for vehicles, 1999.
Anguera, J, et al.; A procedure to design wide-band electromagnetically-coupled stacked microstrip antennas based on a simple network model; IEEE Antennas and Propagation Society International Symposium; Jul. 11, 2007.
Balanis, Constantine A.; Traveling Wave and Broadband Antennas; Antenna Theory—Analysis and design—Chapter 10; Hamilton Printing; 1982, pp. 498-499.
Garg, R. et al.; Microstrip antenna design handbook; Artech House; Jan. 1, 2001.
James, J.R.; Handbook of microstrip antennas—Chapter 7; Institution of Electrical Engineers; Jan. 2, 1989.
Peitgen et al.; Chaos and fractals. New frontiers of science; Feb. 12, 1993.
Waterhouse, R.B.; Small printed antennas with low cross-polarised fields; Electronic letters; Jul. 17, 1997; pp. 1280-1281; vol. 33, No. 15.
Wong, An improved microstrip sierpinski carpet antenna, Proceedings of APM2001, 2001.
Musser, G. Practical Fractals, Scientific American, Jul. 1999, vol. 281, Num. 1.
Hart, Fractal element antennas, [http://www.manukau.ac.nz/departments/e_e/research/ngaire.pdf]., 2007.
Matsushima, Electromagnetically coupled dielectric chip antenna, IEEE Antennas and Propagation Society International Symposium, 1998, vol. 4.
Smith, Efficiency of electrically small antennas combined with matching networks, IEEE Transactions on Antennas and Propagation, May 1977, vol. AP-25, p. 369-373.
Strugatsky, Multimode multiband antenna, Proceedings of the Tactical Communications Conference, 1992. vol. 1.
Pozar, Comparision of three methods for the measurement of printed antenna efficiency, IEEE Transactions on Antennas and Propagation, Jan. 1988, vol. 36.
Yew-Siow, Dipole configurations with strongly improved radiation efficiency for hand-held transceivers, IEEE Transactions on Antennas and Propagation, 1998, vol. 46, Num. 6.
Arutaki, Communication in a three-layered conducting media with a vertical magnetic dipole, IEEE Transactions on Antennas and Propagation, Jul. 1980, vol. AP-28, Num 4.
Desclos, An interdigitated printed antenna for PC card applications, IEEE Transactions on Antennas and Propagation, Sep. 1998, vol. 46, No. 9.
Hikita et al. Miniature SAW antenna duplexer for 800-MHz portable telephone used in cellular radio systems, IEEE Transactions on Microwave Theory and Techniques, Jun. 1988, vol. 36, No. 6.
Ancona, On small antenna impedance in weakly dessipative media, IEEE Transactions on Antennas and Propagation, Mar. 1978, vol. AP-26, No. 2.
Simpson, Equivalent circuits for electrically small antennas using LS-decomposition with the method of moments, IEEE Transactions on Antennas and Propagation, Dec. 1989, vol. 37, No. 12.
Debicki, Calculating input impedance of electrically small insulated antennas for microwave hyperthermia, IEEE Transactions on Microwave Theory and Techniques, Feb. 1993, vol. 41, No. 2.
McLean, A re-examination of the fundamental limits on the radiation Q of electrically small antennas, IEEE Transactions on Antennas and Propagation, May 1996, vol. 44, No. 5.
Muramoto, Characteristics of a small planar loop antenna, IEEE Transactions on Antennas and Propagation, Dec. 1997, vol. 45, No. 12.

(56) References Cited

OTHER PUBLICATIONS

Eratuuli, Dual frequency wire antennas, Electronic Letters, Jun. 1996, vol. 32, No. 12.
Ohmine, A TM mode annular-ring microstrip anetenna for personal satellite communication use, IEEE Transactions Communication, Sep. 1996, vol. E-79.
Poilasne, Active Metallic Photonic Band-Gap Materials (MPBG): Experimental Results on Beam Shaper, IEEE Transactions on Antennas and Propagation, Jan. 2000, vol. 48, No. 1.
Omar, A new broad-band, dual-frequency coplanar waveguide fed slot-antenna, IEEE Antennas and Propagation Society International Symposium, 1999. vol. 2.
Carpintero, Francisco, Replay to Examination Report to European Office for European Patent Application n°00909089; Aug. 14, 2003.
Summons to Attend Oral Proceedings pursant to rule 71 (1) EPC for EP Application 00909089.5; Oct. 28, 2004.
Carpintero, F. Written Submisisons for EP Application 00909089.5; Dec. 15, 2004.
Weman, E. Minutes from Oral Proceedings in accordance with Rule 76(4) EPC for EP Application 00909089.5; Jan. 28, 2005.
Wimer, Michael C. USPTO Office Action for U.S. Appl. No. 10/422,578; Oct. 4, 2004.
Sauer, Joseph M. Response to the Office Action dated Oct. 4, 2004 for the U.S. Appl. No. 10/422,578; Jan. 6, 2005.
Wimer, Michael C. USPTO Office Action for U.S. Appl. No. 10/422,578; Apr. 7, 2005.
Sauer, Joseph M. Response to the Office Action dated Apr. 7, 2005 for the U.S. Appl. No. 10/422,578; May 31, 2005.
Wimer, Michael C. Advisory action before the filing of an appeal brief for U.S. Appl. No. 10/422,578; Jun. 23, 2005.
Sauer, J. Request for Continued Examination for U.S. Appl. No. 10/422,578; Aug. 8, 2005.
Wimer, Michael C. USPTO Office Action for U.S. Appl. No. 10/422,578; Aug. 24, 2005.
Box counting dimension, [electronic]. <www.seanee.edu.pdf>. [Oct. 20, 2009].
HTC Corp. First amended answer and counterclaim to plaintiff's amended complaint; Oct. 2, 2009.
Bhavsar, Samir A.; correspondence regarding *Fractus, S.A.* v. *Samsung Electronics Co., Ltd. et al.*, 6:09-cv-00203 and *Fractus, S.A.* v. *LG Electronics Mobilecomm U.S.A., Inc. et al.*, 6-09-cv-00205; dated Oct. 28, 2009.
Wegner, E. D., B-70 Antenna System, Thirteenth Annual Symposium on USAF Antenna Research and Development, 1963.
Wheeler, H.A., "The Radian Sphere Around a Small Antenna," IEEE Proc., vol. 47, pp. 1325-1331 (Aug. 1959).
Wheeler, H.A., "Small Antennas," The Twenty-Third Symposium on the USAF Antenna Research and Development Program, Oct. 10-12, 1973.
Wong, Kin-Lu and Sze, Jia-Yi, "Dual-Frequency Slotted Rectangular Microstrip Antenna," Electronics Letters, vol. 34, No. 14, Jul. 9, 1998.
Wong et al., "Broadband Microstrip Antennas With Integrated Reactive Loading," Microwave Conference, 1999 Asia Pacific, Nov. 1999, vol. 2, pp. 352-354.
Photos of Nokia 3210 product (1999 or earlier).
Photos of Nokia 8210 product (1999 or earlier).
Photos of Nokia 8260 product (1999 or earlier).
Photos of Nokia 8265 product (1999 or earlier).
Photos of Nokia 8810 product (1998 or earlier).
Photos of Nokia 8850 product (1999 or earlier).
Photos of Nokia 8860 product (1999 or earlier).
Photos of Rim 857 product (at least as early as 2000) and SAR report from FCC.
Photos of Rim 957 product (at least as early as 2000).
Photos of Fractus Panel 01 product (at least as early as 1998).
Photos of Fractus MSPK product (at least as early as 1998).
Borja, C.; Puente, C. Iterative network models to predict the performance of Sierpinski fractal antennas. IEEE. Jan. 1, 1999.
American Century Dictionary, Oxford University Press, Oxford University Press, 1995. pp. 376, 448 dated Jan. 1, 1995.
American Heritage College Dictionary, pp. 340 and 1016, Mifflin Company dated Jan. 1, 1997.
American Heritage Dictionary of the English Language (2000). 1306-1361.
Balanis , C. "Fundamental parameters of antennas—Chapter 2 in Antenna Theory: Analysis & Design", dated 1997. pp. 28-100.
Borowski, E. , Dictionary of Mathematics (Collins: 1989) pp. 456-45, Getting Acquainted with Fractals, pp. 50-53 dated Jan. 1, 1989.
Buczowski , S. The Modified Box-Counting Method: Analysis of Some Characteristic Parameters, dated 1998.
Caswell , W.E., Invisible errors in dimension calculations: geometric and systematic effects by W.E. Caswell and J.A. York, dated 1986 , J. Opt. Soc. Am. A 7, 1055-1073 (1990), J. Opt. Soc. Am. dated Jan. 1, 1986.
Claims for the EP Patent No. 00909089, Herrero y Asociados dated on Jun. 14, 2005.
Collier, C. P. , Geometry for Teachers. Waveland Press (2d ed. 1984) pp. 49-57 dated on Jan. 1, 1984.
Collins Dictionary, Collins, 1979. pp. 608, dated Jan. 1, 1979.
Court Order, Provisional Claim Construction Ruling and Order, Magistrate Judge John D. Love in the case of *Fractus SA* v. *Samsung Electornics Co. Ltd. et al.* Case No. 6:09-cv-00203 (E.D. Tex.) dated Nov. 9, 2010.
Crystal, E. et al. Hairpin.lin and hybridhairpin.line . Half-wave parallel.coupled line filters. IEEE Transaction on Microwave dated on Nov. 11, 1972.
Defendant, Defendant's Invalidity Contentions Case No. 6:09-cv-00203 (E.D. Tex.), dated on Feb. 24, 2010.
Defendant, HTC America Inc's Answer and Counterclaim to Plaintiff's Amended Complaint in the case of *Fractus SA* v. *Samsung Electornics Co. Ltd. et al.* Case No. 6:09-cv-00203 (E.D. Tex.) dated Sep. 25, 2009.
Defendant, HTC America, Inc.'s Amended Answer and Counterclaim to Plaintiff's Second Amended Complaint in the case of *Fractus SA* v. *Samsung Electornics Co. Ltd. et al.* Case No. 6:09-cv-00203 (E.D. Tex.) dated Feb. 24, 2010.
Defendant, HTC America, Inc.'s Amended Answer and Counterclaim to Plaintiff's Second Amended Complaint in the case of *Fractus SA* v. *Samsung Electornics Co. Ltd. et al.* Case No. 6:09-cv-00203 (E.D. Tex.) dated Feb. 25, 2010.
Defendant, HTC America, Inc's Answer and Counterclaims to Plaintiff's Second Amended Complaint in the case of *Fractus SA* v. *Samsung Electornics Co. Ltd. et al.* Case No. 6:09-cv-00203 (E.D. Tex.) dated Dec. 21, 2009.
Defendant, HTC Corporation's Amended Answer and Counterclaim to Plaintiff's Second Amended Complaint in the case of *Fractus SA* v. *Samsung Electornics Co. Ltd. et al.* Case No. 6:09-cv-00203 (E.D. Tex.) dated Feb. 24, 2010.
Defendant, HTC Corporation's Amended Answer and Counterclaim to Plaintiff's Second Amended Complaint in the case of *Fractus SA* v. *Samsung Electornics Co. Ltd. et al.* Case No. 6:09-cv-00203 (E.D. Tex.) dated Feb. 25, 2010.
Defendant, HTC Corporation's Answer and Counterclaim to Plaintiff's Amended Complaint in the case of *Fractus SA* v. *Samsung Electornics Co. Ltd. et al.* Case No. 6:09-cv-00203 (Ed. Tex.) dated Sep. 25, 2009.
Defendant, HTC Corporation's Answer and Counterclaims to Plaintiff's Second Amended Complaint in the case of *Fractus SA* v. *Samsung Electornics Co. Ltd. et al.* Case No. 6:09-cv-00203 (E.D. Tex.) dated Dec. 21, 2009.
Defendant, Kyocera Communications Inc's Answer, Affirmative Defenses and Counterclaims to Plantiff's Amended Complaint in the case of *Fractus SA* v. *Samsung Electornics Co. Ltd. et al.* Case No. 6:09-cv-00203 (E.D. Tex.) dated Jul. 21, 2009.
Defendant, Kyocera Communications Inc's Answer, Affirmative Defenses and Counterclaims to Second Amended Complaint in the case of *Fractus SA* v. *Samsung Electornics Co. Ltd. et al.* Case No. 6:09-cv-00203 (E.D. Tex.) dated Dec. 22, 2009.
Defendant, Kyocera Wireless Corp's Answer, Affirmative Defenses and Counterclaims to Paintiff's Second Amended Complaint in the

(56) References Cited

OTHER PUBLICATIONS case of *Fractus SA* v. *Samsung Electornics Co. Ltd. et al.* Case No. 6:09-cv-00203 (E.D. Tex.) dated Dec. 22, 2009.
Defendant, Kyocera Wireless Corp's Answer, Affirmative Defenses and Counterclaims to Plantiff's Amended Complaint in the case of *Fractus SA* v. *Samsung Electornics Co. Ltd. et al.* Case No. 6:09-cv-00203 (E.D. Tex.) dated Jul. 21, 2009.
Defendant, LG Electronics Mobilecomm USA., Inc.'s Answer and Counterclaim to Fractus' Complaint in the case of *Fractus SA* v. *Samsung Electornics Co. Ltd. et al.* Case No. 6:09-cv-00203 (E.D. Tex.) dated Oct. 1, 2009.
Defendant, Palm Inc.'s Answer, Affirmative Defenses and Counterclaims to Plaintiff's Amended complaint in the case of *Fractus SA* v. *Samsung Electornics Co. Ltd. et al.* Case No. 6:09-cv-00203 (E.D. Tex.) dated Jul. 21, 2009.
Defendant, Palm, Inc's Answer, Affirmative Defenses and Counterclaims to Second Amended Complaint in the case of *Fractus SA* v. *Samsung Electornics Co. Ltd. et al.* Case No. 6:09-cv-00203 (E.D. Tex.) dated Dec. 22, 2009.
Defendant, Pantech Wireless, Inc.'s Answer, Affirmative Defenses and Counterclaims to Fractus' Amended Complaint in the case of *Fractus SA* v. *Samsung Electornics Co. Ltd. et al.* Case No. 6:09-cv-00203 (E.D. Tex.) dated Jun. 4, 2009.
Defendant, Pantech Wireless, Inc's Answer, Affirmative Defenses and Counterclaims to Plaintiff's Second Amended Complaint in the case of *Fractus SA* v. *Samsung Electornics Co. Ltd. et al.* Case No. 6:09-cv-00203 (E.D. Tex.) dated Dec. 21, 2009.
Defendant, Personal Communications Devices Holdings, LLC Answer, Affirmative defenses and Counterclaims to the Second Amended Complaint in the case of *Fractus SA* v. *Samsung Electornics Co. Ltd. et al.* Case No. 6:09-cv-00203 (E.D. Tex.) dated Dec. 17, 2009.
Defendant, Personal Communications Devices Holdings, LLC's Answer, Affirmative Defenses and Counterclaims to Fractus' Amended Complaint in the case of *Fractus SA* v. *Samsung Electomics Co. Ltd. et al.* Case No. 6:09-cv-00203 (E.D. Tex.) dated Jul. 20, 2009.
Defendant, Research in Motion LTD and Research in Motion Corporation's Second Answer, Defenses and Counterclaims to Plaintiff's Second Amended Complaint in the case of *Fractus SA* v. *Samsung Electornics Co. Ltd. et al.* Case No. 6:09-cv-00203 (E.D. Tex.) dated Dec. 21, 2009.
Defendant, Sanyo Electric Co. LTD's Answer to Second Amended Complaint for Patent Infringement in the case of *Fractus SA* v. *Samsung Electornics Co. Ltd. et al.* Case No. 6:09-cv-00203 (E.D. Tex.) dated Dec. 22, 2009.
Defendant, Sanyo North America Corporation's Answer to Second Amended Complaint in the case of *Fractus SA* v. *Samsung Electornics Co. Ltd. et al.* Case No. 6:09-cv-00203 (E.D. Tex.) dated Dec. 22, 2009.
Defendant, Sanyo North America Corporation's Partial Answer to Amended Complaint for Patent Infringement in the case of *Fractus SA* v. *Samsung Electornics Co. Ltd. et al.* Case No. 6:09-cv-00203 (E.D. Tex.) dated Jul. 20, 2009.
Defendant, Sharp's Amended Answer to Second Amended Complaint in the case of *Fractus SA* v. *Samsung Electornics Co. Ltd. et al.* Case No. 6:09-cv-00203 (E.D. Tex.) dated Feb. 24, 2010.
Defendant, Sharp's Answer to Second Amended Complaint in the case of *Fractus SA* v. *Samsung Electornics Co. Ltd. et al.* Case No. 6:09-cv-00203 (E.D. Tex.) dated Dec. 29, 2009.
Defendant, UTStarcom, Inc.'s Answer, Affirmative Defenses, and Counterclaims to Fractus' Amended Complaint in the case of *Fractus SA* v. *Samsung Electornics Co. Ltd. et al.* Case No. 6:09-cv-00203 (E.D. Tex.) dated Jun. 8, 2009.
Defendant, UTStarcom, Inc's Answer, Affirmative Defenses and Counterclaims to Second Amended Complaint in the case of *Fractus SA* v. *Samsung Electornics Co. Ltd. et al.* Case No. 6:09-cv-00203 (E.D. Tex.) dated Dec. 22, 2009.
Defendants, Baxter , J., Declaration of Jeffrey Baxter in the case of *Fractus SA* v. *Samsung Electornics Co. Ltd. et al.* Case No. 6:09-cv-00203 (E.D. Tex.) dated Jul. 29, 2010.
Defendants, Claim Construction and Motion for Summary Judgment, Markman Hearing in the case of *Fractus SA* v. *Samsung Electornics Co. Ltd. et al.* Case No. 6:09-cv-00203 (Ed. Tex.) dated Sep. 22, 2010.
Defendants, HTC America, Inc's First Amended Answer and Counterclaims to Plaintiff's Amended Complaint in the case of *Fractus SA* v. *Samsung Electornics Co. Ltd. et al.* Case No. 6:09-cv-00203 (E.D. Tex.) dated Oct. 2, 2009.
Defendants, Kyocera Communications, Inc; Palm Inc. and UTStarcom, Inc. Response to Fractus SA's Opening Claim Construction Brief in the case of *Fractus SA* v. *Samsung Electornics Co. Ltd. et al.* dated Jul. 30, 2010.
Defendants, Letter from Baker Botts to Howison & Arnott LLP including Exhibits in the case of *Fractus SA* v. *Samsung Electornics Co. Ltd. et al.* Case No. 6:09-cv-00203 (E.D. Tex.) dated Aug. 5, 2010.
Defendants, Letters from Baker Botts to Kenyon & Kenyon LLP, Winstead PC and Howison & Arnott LLP including Exhibits in the case of *Fractus SA* v. *Samsung Electornics Co. Ltd. et al.* Case No. 6:09-cv-00203 (E.D. Tex.) dated Oct. 28, 2009.
Defendants, LG Electronics Inc., LG Electronics USA, Inc., and LG Electronics Mobilecomm USA Inc. Answer and Counterclaim to Amended Complaint in the case of *Fractus SA* v. *Samsung Electornics Co. Ltd. et al.* Case No. 6:09-cv-00203 (E.D. Tex.) dated Oct. 1, 2009.
Defendants, LG Electronics Inc., LG Electronics USA, Inc., and LG Electronics Mobilecomm USA Inc. Answer and Counterclaim to Second Amended Complaint in the case of *Fractus SA* v. *Samsung Electornics Co. Ltd. et al.* Case No. 6:09-cv-00203 (E.D. Tex.) dated Dec. 28, 2009.
Le, H. Office action for the U.S. Appl. No. 10/797,732. USPTO. Aug. 9, 2007.
Lee, B. Office Action for the U.S. Appl. No. 10/181,790. USPTO dated on Aug. 27, 2004.
Lee, B. Office action for the U.S. Appl. No. 10/181,790. USPTO dated on Mar. 2, 2005.
Lee, B. Office action for the U.S. Appl. No. 10/181,790. USPTO dated on Aug. 4, 2005.
Lee, B. Office action for the U.S. Appl. No. 10/181,790. USPTO. dated on Jun. 2, 2005.
Love , J. D., Memorandum order and opinion. Court. Dec. 17, 2010.
Lyon , J. ; Rassweiler , G. ; Chen , C., Ferrite-loading effects on helical and spiral antennas, 15th Annual Symposium on the USAF antenna reserach and development program dated Oct. 12, 1965.
Maiorana , D. Response to the office action dated on Jan. 23, 2004 for the U.S. Appl. No. 10/102,568. Jones Day dated on May 26, 2004.
Mandelbrot , B. B. , Opinions, World Scientific Publishing Company. "Fractals" 1(1), 117-123 (1993), dated on Jan. 1, 1993.
Mandelbrot, The fractal geometry of nature, Freeman and Co. dated on Jan. 1, 1982.
Matthaei, G. et al. Microwave filters, impedance-matching networks and coupling structures. Artech House. dated on Jan. 1, 1980.
Matthaei, G. et al.. Hairpin-comb filters for HTS and other narrow-band applications IEEE Transaction on Microwave, vol. 45 dated on Aug. 8, 1997.
McCormick , J., A Low-profile electrically small VHF antenna, 15th Annual Symposium on the USAF antenna reserach and development program dated Oct. 12, 1965.
Mehaute, A. , Fractal Geometrics, CRC Press, pp. 3-35 dated on Jan. 1, 1990.
Meier , K. ; Burkhard , M. ; Schmid , T. et al, Broadband calibration of E-field probes in Lossy Media, IEEE Transactions on Microwave Theory and Techniques dated Oct. 1, 1996.
Menefee , J. Office action for the U.S. Appl. No. 95/001,414. USPTO dated on Aug. 10, 2010.
Merriam-Webster's Collegiate Dictionary (1996), Merriam-Webster's dated Jan. 1, 1996.
Mithani , S. A. Response to the office action dated on Mar. 12, 2007 for the U.S. Appl. No. 11/021,597. Winstead dated on Aug. 9, 2007.

(56) References Cited

OTHER PUBLICATIONS

Mithani, S., Response to Office Action dated on Aug. 23, 2006 for the U.S. Appl. No. 11/124,768, Winstead, dated on Nov. 13, 2006.
Moore, S., Response to the Office Action dated on Feb. 7, 2006 for the U.S. Appl. No. 11/033,788, Jenkens, dated Jun. 1, 2006.
Na, IEEE Standard Dictionary of Electrical and Electronics Terms., IEEE Press, 6th ed. , pp. 359, 688, and 878 dated Jan. 1, 1993.
Na, Int'l Electro-Technical Commission IEV No. 712-01-04, dated Apr. 1, 1998.
Na, Letter to FCC—Application form 731 and Engineering Test Report by Nokia Mobile Phones for FCC ID: LJPNSW-6NX, M. Flom Associates dated Apr. 1, 1999.
Na, OET Exhibits list for FCC ID: LJPNSW-6NX, Federal Communications Commission—FCC dated Jul. 8, 1999.
Na, Webster's New Collegiate Dictionary, G & C Merriam Co., 1981. pp. 60, 237, 746, dated Jan. 1, 1981.
Naik , A. ; Bathnagar , P. S., Experimental study on stacked ring coupled triangular microstrip antenna, Antenna Applications Symposium, 1994 dated Sep. 21, 1994.
Nelson , Thomas R. ; Jaggard , Dwight L. , Fractals in the Imaging Sciences, 7, J. Optical Soc'y Am. A 1052 dated Jan. 1, 1990.
Nguyen, H.V., Notice of Allowance for U.S. Appl. No. 11/110,052, USPTO, dated on May 30, 2006.
Office action for the Chinese patent application 01823716. CCPIT Patent and Trademark Law Office dated on Feb. 16, 2007.
Office Action for the U.S. Appl. No. 95/001,389, dated Aug. 12, 2010.
Office Action for the U.S. Appl. No. 95/001,390, dated Aug. 12, 2010.
Office Action for the U.S. Appl. No. 10/102,568, dated Jan. 23, 2004.
On Fractal Electrodynamics in Recent Advances in Electromagnetic Theory. Springer Verlag, Oct. 1990. Chapter 6.
Parker (ed.), McGraw-Hill Dictionary of Scientific and Technical Terms (5th ed. 1994). Mc Graw-Hill, pp. 1542 dated on Jan. 1, 1994.
Paschen , A ; Olson , S., A crossed-slot antenna with an infinite balun feed, Antenna Applications Symposium, 1995. dated Sep. 20, 1995.
Patent Cooperation Treaty Application PCT/ES99/00296 Reply dated Nov. 26, 2001.
Peitgen & D. Saupe, H, The science of fractal images, Springer-Verlag (1988) pp. 1-3, 24-27, 58-61 dated Jan. 1, 1988.
Peitgen et al, H O, Chaos and fractals : new frontiers of science, Springer-Verlag, 1992. pp. 22-26, 62-66, 94-105, 212-219, 229-243 dated Jan. 1, 1992.
Phan, T. Notice of allowance for the U.S. Appl. No. 10/963,080 dated on Sep. 1, 2005.
Phan, T. Notice of allowance for the U.S. Appl. No. 11/102,390. USPTO, dated on Jul. 6, 2006.
Phan, T. Notice of allowance for the U.S. Appl. No. 11/179,257. USPTO, dated on Oct. 19, 2006.
Phan, T. Office Action for the U.S. Appl. No. 11/550,256. USPTO, dated on Jan. 15, 2008.
Pozar , D. & E. Newman, Analysis of a Monopole Mounted near or at the Edge of a Half-Plane, IEEE Transactions on Antennas & Propagation, vol. AP-29, No. 3 dated May 1, 1981.
Preliminary Amendment with Originally Filed Claims for U.S. Appl. No. 10/102,568 dated Mar. 18, 2002.
Pressley, A. Elementary Differential Geometry, Springer (2000). Pags. 252-257.
Rademacher , H & O. Toeplitz, The Enjoyment of Math, Princeton Science Library,1957. pp. 164-169, dated Jan. 1, 1957.
Request for inter partes reexamination for US patent 7,148,850 (95/000,598), including exhibits from C1 to F3—HTC. Dec. 3, 2010.
Request for inter partes reexamination for US patent 7,202,822 (95/000,592), including exhibits from CC1 to CC6—Kyocera. Nov. 16, 2010.
Request for inter partes reexamination for US patent 7,148,850 (95/000,593), including exhibits from CC1 to CC7—Kyocera. Nov. 16, 2010.
Request for inter partes reexamination for US patent 7,148,850 (95/001,413) including claim charts from CC-A to CC-F—Samsung. Aug. 4, 2010.
Bach Andersen , J. et al. On closely coupled dipoles in a random field. IEEE Antennas and Wireless Propagation Letters, 2006.
Balanis , C. A. Antenna theory—Analysis and Design—Chapter 9 and Chapter 14. Hamilton Printing, 1982.
Lu , Jui-Han ; Tang , Chia-Luan ; Wong , Kin-Lu. Single-feed slotted equilateral triangular microstrip antenna for circular polarization. IEEE Transactions on Antennas and Propagation, 1999.
Pozar , D. M. Microwave Engineering. Addison-Wesley, 1990.
Pozar , D. ; Schaubert , D. Microstrip antennas. The analysis and design of microstrip antennas and arrays. IEEE Press, 1995.
Samsung SCH R500 : Patent 7,202,822 in Preliminary Infringement Contentions comparing SCH-R500 antenna to certain asserted claims of the '822 patent from *Fractus SA* v. *Samsung Co. Ltd. et al.* Case No. 6:09cv203 (E.D.Tex).
Second amended complaint for patent infringement filed Dec. 8, 2009 in the case of *Fractus SA* v. *Samsung Electronics Co. Ltd. et al.* Case No. 6:09cv203 (F.D. Tex). Fractus, Dec. 2009.
Claim chart comparing claims 1,4,6,17,19,21,22,24-26,29,35,38,40,45-48,51,53,58,61,65,66,69 and 70 of the US patent No. 7,148,850 to US patent No. 6,140,975 of Cohen [US patent 6,140,975] under 35 USC. Baker Botts, Aug. 2010.
Claim chart comparing claims 1,4,6,16,17,19,21,22,24-26,29,35,38,40,45-48,51,53,57,58,61,65,66,69 and 70 of the US patent No. 7,148,850 to US patent No. 6,140,975 to Cohen (hereinafter Cohen) under 35 USC 102. Baker Botts, Aug. 2010.
Claim chart comparing claims 1,4,6,17,19,21,22,24-26,29,35,38,40,45-48,51,53,58,61,65,66 and 69 of the US patent No. 7,148,850 to US patent No. 6,140,975 Cohen under 35 USC 102. Baker Botts, Aug. 2010.
Claim chart comparing claims 1,4,6,16,17,19,21,22,24-26,29,35,38,40,45-48,51,53,57,58,61,65,66 and 69 of the US patent No. 7,148,850 to US patent No. 6,140,975 to Cohen under 35 USC 102. Baker Botts, Aug. 2010.
Claim chart comparing claims 1, 4, 6,16-17,19,21,22, 24-26,29,35,38,40,45-48,51, 53, 57, 58, 61, 65, 66, 69 and 70 of the US patent No. 7,148,850 to EP patent No. 0590671 to Sekine under 35 USC 102. Baker Botts, Aug. 2010.
Claim chart comparing claims 1,4,6,16,17,19,21,22,24-26,29,35,38,40,45-48,51,53,57,58,61,65,66,69 and 70 of the US patent No. 7,148,850 to US patent No. 5,363,114 to Shoemaker (hereinafter shoemaker) under 35 USC 103(a). Baker Botts, Aug. 2010.
Samsung SCH U340 : Patent US7,148,850 in Preliminary Infringement Contentions comparing SCH U340 antenna to certain asserted claims of the '850 patent from *Fractus SA* vs *Samsung Electronics Co. Ltd. et al.* Case No. 6:09cv203 (E.D.Tex.). Fractus, Nov. 2009.
Samsung SCH R500 : Patent US7,148,850 in Preliminary Infringement Contentions comparing SCH R500 antenna to certain asserted claims of the '850 patent from *Fractus SA* vs *Samsung Electronics Co. Ltd. et al.* Case No. 6:09cv203 (E.D.Tex.). Fractus, Nov. 2009.
Fractus SA P.R. 4-2 proposed constructions and extrinsic evidence from *Fractus SA* vs *Samsung Electronics Co. Ltd. et al.* Case No. 6:09cv203 (E.D.Tex.). Fractus, May 2010.
Claim chart comparing claims 1,4-5,7-9,20-21,25 and 31 of US patent 7,202,822 to US patent 6,140,975 [Fig. 5B embodiment]. Baker Botts, Aug. 2010.
Claim chart comparing claims 1,4-5,7-9,12-13,15,18,20-22 and 31 of US patent 7,202,822 to US patent 6,140,975 [Figure 8B embodiment]. Baker Botts, Aug. 2010.
Claim chart comparing claims 1,4,5,7-9,12,13,15,18,20-25,29-31,35,44,46,48,52 and 53 of US patent 7,202,822 to US patent 6,140,975 [figure 7D5 embodiment]. Baker Botts, Aug. 2010.
Claim chart comparing claims 1,4,5,7-9,12-13,15,18,20-25,29-31,35,44,46,48,52 and 53 of US patent 7,202,822 to US patent 6,140,975 [figure 11B embodiment]. Baker Botts, Aug. 2010.
Claim chart comparing claims 1,4,5,7-9,13,15,18,20-25,29-31,35,44,46,48,52 and 53 of US patent 7,202,822 to EP patent No. 0590671 to Sekine. Baker Botts, Aug. 2010.
Claim Chart Comparing claims 1,4,5,7-9,12,13,15,18,21-25,29-31,35,44,46,48,52 of US Patent 7,202,822 to Sanad. Baker Botts, Aug. 2010.

(56) References Cited

OTHER PUBLICATIONS

Claim Chart Comparing claims 1,4-5,7-9,12,13,15,18,21,25,29-31,35,44,46,48 and 52 of US Patent 7,202,822 to U.S. Patent 5,363,114 to Shoemaker under 35 U.S.C. 5 103. Baker Botts, Aug. 2010.
Samsung SCH U340 : Patent 7,202,822 in Preliminary Infrigement Contentions comparing SCH-U340 antenna to certain asserted claims of the '822 patent from *Fractus SA* v. *Samsung Co. Ltd. et al.* Case No. 6:09cv203 (E.D.Tex).
Walker , B. Amendment and response to office action dated Apr. 15, 2008 of U.S. Appl. No. 11/686,804. USPTO—Howison and Arnott. Jul. 9, 2008.
Walker , B. Amendment and response to office action dated Aug. 2, 2006 of U.S. Appl. No. 11/154,843. USPTO—Howison and Arnott. Aug. 11, 2006.
Sauer , J. Amendment and response to office action dated Dec. 13, 2004 of U.S. Appl. No. 10/182,635. USPTO—Jones Day. Mar. 14, 2005.
Sauer , J. Amendment and response to office action dated Oct. 4, 2004 of U.S. Appl. No. 10/182,635. USPTO—Jones Day. Nov. 12, 2004.
Nguyen , H. Notice of Allowance of U.S. Appl. No. 11/179,250. USPTO, Jan. 26, 2007.
Nguyen , H. Notice of Allowance of U.S. Appl. No. 10/182,635. USPTO. Apr. 11, 2005.
Nguyen , H. Notice of Allowance of U.S. Appl. No. 11/110,052. USPTO. Mar. 29, 2006.
Nguyen , H. Notice of Allowance of U.S. Appl. No. 11/154,843. USPTO. Oct. 24, 2006.
Nguyen , H. Notice of Allowance of U.S. Appl. No. 11/686,804. USPTO. Sep. 2, 2008.
Nguyen , H. Office action for U.S. Appl. No. 10/182,635 dated on Oct. 4, 2004. USPTO, 2004.
Nguyen , H. Office action for U.S. Appl. No. 11/154,843 dated Oct. 2, 2006. USPTO, 2006.
Nguyen , H. Office Action for U.S. Appl. No. 10/182,635 dated on Dec. 13, 2004. USPTO, 2004.
Nguyen , H. Office Action for U.S. Appl. No. 11/154,843 dated on May 9, 2006. USPTO, 2006.
Nguyen , H. Office action of U.S. Appl. No. 11/686,804 dated on Apr. 15, 2008. USPTO, 2008.
Walker , B. Amendment and response to office action dated Oct. 28, 2009 of U.S. Appl. No. 12/347,462. USPTO—Howison and Arnott. Mar. 15, 2010.
Nguyen , H. Notice of Allowance of U.S. Appl. No. 12/347,462. USPTO. Jun. 29, 2010.
Nguyen , H. Notice of Allowance of U.S. Appl. No. 12/347,462. USPTO. Apr. 19, 2010.
Nguyen , H. Notice of Allowance of U.S. Appl. No. 12/347,462. USPTO. May 18, 2009.
Nguyen , H. Office Action of U.S. Appl. No. 12/347,462 dated on Oct. 28, 2009.
Fang , A A dual frequency equilateral-triangular microstrip antenna with a pair of narrow slots. Microwave and Optical Technology Letters, Oct. 20, 1999.
Carver , K. R. et al. Microstrip antenna technology. IEEE Transactions on Antennas and Propagation, Jan. 1, 1981.
Anguera , J. ; Puente , C. ; Borja , C. A procedure to design stacked microstrip patch antennas on a simple network model. Microwave and Optical Technology Letters Aug. 1, 2001.
Campos, O. Study of multiband and miniature fractal antennas. Universitat Politècnica de Catalunya Jan. 1, 1998.
NA Defendant Sanyo North America Corporation's partial answer to amended complaint for patent infringement. Defendants, Jul. 20, 2009.
Wheeler , H. A. Small antennas. IEEE Transactions Antennas and Propagation, Jul. 1, 1975.
Walsh , J.J. ; Watterson , J. Fractal analysis of fracture patterns using the standard box-counting technique: valid and invalid methodologies. Journal of Structure Geology, Mar. 10, 1993.
Blackband , W. T. The handbook of antenna design—Chapter 18—Coaxial transmission lines and components Rudge , A. W. et al—IEE Eletromagnetic Waves Series; Peter Peregrinus Ltd. Jan. 1, 1986.
NA Nokia 8260—FCC ID GMLNSW-4DX. Nokia, Apr. 1, 1999.
Maci , S. et al. Dual-band Slot-loaded patch antenna. IEE Proceedings Microwave Antennas Propagation, Jun. 1, 1995.
NA The handbook of antenna design—Index Rudge, A. W. et al.—Peter Peregrinus—Institution of Electrical Engineers Jan. 1, 1986.
Rumsey , V. Frequency independent antennas Academic. Press, Jan. 1, 1996.
VVAA. P.R. 4-3 joint claim construction statement. Fractus Jun. 14, 2010.
VVAA. Detailed rejection of U.S. Appl. No. 12/347,462. Defendants Jul. 1, 2010.
Nguyen , H. Office Action of U.S. Appl. No. 12/498,090 dated on Aug. 18, 2010. USPTO.
NA. Infringement Chart—Phone: LG Dare VX9700. Fractus Nov. 5, 2009.
NA. Fractus SA's opening claim construction brief—Letter. Fractus—Case 6:09-cv-00203-LED-JDL Jul. 16, 2010.
Mithani , S. Response to Office Action dated Aug. 9, 2007 of U.S. Appl. No. 10/797,732. Winstead Nov. 8, 2007.
NA. Defendant's reply in support of their motion for summary judgment of invalidity based on indefiniteness and lack of written description for certain terms. Defendants Aug. 30, 2010.
Kyriacos , S. ; Buczkowski , S. et al. A modified box-counting method. Fractals—World Scientific Publishing Company Jan. 1, 1994.
Sterne , R. G. Response to the Office Action for the U.S. Appl. No. 95/001,390 dated on Aug. 19, 2010. Sterne, Kessler, Goldstein & Fox PLLC Nov. 19, 2010.
Walker , B. Response to office action dated Aug. 18, 2010 of U.S. Appl. No. 12/498,090. Howison & Arnott Jan. 17, 2011.
NA. United States Table of Frequency allocations—The Radio Spectrum. United States Department of Commerce, Mar. 1, 1996.
NA. FCC—United States table of frequency allocations. Federal Communications Commission, Oct. 1, 1999.
Barnsley , M. Fractals Everywhere. Academic Press Professional Jan. 1, 1993.
Falconer , K. Fractal geometry. Mathematical foundations and applications—Declaration of M. Howe—Exhibit Q. John Wiley and Sons, Jan. 1, 1990.
Fujimoto , K. et al Small Antennas. Research Studies Press LTD, Jan. 1, 1987.
NA. Applications of IE3D in designing planar and 3D antennas—Release 15.0. Mentor Graphics, Jan. 1, 2010.
NA. IE3D User's Manual. Mentor Graphics, Jan. 1, 2010.
Jaggard , D. L. Expert report of Dwight L. Jaggard (redacted)—expert witness retained by Fractus. Fractus, Feb. 23, 2011.
Long , S. Expert report of Stuart Long (redacted)—expert witness retained by Fractus. Fractus, Feb. 23, 2011.
Stutzman , W. L. Expert report of Dr. Warren L. Stutzman (redacted)—expert witness retained by Fractus. Fractus, Feb. 23, 2011.
NA. Fractus's sur-reply to defendants' motion for reconsideration of the court's Dec. 17, 2010 claim construction order based on newly-available evidence—Document 666. Fractus, Mar. 8, 2011.
NA. Plaintiff Fractus SA's answer to second amended counterclaims of defendant HTC Corporation to Fractus's second amended complaint—Document 678. Fractus, Mar. 14, 2011.
NA. Plaintiff Fractus SA's answer to second amended counterclaims of defendant HTC to Fractus's second amended complaint—Document 680. Fractus, Mar. 14, 2011.
NA. Plaintiff Fractus SA's answer to second amended counterclaims of defendant LG Electronics to Fractus's second amended complaint—Document 694. Fractus, Mar. 15, 2011.
NA. Plaintiff Fractus SA's answer to second amended counterclaims of defendant Samsung to Fractus's second amended complaint—Document 695. Fractus, Mar. 15, 2011.
NA. Plaintiff Fractus SA's answer to amended counterclaims of defendant Pantech Wireless Inc to Fractus's second amended complaint—Document 696. Fractus, Mar. 15, 2011.

(56) References Cited

OTHER PUBLICATIONS

NA. Order—Document 670. Court, Mar. 9, 2011.
Davis, Leonard. Order—Document 783. United States District Judge, Apr. 1, 2011.
NA. Fractal Antenna—Frequently asked questions. Fractal Antenna Systems Inc. Jan. 1, 2011.
Petigen , H. Chaos and fractals : New frontiers of science—pag. 231-233 and 386-391. Springer, Jan. 1, 1992.
Offutt , W. ; DeSize , L. K. Antenna Egineering Handbook—Chapter 23—Methods of Polarization Synthesis Johnson R. C.—McGraw Hill, Jan. 1, 1993.
NA Request for inter partes reexamination of US patent 7,148,850—95/001,413—Third party requester's comments to patent owner's reply dated on Apr. 11, 2011. Samsung, Apr. 11, 2011.
Lee , M. Corrected Patent Owner's Response to First Office Action of Oct. 8, 2010 of US patent No. 7,148,850—95/001,413—Exhibit 1. Stene, Kessler, Goldstein & Fox P.L.L.C. Apr. 11, 2011.
Lee , M. Corrected Patent Owner's Response to First Office Action of Oct. 8, 2010 of US patent No. 7,148,850—95/001,413. Stene, Kessler, Goldstein & Fox P.L.L.C. Apr. 11, 2011.
Greene , R. Corrected Patent Owner's Response to Office Action of Oct. 8, 2010 of patent No. 95/001,414. Stene, Kessler, Goldstein & Fox P.L.L.C. Apr. 11, 2011.
Tribble, M. L. Letter to John D. Love—Document 715—Permission to file a summary judgment motion of no indefiniteness on the issues wher the Court's Report and Recommendation already has held that the claim term is not indefinite. Susman Godfrey, Mar. 18, 2011.
Tribble , M. L. Letter to John D. Love—Document 716—Permission to file a partial summary judgement motion on infringement. Susman Godfrey , LLP Mar. 18, 2011.
Sirola, Neil P. Letter to John D. Love—Document 721—Permission to file a motion for summary judgment of invalidity of the following 7 asserted claims from the MLV, patent family. Baker Botts, LLP Mar. 18, 2011.
Dr. Carles Puente Baliarda; Fractal Antennas; Ph. D. Dissertation; May 1997; Cover page—p. 270; Electromagnetics and Photonics Engineering group, Dept. of Signal Theory and Communications, Universtat Poltecnica de Catalunya; Barcelona, Spain.
Oscar Campos Escala; Study of Multiband and Miniature Fractal Antennas; Final Year Project; Cover page-119 plus translation; Superior Technical Engineering School of Telecommunications, Barcelona Polytechnic University, Barcelona, Spain.
Oriol Verdura Contrras; Fractal Miniature Antenna; Final Year Project; Sep. 1997; Cover page-61 plus translation; UPC Baix Llobregat Polytechnic University; Barcelona Spain.
E.A. Parker and A.N.A. El Sheikh; Convoluted Dipole Array Elements; Electronic Letters; Feb. 14, 1001; pp. 322-333; vol. 27, No. 4; IEE; United Kingdom.
Carmen Borja Borau; Antennas Fractales Microstrip (Microstrip Fractal Antennas); Thesis; 1997; Cover page-Biblografia p. 3 (261 pages); E.T.X. d'Enginyeria de Telecomunicacio; Barcelona, Spain.
Chien-Jen Wang and Christina F. Jou, "Compact Microstrip Meander Antenna," IEEE Microwave and Optical Technology Letters, vol. 22, No. 6, pp. 413-414, Sep. 20, 1999.
H.Y. Wang and M.J. Lancaster, "Aperture-Coupled Thin-Film Superconducting Meander Antennas," IEEE Transactions on Antennas and Propagation, vol. 47, No. 5, pp. 829-836, May 1999.
Christian Braun, Gunnar Engblom and Claes Beckman, "Antenna Diversity for Mobile Telephones," AP-S IEEE, pp. 2220-2223, Jun. 1998.
R.B. Waterhouse, D.M. Kokotoff and F. Zavosh, "Investigation of Small Printed Antennas Suitable for Mobile Communication Handsets," AP-S IEEE, pp. 1946-1949, Jun. 1998.
Terry Kin-Chung Lo and Yeongming Hwang, "Bandwidth Enhancement of PIFA Loaded with Very High Permitivity Material Using FDTD," AP-S IEEE, pp. 798-801, Jun. 1998.
Jui-Han Lu and Kai-Ping Yang, "Slot-Coupled Compact Triangular Microstrip Antenna With Lumped Load," AP-S IEEE, pp. 916-919, Jun. 1998.
Hua-Ming Chen and Kin-Lu Wong, "On the Circular Plarization Operation of Annular-Ring Microstrip Antennas," IEEE Transactions on Antennas and Propagation, vol. 47, No. 8, pp. 1289-1292, Aug. 1999.
Choon Sae Lee and Vahakn Nalbandian, "Planar Circularly Polarized Microstrip Antenna with a Single Feed," IEEE Transactions on Antennas and Propagation, vol. 47, No. 6, pp. 1005-1007, Jun. 1999.
Chih-Yu Huang, Jian-Yi Wu and Kin-Lu Wong, "Cross-Slot-Coupled Microstrip Antenna and Dielectric Resonator Antenna for Circular Polarization," IEEE Transactions on Antennas and Propagation, vol. 47, No. 4, pp. 605-609, Apr. 1999.
David M. Kokotoff, James T. Aberle and Rod B. Waterhouse, "Rigorous Analysis of Probe-Fed Printed Annular Ring Antennas," IEEE Transactions on Antennas and Propagation, vol. 47, No. 2, pp. 384-388, Feb. 1999.
Rod Be Waterhouse, S.D. Targonski and D.M. Kokotoff, Design and Performance of Small Printed Antennas, IEEE Transactions on Antennas and Propagation, vol. 46, No. 11, pp. 1629-1633, Nov. 1998.
Yan Wai Chow, Edward Kai Ning Yung, Kim Fung Tsand and Hon Tat Hiu, "An Innovative Monopole Antenna for Mobile-Phone Handsets," Microwave and Optical Technology Letters, vol. 25, No. 2, pp. 119-121, Apr. 20, 2000.
Wen-Shyang Chen, "Small Circularly Polarized Microstrip Antennas," AP-S IEEE, pp. 1-3, Jul. 1999.
W.K. Lam and Edward K.N. Yung, "A Novel Leaky Wave Antenna for the Base Station in an Innovative Indoors Cellular Mobile Communication System," AP-S IEEE, Jul. 1999.
H. Iwasaki, "A circularly Polarized Small-Size Microstrop Antenna with a Cross Slot," IEEE Transactions on Antennas and Propagation, vol. 44, No. 10, pp. 1399-1401, Oct. 1996.
Choon Sae Lee and Pi-Wei Chen, "Electrically Small Microstrip Antennas," IEEE, 2000.
Jui-Han Lu, Chia-Luan Tang and Kin-Lu Wong, "Slot-Coupled Small Triangular Microstrip Antenna," Microwave and Optical Technology Letters, vol. 16, No. 6, pp. 371-374, Dec. 20, 1997.
Chia-Luan Tang, Hong-Twu Chen and Kin-Lu Wong, "Small Circular Microstrip Antenna with Dual-Frequency Operation," IEEE Electronic Letters, vol. 33, pp. 1112-1113, Jun. 10, 1997.
R. Waterhouse, "Small Microstrip Patch Antenna," IEEE Electronic Letters, vol. 31, pp. 604-605, Feb. 21, 1995.
R. Waterhouse, "Small Printed Antenna Easily Integrated Into a Mobile Handset Terminal," IEEE Electronic Letters, vol. 34, No. 17, pp. 1629-1631, Aug. 20, 1998.
0. Leisten, Y. Vardaxoglou, T. Schmid, B. Rosenberger, E. Agboraw, N. Kuster and G. Nicolaidis, "Miniature Dielectric-Loaded Personal Telephone Antennas with Low User Exposure," IEEE Electronic Letters, vol. 34, No. 17, pp. 1628-2629, Aug. 20, 1998.
Hua-Ming Chen, "Dual-Frequency Microstrip Antenna with Embedded Reactive Loading," IEEE Microwave and Optical Technology Letters, vol. 23, No. 3, pp. 186-188, Nov. 5, 1999.
Shyh-Timg Fang and Kin-Lu Wong, "A Dual Frequency Equilateral-Traingular Microstrip Antenna with a Pair of Narrow Slots," IEEE Microwave and Optical Technology Letters, vol. 23, No. 2, pp. 82-84, Oct. 20, 1999.
Kin-Lu Wong and Kai-Ping Yang, "Modified Planar Inverter F. Antenna," IEE Electronic Letters, vol. 34, No. 1, pp. 7-8, Jan. 8, 1998.
S.K. Palit, A. Hamadi and D. Tan, "Design of a Wideband Dual-Frequency Notched Microstrip Antenna," AP-S IEEE, pp. 2351-2354, Jun. 1998.
T. Williams, M. Rahman and M.A. Stuchly, "Dual-Band Meander Antenna for Wireless Telephones," IEEE Microwave and Optical Technology Letters, vol. 24, No. 2, pp. 81-85, Jan. 20, 2000.
Nathan Cohen, "Fractal Antennas, Part 1," Communications Quarterly: The Journal of Communications Technology, pp. 7-22, Summer, 1995.
Nathan Cohen, "Fractal and Shaped Dipoles," Communications Quarterly: The Journal of Communications Technology, pp. 25-36, Spring 1995.
Nathan Cohen, "Fractal Antennas, Part 2," Communications Quarterly: The Journal of Communications Technology, pp. 53-66, Summer 1996.

(56) References Cited

OTHER PUBLICATIONS

John P. Gianvittorio and Yahya Rahmat-Samii, Fractal Element Antennas; A Compilation of Configurations with Novel Characteristics, IEEE, 2000.
Jacob George, C.K. Aanandan, P. Mohanan and K.G. Nair, "Analysis of a New Compact Microstrip Antenna," IEEE Transactions on Antennas and Propagation, vol. 46, No. 11, pp. 1712-1717, Nov. 1998.
Jungmin Chang and Sangseol Lee, "Hybrid Fractal Cross Antenna," IEEE Microwave and Optical Technology Letters, vol. 25, No. 6, pp. 429-435, Jun. 20, 2000.
Jaume Anguera, Carles Puente, Carmen Borja, Jordi Romeu and Marc Aznar, "Antenas Microstrip Apiladas con Geometria de Anillo," Proceedings of the XIII National Symposium of the Scientific International Union of Radio, URSI '00, Zaragoza, Spain, Sep. 2000.
C. Puente, J. Romeu, R. Pous, J. Ramis and A Hijazo, "La Antena de Koch: Un Monopolo Large Pero Pequeno," XIII Simposium Nacional URSI, vol. 1, pp. 371-373, Pamplona, Sep. 1998.
C. Puente, and R. Pous, "Diseno Fractal de Agrupaciones de Antenas," IX Simposium Nacional URSI, vol. 1, pp. 227-231, Las Palmas, Sep. 1994.
C. Puente, J. Romeu, R. Pous and A. Cardama, "Multiband Fractal Antennas and Arrays," Fractals in Engineering, J.L. Vehel, E. Lutton, C. Tricot editors, Springer, New York, pp. 222-236, 1997.
C. Puente and R. Pous, "Fractal Design of Multiband and Low Side-Lobe Arrays," IEEE Transactions on Antennas and Propagation, vol. 44, No. 5, pp. 730-739, May 1996.
Puente, C. et al, "Multiband properties of a fractal tree antenna generated by electrochemical deposition," Electronics Letters, IEE Stevenage, GB, vol. 32, No. 25, pp. 2298-2299, Dec. 5, 1996.
Puente, C. et al., "Small but long Koch fractal monopole," Electronics Letters, IEE Stevenage, GB, vol. 34, No. 1, pp. 9-10, Jan. 8, 1998.
Puente Baliarda, Carles et al., "The Koch Monopole: A Small Fractal Antenna," IEEE Transactions on Antennas and Propagation, New York, vol. 48, No. 11, pp. 1773-1781, Nov. 1, 2000.
Cohen, Nathan, "Fractal Antenna Applications in Wireless Telecommunications," Electronic Industries Forum of New England, 1997, Professional Program Proceedings, Boston, Massachusetts, May 6-8, 1997, IEEE, pp. 43-49, New York, New York, May 6, 1997.
Anguera, J. et al., "Miniature Wideband Stacked Microstrip Patch Antenna Based on the Sierpinski Fractal Geometry," IEEE Antennas and Propagation Society International Symposium, 2000 Digest Aps., vol. 3 of 4, pp. 1700-1703, Jul. 16, 2000.
Hara Prasad, R.V. et al., "Microstrip Fractal Patch Antenna for Multi-Band Communication," Electronics Letter, IEE Stevenage, GB, vol. 36, No. 14, pp. 1179-1180, Jul. 6, 2000.
Borja, C. et a., "High Directivity Fractal Boundary Microstrip Patch Antenna," Electronics Letters, IEE Stevenage, GB, vol. 36, No. 9, pp. 778-779, Apr. 27, 2000.
Hansen, R.C., "Fundamental Limitations in Antennas," Proceedings of the IEEE, vol. 69, No. 2, pp. 170-182, Feb. 1981.
Jaggard, Dwight L., "Fractal Electrodynamics and Modeling," Direction in Electromagnetic Wave Modeling, pp. 435-446, 1991.
Hohlfeld, Robert G. et al., "Self-Similarity and the Geometric Requirements for Frequency Independence in Antennae," Fractals, vol. 7, No. 1, pp. 79-84, 1999.
Samavati, Hirad et al., "Fractal Capacitors," IEEE Journal of Solid-State Circuits, vol. 33, No. 12, pp. 2035-2041, Dec. 1998.
Pribetich, P. et al. "Quasifractal Planar Microstrip Resonators for Microwave Circuits," Microwave and Optical Technology Letters, vol. 21, No. 6, pp. 443-436, Jun. 20, 1999.
Zhang, Dawei, et al., "Narrowband Lumped-Element Microstrip Filters Using Capacitively-Loaded Inductors," IEEE MTT-S Microwave Symposium Digest, pp. 379-382, May 16, 1995.
Gough C.E. et al., "High Te coplanar resonators for microwave applications and scientific studies," Physics C, NL, North-Holland Publishing, Amsterdam, vol. 282-287, No. 2001, pp. 395-398, Aug. 1, 1997.
Book by H. Meinke and F. V. Gundlah, Radio Engineering Reference, vol. 1, Radio components. Circuits with lumped parameters. Transmission lines. Wave-guides. Resonators. Arrays. Radio wave propagation, States Energy Publishing House, Moscow, with English translation, 4 pages, 1961.
V. A. Volgov, "Parts and Units of Radio Electronic Equipment (Design & Computation)," Energiya, Moscow, with English translation, 4 pages, 1967.
Ali, M. et al., "A Triple-Band Internal Antenna for Mobile Hand-held Terminals," IEEE, pp. 32-35, 1992.
Romeu, Jordi et al., "A Three Dimensional Hilbert Antenna," IEEE, pp. 550-553, 2002.
Parker et al., "Convoluted Array Elements and Reduced Size Unit Cells for Frequency-Selective Surfaces," Microwaves, Antennas & Propagation, IEEE Proceedings H, vol. 138, No. 1, pp. 19-22, Feb. 1991.
Sanad, Mohamed, "A Compact Dual-Broadband Microstrip Antenna Having Both Stacked and Planar Parasitic Elements," IEEE Antennas and Propagation Society International Symposium 1996 Digest, pp. 6-9, Jul. 21-26, 1996.
European Patent Office Communication from the corresponding European patent application dated Feb. 7, 2003, 10 pages.
Hofer, D.A., Kesler, O.B., and Loyet, L.L., "A Compact Multi-Polarized Broadband Antenna," Proceedings of the 1989 Antenna Applications Symposium, Sep. 20-22, 1989.
Holtum, A. G., "A Dual Frequency Dual Polarized Microwave Antenna," The Sixteenth Symposium on the USAF Antenna Research and Development Program, Oct. 11-13, 1966.
Holzschuh, D.L., "Hardened Antennas for Atlas and Titan Missile Site Communications," The Thirteenth Symposium on the USAF Antenna Research and Development Program, Oct. 14-18, 1963.
Hong, "Compact microwave elliptic function filter using novel microstrip meander open-loop resonators" (Mar. 14, 1996).
Hong and Lancaster, Recent Advances in Microstrip Filters for Communications and Other Applications, IEEE, pp. 2/1-2/6 (1997).
Huynh, T. and Lee, K.F., "Single-layer single-patch wideband microstrip antenna," Electronics Letters, 31, 16, Aug. 3, 1995.
Hyneman, R.F., et al., "Homing Antennas for Aircraft (450-2500 MC)," The Fifth Symposium on the USAF Antenna Research and Development Program, Oct. 16-20, 1955.
IEEE, IEEE Standard Definitions of Terms for Antennas, IEEE Std. 145-1983, New York, IEEE, 1983.
Ikata, O., Satoh, Y., Uchishiba, H., Taniguchi, H., Hirasawa, N., Hashimoto, K. and Ohmori, H., "Development of Small Antenna Duplexer Using SAW Filters for Handheld Phones," 1993 IEEE Ultrasonics Symposium, 1, Oct. 31-Nov. 3, 1993.
Ingerson, Paul G. and Mayes, Paul E., "Asymmetrical Feeders for Log-Periodic Antennas," The Seventeenth Symposium on the USAF Antenna Research and Development Program (Nov. 14-17, 1967).
Isbell, D.E., "Non-Planar Logarithmically Periodic Antenna Structures," Seventh Annual Symposium on USAF Antenna Research and Development Program, Oct. 21-25, 1957.
Isbell, D.E., "Multiple Terminal Log-Periodic Antennas," Eighth Annual Symposium on the USAF Antenna Research and Development Program, Oct. 20-24, 1958.
Ishikawa, Y., Hattori, J., Andoh, M. and Nishikawa, T., "800 MHz High Power Bandpass Filter Using TM Dual Mode Dielectric Resonators," 21st Eurpoean Microwave Conference, vol. 2, Sep. 9-12, 1991.
Jones, Howard S., "Conformal and Small Antenna Designs," Proceedings of the 1981 Antenna Applications Symposium, Aug. 1981.
Kuhlman, E.A., "A Directional Flush Mounted UHF Communications Antenna for High Performance Jet Aircraft for the 225-400 MC Frequency Range," The Fifth Symposium on the USAF Antenna Research and Development Program, Oct. 16-20, 1955.
Kumar, G. and Gupta, K., "Directly Coupled Multiple Resonator Wide-Band Microstrip Antennas," IEEE Transactions on Antennas and Propagation, AP-29, 1, Jun. 1985, pp. 588-593.
Kumar, "Nonradiating Edges and Four Edges Gap-Coupled Multiple Resonator Broad-Band Microstrip Antenna," IEEE Transactions on Antenna and Propagation, Feb. 1985.
Kuo, Sam, "Frequency-Independent Log-Periodic Antenna Arrays With Increased Directivity and Gain," Twenty-First Annual Symposium on USAF Antenna Research and Development, Oct. 12-14, 1971.

(56) References Cited

OTHER PUBLICATIONS

Kurpis, G. P., The New IEEE Standard Dictionary of Electrical and Electronics Terms, Fifth Edition, New York, IEEE, 1993.
Lancaster, et al., "Miniature Superconducting Filters" IEEE Transactions on Microwave Theory and Techniques (Jul. 1996).
Larson, III, J. D., Ruby, R., Bradley, P. and Oshmyansky, Y., "A BAW Antenna Duplexer for the 1900 MHz PCS Band," 1999 IEEE Ultrasonics Symposium, 2, Oct. 17-20, 1999.
Lee, J.C., "Analysis of Differential Line Length Diplexers and Long-Stub Filters," The Twenty-First Symposium on the USAF Antenna Research and Development Program, Oct. 12-14, 1971.
Liu, "Dual-Frequency Planar Inverted-F Antenna," IEEE Transactions on Antennas and Propagation, vol. 45, No. 10, Oct. 1997.
D. Liu, "A Multi-branch monopole antenna for dual-band cellular applications," IEEE Antennas and Propagation society international symposium and URSI Radio science Meeting proceedings, vol. 3, pp. 1578-1581, Jul. 11-16,1999, USA.
Lo, Y. T., et al. "Theory and Experiment on Microstrip Antennas," 1978 Antenna Applications Symposium, Sep. 20-22, 1978.
Locus, Stanley S., "Antenna Design for High Performance Missile Environment," The Fifth Symposium on the USAF Antenna Research and Development Program, Oct. 16-20, 1955.
Lu, Jui-Han & Wong, Kin-Lu, "Dual-Frequency Rectangular Microstrip Antenna with Embedded Spur Lines and Integrated Reactive Loading," Microwave & Optical Tech. Letters, 21, 4, May 20, 1999.
Lu and Wong, "Single-feed dual-frequency equilateral-triangular microstrip antenna with pair of spur lines," Electronics Letters, vol. 34, No. 12, Jun. 11, 1998.
Lu and Wong, "Slot-loaded, meandered rectangular microstrip antenna with compact dual-frequency operation," Electronics Letters, vol. 34, No. 11, May 28, 1998.
Lu et al., "Novel Dual-Frequency and Broad-Band Designs of Slot-Loaded Equilateral Triangular Microstrip Antennas," Microwave and Optical Technology Letters, vol. 48, No. 7 (Jul., 2000).
Maci, S. and Gentili, G. B., "Dual-Frequency Patch Antennas," IEEE Antennas and Propagation Magazine, 39, Dec. 6, 1997.
Maci et al., "Dual-band Slot-loaded patch antenna", IEE Proc.-Microw. Antennas Propag., vol. 142, No. 3, pp. 225-232 (Jun. 1995).
Martin, W.R., "Flush VOR Antenna for C-121C Aircraft," The Second Symposium on the USAF Antenna Research and Development Program, Oct. 19-23, 1952.
Martin, R.W., et al. "An Unfurlable, High-Gain Log-Periodic Antenna for Space Use" The Seventeenth Symposium on the USAF Antenna Research and Development Program, Nov. 14-17, 1967.
May, "Aerial Magic," New Scientist, pp. 28-30 (Jan. 31, 1998).
Mayes, P.E., et al. "Multi-Arm Logarithmic Spiral Antennas," The Tenth Symposium on the USAF Antenna Research and Development Program, Oct. 3-7, 1960.
Mayes, P.E., et al. "High Gain Log-Periodic Antennas," The Tenth Symposium on the USAF Antenna Research and Development Program, Oct. 3-7, 1960.
Mayes, P., et al. "Some Broadband, Low-Profile Antennas," 1985 Antenna Applications Symposium, Sep. 18-20, 1985.
McDowell, E. P., "High Speed Aircraft Antenna Problems and Some Specific Solutions for MX-1554," The Second Symposium on the USAF Antenna Research and Development Program, Oct. 19-23, 1952.
McDowell, E. P., "Flush Mounted X-Band Beacon Antennas for Aircraft," The Third Symposium on the USAF Antenna Research and Development Program, Oct. 18-22, 1953.
McSpadden, J. O., Lu, Fan and Chang, Kai, "Design and Experiments of a High- Conversion-Efficiency 5.8-GHz Rectenna," IEEE Transactions on Microwave Theory and Techniques, 46, 12, part 1, Dec. 1998.
Misra and Chowdhury, "Study of Impedance and Radiation Properties of a Concentric Microstrip Triangular-Ring Antenna and Its Modeling Techniques Using FDTD Method," IEEE Transactions on Antennas and Propagation, vol. 46, No. 4, Apr. 1998.
Misra, Ita et al., "Experimental Investigations on the Impedance and Radiation Properties of a Three-Element Concentric Microstrip Antenna," Microwave and Optical Technology Letters, vol. 11, No. 2, Feb. 5, 1996.
Moheb, H., Robinson, C. and Kijesky, J., "Design & Development of Co-Polarized Ku-Band Ground Terminal System for Very Small Aperture Terminal (VSAT) Application," IEEE International Symposium on Antennas and Propagation Digest, 3, Jul. 11-16, 1999.
Munson, R. et al. "Conformal Microstrip Array for a Parabolic Dish," The Twenty-Third Symposium on the USAF Antenna Research and Development Program, Oct. 10-12, 1973.
Munson, R., "Microstrip Phased Array Antennas," The Twenty-Second Symposium on the USAF Antenna Research and Development Program, Oct. 11-13, 1972.
Munson, R. E., "Conformal Microstrip Antennas and Microstrip Phased Arrays," IEEE Trans. Antennas Propagat., vol. AP-22, p. 74, Jan. 1974.
Mushiake, Yasuto, Self-Complementary Antennas: Principle of Self-Complementarity for Constant Impedance, London, Springer-Verlag London Limited, 1996.
Nadan, T. Le, Coupez, J. P., Toutain, S. and Person, C., "Integration of an Antenna/Filter Device, Using a Multi-Layer, Multi-Technology Process," 28th European Microwave Conference, vol. 1, Oct. 1998.
Nagai, Kiyoshi, Mikuni, Yoshihiko and Iwasaki, Hisao, "A Mobile Radio Antenna System Having a Self-Diplexing Function," IEEE Transactions on Vehicular Technology, 28, Nov. 4, 1979.
Nakano and Vichien, "Dual-Frequency Square Patch Antenna with Rectangular Notch," Electronics Letters, vol. 25 No. 16, Aug. 3, 1989.
Nishikawa, T., Ishikawa, Y., Hattori, J. and Wakino, K. "Dielectric Receiving Filter with Sharp Stopband Using an Active Feedback Resonator Method for Cellular Base Stations," IEEE Transactions on Microwave Theory and Techniques, 37, Dec. 12, 1989.
Ou, J. D. et al., "An Analysis of Annular, Annular Sector, and Circular Sector Microstrip Antennas," 1981 Antenna Applications Symposium, Sep. 23-25, 1981.
Pan, S. and Hsu, W., "Single-Feed Dual-Frequency Microstrip Antenna with Two Patches," IEEE, 1999.
Paschen, D.A. & Mayes, P.E., "Structural Stropband Elimination with the Monopole-Slot Antenna," 1982 Antenna Applications Symposium, Sep. 22-24, 1982.
Paschen, D.A., "Broadband Microstrip Matching Techniques," 1983 Antenna Applications Symposium, Sep. 21-23, 1983.
Phelan, H.R., "A Wide-Band Parallel-Connected Balun," The Eighteenth Symposium on the USAF Antenna Research and Development Program, Oct. 15-17, 1968.
Puente, C., Romeu, J., Bartoleme, R. and Pous, R., "Perturbation of the Sierpinski Antenna to Allocate Operating Bands," Electronics Letters, 32, 24, Nov. 21, 1996.
Puente-Baliarda, "On the Behavior of the Sierpinski Multiband Fractal Antenna," IEEE Transactions on Antennas and Propagation, vol. 46, No. 4 (Apr. 1998).
Rensh, "Broadband Microstrip Antenna," Proceedings of the Moscow International Conference on Antenna Theory and Tech. 1998, vol. 28, pp. 420-423 (Sep. 22, 1998).
Rockwell B-1B Lancer <http://home.att.net/~jbaugher2/newb1_2.html> (last visited Feb. 17, 2010).
Rosa, J. et al., "A Wide Angle Circularly Polarized Omnidirectional Array Antenna," The Eighteenth Symposium on the USAF Antenna Research and Development Program, Oct. 15-17, 1968.
Rotman, W., "Problems Encountered in the Design of Flush-Mounted Antennas for High Speed Aircraft," The Second Symposium on the USAF Antenna Research and Development Program, Oct. 19-23, 1952.
Rowell and Murch, "A Compact PIFA Suitable for Dual-Frequency 900/1800-MHz Operation," IEEE Transactions on Antennas and Propagation, vol. 46, No. 4, Apr. 1998.
Rowell, "A Capacitating Loaded PIFA for Compact Mobile Telephone Handsets," IEEE Transactions on Antennas and Propagation, 45, May 5, 1997.
Rudge, A. W., Milne, K., Olver, A. D. and Knight P., (eds.), The Handbook of Antenna Design, vols. 1 and 2, London, Peter Peregrinus Ltd., 1986.

(56) References Cited

OTHER PUBLICATIONS

Rumsey, Victory H., Frequency Independent Antennas, New York, Academic Press, 1966.
Sanchez-Hernandez, D. & Robertson, I. D., "Analysis and Design of a Dual-Band Circularly Polarized Microstrip Patch Antenna," IEEE Transactions on Antennas and Propagation, 43, Feb. 2, 1995.
Sandlin, B.S., Terzuoli, A.J., "A Genetic Antenna Design for Improved Radiation Over Earth," Program for 1997 Antenna Applications Symposium (Allerton Conference Proceedings), Sep. 17-18, 1997.
Saunders, Simon R., Antennas and Propagation for Wireless Communication Systems, Chichester, John Wiley & Sons, Ltd., 1999.
Scharfman, W., et al. "Telemetry Antennas for High-Altitude Missiles," The Eighth Symposium on the USAF Antenna Research and Development Program, Oct. 20-24, 1958.
Schaubert, Chang and Wunsch, "Measurement of Phased Array Performance at Arbitrary Scan Angles," presented at the 1994 Antenna Applications Symposium on Sep. 21, 1994.
Seavy, J. et al., "C-Band Paste-On and Floating Ring Reflector Antennas," The Twenty-Third Symposium on the USAF Antenna Research and Development Program, Oct. 10-12, 1973.
Shenoy, A., Chalmers, H., Carpenter, E., Bonetti, R. and Wong, A., "Notebook Satcom Terminal Technology Development," Tenth International Conference on Digital Satellite Communications, May 15-19, 1995.
Shibagaki, N. Sakiyama, K. and Hikita, M., "SAW Antenna Duplexer Module Using SAW-Resonator-Coupled Filter for PCN System," 1998 IEEE Ultrasonics Symposium, 1, Oct. 5-8, 1998.
Shibagaki, N., Sakiyama, K. and Hikita, M. "Miniature SAW Antenna Duplexer Module for 1.9 GHz PCN Systems Using SAW-Resonator-Coupled Filters," 1998 IEEE Ultrasonics Symposium, 2, Jun. 7-12, 1998.
Shimoda, R.Y., "A Variable Impedance Ratio Printed Circuit Balun," 1979 Antenna Applications Symposium, Sep. 26-18, 1979.
Shnitkin, "Analysis of Log-Periodic Folded Dipole Array" (Sep. 1992).
Sinclair, "Theory of Models of Electromagnetic Systems," Proceedings of the IRE, Nov. 1948.
Snow, W. L., et al. "Ku-Band Planar Spiral Antenna," The Nineteenth Symposium on the USAF Antenna Research and Development Program, Oct. 14-16, 1969.
Snow, W. L., "UHF Crossed-Slot Antenna and Applications," The Thirteenth Symposium on the USAF Antenna Research and Development Program, Oct. 14-18, 1963.
Song, C.T.P., Hall, P.T., Ghafouri-Shiraz, H. and Wake, D., "Fractal Stacked Monopole With Very Wide Bandwidth," Electronics Letters, 35, 12, Jun. 10, 1999.
Stang, Abstracts of the 12th Annual Symposium (Oct. 16-19, 1962).
Stang, Paul F., "Balanced Flush Mounted Log-Periodic Antenna for Aerospace Vehicles," Twelfth Annual Symposium on USAF Antenna Research and Development, vol. 1, Oct. 16-19, 1962.
Stutzman, "Antenna Theory and Design," 2nd ed., 1998.
Taga, Tokio and Tsunekawa, Kouichi, "Performance Analysis of a Built-In Planar Inverted F Antenna for 800 MHz Band Portable Radio Units," IEEE Journal on Selected Areas in Communications, vol. SAC-5, No. 5, Jun. 1987.
Tanner, Robert L., et al., "Electronic Counter Measure Antennas for a Modern Electronic Reconnaissance Aircraft," The Fourth Symposium on the USAF Antenna Research and Development Program, Oct. 17-21, 1954.
Teeter, W. W L. and Bushore, K. R., "A Variable-Ratio Microwave Power Divider and Multiplexer," IRE Transactions on Microwave Theory and Techniques, 5, Oct. 4, 1957.
Terman, F. E., Radio Engineering, New York, McGraw-Hill Book Company, 1947.
The Glen L. Martin Company, "Antennas for USAF B-57 Series Bombers" The Second Symposium on the USAF Antenna Research and Development Program, Oct. 19-23, 1952.
Turner and Richard, "Development of an Electrically Small Broadband Antenna," presented at the Eighteenth Symposium on the USAF Antenna Research and Development Program, Oct. 15-17, 1968.
Turner, "Broadband Passive Electrically Small Antennas for TV Application," presented at the Proceedings of the 1977 Antenna Applications Symposium on Apr. 27-29, 1977 at Robert Allerton Park at the University of Illinois.
Virga, "Low-Profile Enhanced Bandwidth PIFA Antennas for Wireless Communications Packaging," IEEE Transactions on Microwave Theory and Techniques, vol. 45, No. 10 (Oct. 1997).
Volakis, J., Antenna Engineering Handbook, pp. 39-7 to 39-15 (4th ed. 2007).
Walker, G.J. and James, J.R., "Fractal Volume Antennas," Electronics Letters, 34, 16, Aug. 6, 1998.
Wall, H. et al. "Communications Antennas for Mercury Space Capsule," The Eleventh Symposium on the USAF Antenna Research and Development Program, Oct. 16-20, 1961.
Watanbe, T., Furutani, K., Nakajima, N. and Mandai, H., "Antenna Switch Duplexer for Dualband Phone (GSM/DCS) Using LTCC Multilayer Technology," IEEE MTT-S International Microwave Symposium Digest, 1, Jun. 13-19, 1999.
Weeks, W. L., Antenna Engineering, New York, McGraw-Hill Book Company, 1968.
Weeks, W. L., Electromagnetic Theory for Engineering Applications, New York John Wiley & Sons, 1964.
Infringement Chart—LG Versa VX9600. Patent: 7,202,822. Fractus, 2009.
Infringement Chart—LG Voyager VX10000. Fractus, 2009.
Infringement Chart—LG Voyager VX10000. Patent: 7,148,850. Fractus, 2009.
Infringement Chart—LG Voyager VX10000. Patent: 7,202,822. Fractus, 2009.
Infringement Chart—LG VU CU920. Fractus, 2009.
Infringement Chart—LG VU CU920. Patent: 7,148,850. Fractus, 2009.
Infringement Chart—LG VU CU920. Patent: 7,202,822. Fractus, 2009.
Infringement Chart—LG VX5400. Fractus, 2009.
Infringement Chart—LG VX5400. Patent: 7,148,850. Fractus, 2009.
Infringement Chart—LG VX5400. Patent: 7,202,822. Fractus, 2009.
Infringement Chart—LG VX5500. Fractus, 2009.
Infringement Chart—LG VX5500. Patent: 7,148,850. Fractus, 2009.
Infringement Chart—LG VX5500. Patent: 7,202,822. Fractus, 2009.
Infringement Chart—LG VX8350. Fractus, 2009.
Infringement Chart—LG VX8350. Patent: 7,148,850. Fractus, 2009.
Infringement Chart—LG VX8350. Patent: 7,202,822. Fractus, 2009.
Infringement Chart—LG VX8360. Fractus, 2009.
Infringement Chart—LG VX8360. Patent: 7,148,850. Fractus, 2009.
Infringement Chart—LG VX8360. Patent: 7,202,822. Fractus, 2009.
Infringement Chart—LG VX8500. Fractus, 2009.
Infringement Chart—LG VX8500. Patent: 7,148,850. Fractus, 2009.
Infringement Chart—LG VX8500. Patent: 7,202,822. Fractus, 2009.
Infringement Chart—LG VX8560 Chocolate 3. Fractus, 2009.
Infringement Chart—LG VX8560 Chocolate 3. Patent: 7,148,850. Fractus, 2009.
Infringement Chart—LG VX8560 Chocolate 3. Patent: 7,202,822. Fractus, 2009.
Infringement Chart—LG VX8610. Fractus, 2009.
Infringement Chart—LG VX8610. Patent: 7,148,850. Fractus, 2009.
Infringement Chart—LG VX8610. Patent: 7,202,822. Fractus, 2009.
Infringement Chart—LG VX8800. Fractus, 2009.
Infringement Chart—LG VX8800. Patent: 7,148,850. Fractus, 2009.
Infringement Chart—LG VX8800. Patent: 7,202,822. Fractus, 2009.
Infringement Chart—LG VX9400. Fractus, 2009.
Infringement Chart—LG Xenon GR500. Fractus, 2009.
Infringement Chart—LG Xenon GR500. Patent: 7,148,850. Fractus, 2009.
Infringement Chart—LG Xenon GR500. Patent: 7,202,822. Fractus, 2009.
Infringement Chart—Palm Centro 685. Fractus, 2009.
Infringement Chart—Palm Centro 685. Patent: 7,148,850. Fractus, 2009.

(56) References Cited

OTHER PUBLICATIONS

Infringement Chart—Palm Centro 685. Patent: 7,202,822. Fractus, 2009.
Infringement Chart—Palm Centro 690. Fractus, 2009.
Infringement Chart—Palm Centro 690. Patent: 7,148,850. Fractus, 2009.
Infringement Chart—Palm Centro 690. Patent: 7,202,822. Fractus, 2009.
Infringement Chart—Palm Pre. Fractus, 2009.
Infringement Chart—Palm Pre. Patent: 7,148,850. Fractus, 2009.
Infringement Chart—Palm Pre. Patent: 7,202,822. Fractus, 2009.
Infringement Chart—Pantech Breeze C520. Fractus, 2009.
Infringement Chart—Pantech Breeze C520. Patent: 7,148,850. Fractus, 2009.
Infringement Chart—Pantech Breeze C520. Patent: 7,202,822. Fractus, 2009.
Infringement Chart—Pantech C610. Fractus, 2009.
Infringement Chart—Pantech C610. Patent: 7,148,850. Fractus, 2009.
Infringement Chart—Pantech C610. Patent: 7,202,822. Fractus, 2009.
Infringement Chart—Samsung SGH A117. Patent: 7,202,822. Fractus, 2009.
Infringement Chart—Samsung SGH A127. Patent: 7,148,850. Fractus, 2009.
Infringement Chart—Samsung SGH A127. Patent: 7,202,822. Fractus, 2009.
Infringement Chart—Samsung SGH A437. Fractus, 2009.
Infringement Chart—Samsung SGH A437. Patent: 7,148,850. Fractus, 2009.
Infringement Chart—Samsung SGH A437. Patent: 7,202,822. Fractus, 2009.
Infringement Chart—Samsung SGH A737. Fractus, 2009.
Infringement Chart—Samsung SGH A737. Patent: 7,148,850. Fractus, 2009.
Infringement Chart—Samsung SGH A737. Patent: 7,202,822. Fractus, 2009.
Infringement Chart—Samsung SGH A867. Fractus, 2009.
Infringement Chart—Samsung SGH A867. Patent: 7,148,850. Fractus, 2009.
Infringement Chart—Samsung SGH A867. Patent: 7,202,822. Fractus, 2009.
Infringement Chart—Samsung SGH T229. Fractus, 2009.
Infringement Chart—Samsung SGH T229. Patent: 7,148,850. Fractus, 2009.
Infringement Chart—Samsung SGH T229. Patent: 7,202,822. Fractus, 2009.
Infringement Chart—Samsung SGH T439. Fractus, 2009.
Infringement Chart—Samsung SGH T439. Patent: 7,148,850. Fractus, 2009.
Infringement Chart—Samsung SGH T439. Patent: 7,202,822. Fractus, 2009.
Infringement Chart—Samsung SGH T459. Fractus, 2009.
Infringement Chart—Samsung SGH T459. Patent: 7,148,850. Fractus, 2009.
Infringement Chart—Samsung SGH T459. Patent: 7,202,822. Fractus, 2009.
Infringement Chart—Samsung SGH T919. Fractus, 2009.
Infringement Chart—Samsung SGH T919. Patent: 7,148,850. Fractus, 2009.
Infringement Chart—Samsung SGH T919. Patent: 7,202,822. Fractus, 2009.
Infringement Chart—Samsung SGH-A237. Fractus, 2009.
Infringement Chart—Samsung SGH-A237. Patent: 7,148,850. Fractus, 2009.
Infringement Chart—Samsung SGH-A237. Patent: 7,202,822. Fractus, 2009.
Infringement Chart—Samsung SGH-A257. Fractus, 2009.
Infringement Chart—Samsung SGH-A257 Magnet. Patent: 7,148,850. Fractus, 2009.
Infringement Chart—Samsung SGH-A257 Magnet. Patent: 7,202,822. Fractus, 2009.
Infringement Chart—Samsung SGH-A837. Fractus, 2009.
Infringement Chart—Samsung SGH-A837. Patent: 7,148,850. Fractus, 2009.
Infringement Chart—Samsung SGH-A837. Patent: 7,202,822. Fractus, 2009.
Infringement Chart—Samsung SGH-A887. Fractus, 2009.
Infringement Chart—Samsung SGH-1907. Patent: 7,148,850 Fractus, 2009.
Infringement Chart—Samsung SGH-1907. Patent: 7,202,822. Fractus, 2009.
Infringement Chart—Samsung SGH-T219. Fractus, 2009.
Infringement Chart—Samsung SGH-T219. Patent: 7,148,850. Fractus, 2009.
Infringement Chart—Samsung SGH-T219. Patent: 7,202,822. Fractus, 2009.
Infringement Chart—Samsung SGH-T239. Fractus, 2009.
Infringement Chart—Samsung SGH-T239. Patent: 7,148,850. Fractus, 2009.
Infringement Chart—Samsung SGH-T239. Patent: 7,202,822. Fractus, 2009.
Infringement Chart—Samsung SGH-T559. Fractus, 2009.
Infringement Chart—Samsung SGH-T559 Comeback. Patent: 7,148,850. Fractus, 2009.
Infringement Chart—Samsung SGH-T559 Comeback. Patent: 7,202,822. Fractus, 2009.
Infringement Chart—Samsung SGH-T639. Fractus, 2009.
Infringement Chart—Samsung SGH-T639. Patent: 7,148,850. Fractus, 2009.
Infringement Chart—Samsung SGH-T639. Patent: 7,202,822. Fractus, 2009.
Infringement Chart—Samsung SGH-T739. Fractus, 2009.
Infringement Chart—Samsung SGH-T739. Patent: 7,148,850. Fractus, 2009.
Infringement Chart—UTStarcom CDM7126. Patent: 7,202,822. Fractus, 2009.
Infringement Chart—UTStarcom Quickfire GTX75. Fractus, 2009.
Infringement Chart—UTStarcom Quickfire GTX75. Patent: 7,148,850. Fractus, 2009.
Infringement Chart—UTStarcom Quickfire GTX75. Patent: 7,202,822. Fractus, 2009.
Puente , C. ; Romeu , J. ; Cardama , A. Fractal-shaped antennas. Frontiers in electromagnetics—IEEE Press, 2000.
Infringement Chart—HTC Tilt 8925. Patent: 7,148,850. Fractus, 2009.
Infringement Chart—HTC Tilt 8925. Patent: 7,202,822. Fractus, 2009.
Infringement Chart—HTC Touch Pro 2. Fractus, 2009.
Infringement Chart—HTC Touch Pro 2 CDMA. Patent: 7,148,850. Fractus, 2009.
Infringement Chart—HTC Touch Pro 2. Patent: 7,202,822. Fractus, 2009.
Infringement Chart—HTC Touch Pro Fuze. Fractus, 2009.
Infringement Chart—HTC Touch Pro Fuze. Patent: 7,148,850. Fractus, 2009.
Infringement Chart—HTC Touch Pro Fuze. Patent: 7,202,822. Fractus, 2009.
Infringement Chart—HTC Touch Pro. Fractus, 2009.
Infringement Chart—HTC Touch Pro. Patent: 7,148,850. Fractus, 2009.
Infringement Chart—HTC Touch Pro. Patent: 7,202,822. Fractus, 2009.
Infringement Chart—HTC Wing. Fractus, 2009.
Infringement Chart—HTC Wing. Patent: 7,148,850. Fractus, 2009.
Infringement Chart—HTC Wing. Patent: 7,202,822. Fractus, 2009.
Infringement Chart—Kyocera Jax. Fractus, 2009.
Infringement Chart—Kyocera Jax. Patent: 7,148,850. Fractus, 2009.
Infringement Chart—Kyocera Jax. Patent: 7,202,822. Fractus, 2009.
Infringement Chart—Kyocera MARBL. Fractus, 2009.
Infringement Chart—Kyocera MARBL. Patent: 7,148,850. Fractus, 2009.

(56) References Cited

OTHER PUBLICATIONS

Infringement Chart—Kyocera MARBL. Patent: 7,202,822. Fractus, 2009.
Infringement Chart—Kyocera NEO E1100. Fractus, 2009.
Infringement Chart—Kyocera NEO E1100. Patent: 7,148,850. Fractus, 2009.
Infringement Chart—Kyocera NEO E1100. Patent: 7,202,822. Fractus, 2009.
Infringement Chart—Kyocera S2400. Fractus, 2009.
Infringement Chart—Kyocera S2400. Patent: 7,148,850. Fractus, 2009.
Infringement Chart—Kyocera S2400. Patent: 7,202,822. Fractus, 2009.
Infringement Chart—Kyocera Wildcard M1000. Fractus, 2009.
Infringement Chart—Kyocera Wildcard M1000. Patent: 7,148,850. Fractus, 2009.
Infringement Chart—Kyocera Wildcard M1000. Patent: 7,202,822. Fractus, 2009.
Infringement Chart—LG 300G. Fractus, 2009.
Infringement Chart—LG 300G. Patent: 7,148,850. Fractus, 2009.
Infringement Chart—LG 300G. Patent: 7,202,822. Fractus, 2009.
Infringement Chart—LG Aloha LX140. Fractus, 2009.
Infringement Chart—LG Aloha LX140. Patent: 7,148,850. Fractus, 2009.
Infringement Chart—LG Aloha LX140. Patent: 7,202,822. Fractus, 2009.
Infringement Chart—LG AX155. Fractus, 2009.
Infringement Chart—LG AX155. Patent: 7,148,850. Fractus, 2009.
Infringement Chart—LG AX155. Patent: 7,202,822. Fractus, 2009.
Infringement Chart—LG AX300. Fractus, 2009.
Infringement Chart—LG AX300. Patent: 7,148,850. Fractus, 2009.
Infringement Chart—LG AX300. Patent: 7,202,822. Fractus, 2009.
Infringement Chart—LG AX380. Fractus, 2009.
Infringement Chart—LG AX380. Patent: 7,148,850. Fractus, 2009.
Infringement Chart—LG AX380. Patent: 7,202,822. Fractus, 2009.
Infringement Chart—LG AX585. Fractus, 2009.
Infringement Chart—LG AX585. Patent: 7,148,850. Fractus, 2009.
Infringement Chart—LG AX585. Patent: 7,202,822. Fractus, 2009.
Infringement Chart—LG AX8600. Fractus, 2009.
Infringement Chart—LG AX8600. Patent: 7,148,850. Fractus, 2009.
Infringement Chart—LG AX8600. Patent: 7,202,822. Fractus, 2009.
Notice of compliance with motion practice orders, Feb. 14, 2011.
Reply brief in support of Defendant's motion for reconsideration of the court's ruling on the term "at least a portion" in the court's Dec. 17, 2010 claim construction order based on newly-available evidence, dated on Feb. 25, 2011.
Defendants Samsung Electronics Co LTD (et al) second amended answer and counterclaims to the second amended complaint of plaintiff Fractus SA, dated on Feb. 28, 2011.
Defendants LG Electronics Inc, LG Electronics USA, and LG Electronics Mobilecomm USA Inc's second amended answer and counterclaim to second amended complaint, dated on Feb. 28, 2011.
Declaration of Jeffery D. Baxter—Including Exhibits: J, K, L, M ,N ,O, P, Q, R, S, T, U, Z, AA, KK, LL, WW, BBB, EEE, GGG, HHH, III, KKK, MMM, NNN, OOO, PPP, QQQ, TTT, UUU, VVV, WWW, YYY, ZAA, AAAA, BBBB, dated on Jul. 30, 2010.
Declaration of Thomas E. Nelson—Exhibit A—Antenna photos, dated on Feb. 3, 2011.
Defendant's notice of compliance regarding second amended invalidity contentions, dated on Jan. 21, 2011.
Defendant Pantech Wireless Inc amended answer, affirmative defenses, and counterclaims to Fractus' second amended complaint, dated on Feb. 28, 2011.
Rebuttal expert report of Dr. Stuart A. Long (redacted version), dated on Feb. 16, 2011.
Rebuttal expert report of Dr. Warren L. Stutzman (redacted version), dated on Feb. 16, 2011.
Rebuttal expert report of Dr. Dwight L. Jaggard (redacted version), dated on Feb. 16, 2011.
Fractus' reply to defendant's motion for reconsideration of, and objections to, magistrate Judge Love's markman order, dated on Feb. 4, 2011.
Memorandum opinion and order, dated on Jan. 20, 2011.
Order adopting report and recommendation of magistrate judge, dated on Feb. 11, 2011.
Report and recommendation of United States magistrate judge, dated on Feb. 8, 2011.
Request for inter partes reexamination of US patent 7,148,850—95/001,413—Third party requester's comments to patent owner's reply dated on Jan. 10, 2011.
Request for inter partes reexamination of US patent 7,202,822—95/001,414—Third party requester's comments to patent owner's reply dated on Jan. 10, 2011.
Request for inter partes reexamination of US patent No. 7,202,822—95/000,610—including exhibits C1-C2-C3-C4-C5-D1-D2-D3-D4-E1-E2-E3-E4-E5-F1-F2-F3-G-H-I1-I2-I3-I4-I5.
Howe , M. Document 440-2—Declaration of Micah Howe in support of Fractus SA opposition to defendants' motion for summary judgement of invalidity based on indefiniteness and lack of written description for certain terms. Heim , Payne and Chorus LLP. Aug. 16, 2010.
Howe , M. Document 893—Fractus SA's surreply to defendants motion to clarify claim construction. Susman Godfrey, Apr. 29, 2011.
Love , J. Document 900—Order. Court, Apr. 29, 2011.
Davis , L. Document 968—Order. Court, May 13, 2011.
Davis, L. Document 971—Order. Court, May 13, 2011.
Baxter , J. Document 429—Declaration of Jeffery D. Baxter—Including Exhibits: J, K, L, M ,N ,O, P, Q, R, S, T, U, Z, AA, KL, LL. Defendants, Jul. 30, 2010.
NA Document 452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q. Defendants, Aug. 30, 2010.
Falconer , K. Fractal Geometry: Mathematical Foundations and Applications. John Wiley & Sons, 1990, pp. 38-44.
Laufer , P. M. Decision Sua Sponte to merle reexamination porceedings of US patent 7,148,850 and reexamination Nos. 95/000,593—95/001,413—95/000,598. USPTO. Jun. 8, 2011.
Laufer , P. M. Decision Sua Sponte to merge reexamination proceedings of US patent 7,202,822 and reexamination Nos. 95/000,592—95/000,610—95/001,414. USPTO. Jun. 7, 2011.
Nguyen , L. office Action of US patent 7,148,850 and control No. 95/001,314—95/000,598—95/000,593 dated Jul. 29, 2011. USPTO.
Nguyen , L. office Action of US patent 7,202,822 and control No. 95/000,592—95/000,610—95/001,414 dated Jul. 29, 2011. USPTO.
Buczkowski, S. Measurements of fractal dimension by box-counting: a critical analysis of data scatter. Elservier Science, 1998.
Buczkowski, S. The modified box-counting method: analysis of some characteristic parameters. Pattern Recognition, vol. 31, 1998.
Feng, J. Fractional box-counting approach to fractal dimension estimation. Proceedings of ICPR, 1996.
Foroutan, K et al. Advances in the implementation of the box-counting method of fractal dimension estimation. Elservier Science, 1999.
Gagnepain, J. et al. Fractal approach to two-dimension and three-dimensional surface roughness, Wear, 109, 1986.
Heberling, D. et al. Trends on handset antennas. 29th European Microwave Conference, 1999.
Huang, Q. Can the fractal dimension of images be measured? Pattern Recognition, vol. 27, 1994.
Saarkar, N. An efficient differential box-counting approach to compute fractal dimension of image. IEEE Transactions on Systems, man, and cybernetics, vol. 24, 1994.
Walsh, J. et al. Short notes: Fractal analysis of fracture patterns using the standard box-counting technique: valid and invalid methodologies. Journal of Structural Geology, vol. 15, 1993.
Chen, X. Small antenna desing for mobile handsets. Sony Ericsson, Mar. 2003.
External photographies Nokia mobile 8860 (FCC ID LJPNSW-6NX). FCC, Jul. 1999.
Internal photographies Nokia mobile 8860 (FCC ID LJPNSW-6NX). FCC, Jul. 1999.

(56) References Cited

OTHER PUBLICATIONS

Walker , B. Response to office action dated Aug. 18, 2010 of U.S. Appl. No. 12/498,090.
Addison , P. S. Fractals and chaos. Institute of Physics Publishing. 1997. pag 256.
Verdura, O. Miniature fractal antenna (Antena fractal miniatura). Universitat Politecnica de Catalunya. Sep. 1997.
Chen , X. ; Ying , Z. Small Antenna Design for Mobile Handsets (part I). Sony Ericsson. Mar. 25, 2009.
NA. Document 430—Defendants Rim, Samsung, HTC, LG and Pantech's response to plaintiff Fractus SA's opening claim construction brief. Defendants. Jul. 30, 2010.
Addison , P. S. Fractals and chaos—An illustrated course. Institute of Physics Publishing. 1997. pag 1-3 , 30-36.
Borja , C. Fractal microstrip antennas (Antenas fractales microstrip). Universitat Politecnica de Catalunya. Jul. 1997.
Bhaysar , S.A. Document 641—Defendant HTC America, Inc's second amended answer and counterclaim to plaintiffs second amended complaint. Defendants, 2011.
Bhaysar , S. A. Document 642—Defendant HTC Corporation's second amended answer and counterclaim to plaintiffs second amended complaint. Defendants, 2011.
Infringement Chart—Samsung SGH-T739. Patent: 7,202,822. Fractus, 2009.
Infringement Chart—Samsung SGH-T819. Fractus, 2009.
Infringement Chart—Samsung SGH-T819. Patent: 7,148,850. Fractus, 2009.
Infringement Chart—Samsung SGH-T819. Patent: 7,202,822. Fractus, 2009.
Infringement Chart—Samsung SGH-T929. Fractus, 2009.
Infringement Chart—Samsung SGH-T929. Patent: 7,148,850. Fractus, 2009.
Infringement Chart—Samsung SGH-T929. Patent: 7,202,822. Fractus, 2009.
Infringement Chart—Samsung Spex R210a. Fractus, 2009.
Infringement Chart—Samsung Spex R210a. Patent: 7,148,850. Fractus, 2009.
Infringement Chart—Samsung Spex R210a. Patent: 7,202,822. Fractus, 2009.
Infringement Chart—Samsung SPH M520. Fractus, 2009.
Infringement Chart—Samsung SPH M520. Patent: 7,148,850. Fractus, 2009.
Infringement Chart—Samsung SPH M520. Patent: 7,202,822. Fractus, 2009.
Infringement Chart—Samsung SPH M540. Fractus, 2009.
Infringement Chart—Samsung SPH M540. Patent: 7,148,850. Fractus, 2009.
Infringement Chart—Samsung SPH M540. Patent: 7,202,822. Fractus, 2009.
Infringement Chart—Samsung SPH-A523. Fractus, 2009.
Infringement Chart—Samsung SPH-A523. Patent: 7,148,850. Fractus, 2009.
Infringement Chart—Samsung SPH-A523. Patent: 7,202,822. Fractus, 2009.
Infringement Chart—Samsung SPH-M550. Fractus, 2009.
Infringement Chart—Samsung SPH-M550. Patent: 7,148,850. Fractus, 2009.
Infringement Chart—Samsung SPH-M550. Patent: 7,202,822. Fractus, 2009.
Infringement Chart—Samsung Sway SCH-U650. Fractus, 2009.
Infringement Chart—Samsung Sway SCH-U650. Patent: 7,148,850. Fractus, 2009.
Infringement Chart—Samsung Sway SCH-U650. Patent: 7,202,822. Fractus, 2009.
Infringement Chart—Sanyo Katana II. Fractus, 2009.
Infringement Chart—Sanyo Katana II. Patent: 7,148,850. Fractus, 2009.
Infringement Chart—Sanyo Katana II. Patent: 7,202,822. Fractus, 2009.
Infringement Chart—Sanyo Katana LX. Fractus, 2009.
Infringement Chart—Sanyo Katana LX. Patent: 7,148,850. Fractus, 2009.
Infringement Chart—Sanyo Katana LX. Patent: 7,202,822. Fractus, 2009.
Infringement Chart—Sanyo S1. Fractus, 2009.
Infringement Chart—Sanyo S1. Patent: 7,148,850. Fractus, 2009.
Infringement Chart—Sanyo S1. Patent: 7,202,822. Fractus, 2009.
Infringement Chart—Sanyo SCP 2700. Fractus, 2009.
Infringement Chart—Sanyo SCP 2700. Patent: 7,148,850. Fractus, 2009.
Infringement Chart—Sanyo SCP 2700. Patent: 7,202,822. Fractus, 2009.
Infringement Chart—Sharp Sidekick 2008. Fractus, 2009.
Infringement Chart—Sharp Sidekick 2008. Patent: 7,148,850. Fractus, 2009.
Infringement Chart—Sharp Sidekick 2008. Patent: 7,202,822. Fractus, 2009.
Infringement Chart—Sharp Sidekick 3. Fractus, 2009.
Infringement Chart—Sharp Sidekick 3. Patent: 7,148,850. Fractus, 2009.
Infringement Chart—Sharp Sidekick 3. Patent: 7,202,822. Fractus, 2009.
Infringement Chart—Sharp Sidekick LX 2009. Fractus, 2009.
Infringement Chart—Sharp Sidekick LX 2009. Patent: 7,148,850. Fractus, 2009.
Infringement Chart—Sharp Sidekick LX 2009. Patent: 7,202,822. Fractus, 2009.
Infringement Chart—Sharp Sidekick LX. Patent: 7,148,850. Fractus, 2009.
Infringement Chart—Sharp Sidekick LX. Patent: 7,202,822. Fractus, 2009.
Infringement Chart—UTStarcom CDM7126. Fractus, 2009.
Infringement Chart—UTStarcom CDM7126. Patent: 7,148,850. Fractus, 2009.
Antenna Installation on Super Constellation Airborne Early Warning and Control Aircraft (Allerton Conference 1954).
Counter, V. A., "Flush, Re-entrant, Impedance Phased, Circularly Polarized Cavity Antenna for Missiles," The Second Symposium on the USAF Antenna Research and Development Program, Oct. 19-23, 1952.
Counter and Margerum, Flush Dielectric Disc Antenna for Radar (AllertonConference 1952).
FCC Form 731 filed Apr. 1, 1999.
GSM Technical Specification and related materials.
James and Hall, "Handbook of Microstrip Antennas", vol. 1, 1989.
Photos of Nokia Motorola Advisor Elite (1997).
Photos of Nokia Motorola Advisor Gold (1996).
Photos of Nokia Motorola Bravo Plus (1995).
Photos of Nokia Motorola P935 (2000).
Photos of Nokia Motorola Page Writer 2000x (2000).
Photos of Nokia 3360 (1999 or earlier).
Photos of Hagenuk (1996 or earlier).
Photos of RIM950 (2000 or earlier).
Infringement Chart—LG CF360. Fractus, 2009.
Infringement Chart—LG CF360. Patent: 7,148,850. Fractus, 2009.
Infringement Chart—LG CF360. Patent: 7,202,822. Fractus, 2009.
Infringement Chart—LG Chocolate VX8550. Fractus, 2009.
Infringement Chart—LG Chocolate VX8550. Patent: 7,148,850. Fractus, 2009.
Infringement Chart—LG Chocolate VX8550. Patent: 7,202,822. Fractus, 2009.
Infringement Chart—LG CU515. Fractus, 2009.
Infringement Chart—LG CU515. Patent: 7,148,850. Fractus, 2009.
Infringement Chart—LG CU515. Patent: 7,202,822 Fractus, 2009.
Infringement Chart—LG Dare VX9700. Fractus, 2009.
Infringement Chart—LG Dare VX9700. Patent: 7,148,850. Fractus, 2009.
Infringement Chart—LG Dare VX9700. Patent: 7,202,822. Fractus, 2009.
Infringement Chart—LG enV Touch VX1100. Fractus, 2009.
Infringement Chart—LG enV Touch VX1100. Patent: 7,148,850. Fractus, 2009.

(56) References Cited

OTHER PUBLICATIONS

Infringement Chart—LG enV Touch VX1100. Patent: 7,202,822. Fractus, 2009.
Infringement Chart—LG enV VX9900. Fractus, 2009.
Infringement Chart—LG enV VX-9900. Patent: 7,148,850. Fractus, 2009.
Infringement Chart—LG enV VX-9900. Patent: 7,202,822. Fractus, 2009.
Infringement Chart—LG EnV2 VX9100. Fractus, 2009.
Infringement Chart—LG EnV2 VX9100. Patent: 7,148,850. Fractus, 2009.
Infringement Chart—LG EnV2 VX9100. Patent: 7,202,822. Fractus, 2009.
Infringement Chart—LG EnV3 VX9200. Fractus, 2009.
Infringement Chart—LG EnV3 VX9200. Patent: 7,148,850. Fractus, 2009.
Infringement Chart—LG EnV3 VX9200. Patent: 7,202,822. Fractus, 2009.
Infringement Chart—LG Flare LX165. Fractus, 2009.
Infringement Chart—LG Flare LX165. Patent: 7,148,850. Fractus, 2009.
Infringement Chart—LG Flare LX165. Patent: 7,202,822. Fractus, 2009.
Infringement Chart—LG GT365 NEON. Fractus, 2009.
Infringement Chart—LG GT365 NEON. Patent: 7,148,850. Fractus, 2009.
Infringement Chart—LG GT365 NEON. Patent: 7,202,822. Fractus, 2009.
Infringement Chart—LG Lotus. Fractus, 2009.
Infringement Chart—LG Lotus. Patent: 7,148,850. Fractus, 2009.
Infringement Chart—LG Lotus. Patent: 7,202,822. Fractus, 2009.
Infringement Chart—LG Muziq LX570. Fractus, 2009.
Infringement Chart—LG Muziq LX570. Patent: 7,148,850. Fractus, 2009.
Infringement Chart—LG Muziq LX570. Patent: 7,202,822. Fractus, 2009.
Infringement Chart—LG Rumor. Fractus, 2009.
Infringement Chart—LG Rumor 2. Fractus, 2009.
Infringement Chart—LG Rumor 2. Patent: 7,148,850. Fractus, 2009.
Infringement Chart—LG Rumor 2. Patent: 7,202,822. Fractus, 2009.
Infringement Chart—LG Rumor. Patent: 7,148,850. Fractus, 2009.
Infringement Chart—LG Rumor. Patent: 7,202,822. Fractus, 2009.
Infringement Chart—LG Shine CU720. Fractus, 2009.
Infringement Chart—LG Shine CU720. Patent: 7,148,850. Fractus, 2009.
Infringement Chart—LG Shine CU720. Patent: 7,202,822. Fractus, 2009.
Infringement Chart—LG UX200. Fractus, 2009.
Infringement Chart—LG UX280. Patent: 7,148,850. Fractus, 2009.
Infringement Chart—LG UX280. Patent: 7,202,822. Fractus, 2009.
Infringement Chart—LG Versa VX9600. Fractus, 2009.
Infringement Chart—LG Versa VX9600. Patent: 7,148,850. Fractus, 2009.
Garg , R. et al, Microstrip antenna design handbook, Chapter 1—Microstrip Radiators, Artech House, 2001.
Peitgen , H. O. et al, Chaos and fractals, Springer-Verlag, 1992, pp. 880-895.
Peitgen , H. O. et al, Chaos and fractals, Springer-Verlag, 1992, pp. 23-28, 94-95, 202-206, 225, 231-243, 283-292, 392-396, 441, 225, 372-373, 386-389, 390-391.
Durgun , A. C. ; Reese , M. S. ; Balanis , C. A. et al, Flexible bow-tie antennas with reduced metallization, IEEE Radio and Wireless Symposium (RWS), Jan. 16, 2011, pp. 50-53.
Puente , C., Fractal antennas, Universitat Politecnica de Catalunya, May 1997, pp. ix-xiv, 234-237.
Qiu , Jianming et al., A planar monopole antenna design with band-notched characteristic, IEEE Transactions on antennas and propagations, Jan. 2006, pp. 288-292.
Song , C. T. P. et al, Multi-circular loop monopole antenna, Electronic Letters, Mar. 2000.
Jaggard , D. L., Expert report of Dwight L. Jaggard (redacted)—expert witness retained by Fractus, Feb. 23, 2011, pp. ii-vi, 12-24.
Amendment and response to final rejection dated Oct. 6, 2001 of U.S. Appl. No. 10/371,676 on Dec. 3, 2004—Kyocera Wireless.
Office action for U.S. Appl. No. 12/498,090 dated on Dec. 30, 2011.
Office Action of U.S. Appl. No. 12/347,462 dated on Dec. 7, 2011.
Office Action of U.S. Appl. No. 13/020,034 dated on Nov. 8, 2011.
Office action of U.S. Appl. No. 13/044,207 dated on Dec. 5, 2011.
Amendment and response to office action dated Dec. 7, 2011 for U.S. Appl. No. 12/347,462, dated on Apr. 3, 2012.
Amendment and response to office action dated Dec. 30, 2011 for U.S. Appl. No. 12/498,090, dated on Apr. 3, 2012.
Amendment and response to office action dated Nov. 8, 2011 for U.S. Appl. No. 13/020,034, dated on Apr. 3, 2012.
Amendment and response to office action dated Dec. 5, 2011 for U.S. Appl. No. 13/044,207, dated on Apr. 3, 2012.
Third party requester's comments to patent owners response of Oct. 31, 2011 for US patent 7,148,850—95/001,413 , 95/000,593, dated on Mar. 23, 2012.
Third party requester's comments to patent owners response of Oct. 31, 2011 for US patent 7,202,822—95/001,414 , 95/000,592 , 95/000,610, dated on Mar. 23, 2012.
Jaggard , D. L. The oral and videotaped deposition of Dwight Jaggard. vol. 1. Defendants. Mar. 8, 2011.
Jaggard , D. L. The oral and videotaped deposition of Dwight Jaggard. vol. 2. Defendants. Mar. 9, 2011.
Jaggard , D. L. The oral and videotaped deposition of Dwight Jaggard. vol. 3. Defendants. Mar. 10, 2011.
Best , S. R. Demonstratives presented by Dr. Steven Best during trial. Defendants. May 19, 2011.
Long , S. Dr. Stuart Long infringement analysis presented during trial. Fractus. May 18, 2011.
Katsibas , K. D. ; Balanis , C. A. ; Panayiotis , A. T. ; Birtcher , C. R. Folded loop antenna for mobile hand-held units. IEEE Transactions on antennas and propagation. Feb. 1, 1998.
Addison , P. Fractals and chaos. An illustrated course. Institute of Physics Publishing. Pag 14-15. Jan. 1, 1997.
NA. Patent owner's response to first office action of Jul. 29, 2011 of US patent 7,148,850—95/001,413—95/000,593—95/000,598. Sterne, Kessler, Goldstein & Fox. Oct. 31, 2011.
NA. Patent owner's response to first office action of Jul. 29, 2011 of US patent 7,202,822—95/001,414—95/000,592—95/000,610. Sterne, Kessler , Goldstein & Fox. Oct. 31, 2011.
Peitgen , H. ; Saupe , D. The science of fractal images. Springer-Verlag. Pag 60-63. Jan. 1, 1988.
NA. Transcript of jury trial before the Honorable Leonard Davis—May 18, 2011—1:00 PM. Court. May 18, 2011.
NA. Transcript of jury trial before the Honorable Leonard Davis—May 18, 2011—8:45 AM. Court. May 18, 2011.
NA. Transcript of jury trial before the Honorable Leonard Davis—May 19, 2011—1:00 PM. Court. May 19, 2011.
Na. Transcript of jury trial before the Honorable Leonard Davis—May 19, 2011—8:45 AM. Court. May 19, 2011.
NA. Transcript of jury trial before the Honorable Leonard Davis—May 20, 2011—8:30 AM. Court. May 20, 2011.
NA. Transcript of jury trial before the Honorable Leonard Davis—May 20, 2011—12:30 PM. Court. May 20, 2011.
NA. Transcript of jury trial before the Honorable Leonard Davis—May 23, 2011—8:55 AM. Court. May 23, 2011.
NA. Transcript of jury trial before the Honorable Leonard Davis US District Judge—May 17, 2011—8:00 AM. Court. May 17, 2011.
NA. Transcript of jury trial before the Honorable Leonard Davis, US District Judge—May 17, 2011—1:10 PM. Court. May 17, 2011.
NA. Transcript of pretrial hearing before the Honorable Leonard Davis, US District Judge—May 16, 2011—2:00 PM. Court. May 16, 2011.
Document 1082—Joint motion to dismiss HTC. Susman Godfrey LLP. Sep. 13, 2011.
Document 1083—Order—Final consent judgement HTC. Court. Sep. 15, 2011.

(56) References Cited

OTHER PUBLICATIONS

Document 1088—Samsung's motion to determine intervening rights in view of new Federal Circuit case law or, in the alternative, to stay the case pending the outcome of reexamination. Defendants. Oct. 19, 2011.
Document 1091—Fractus's response to Samsung's motion to determine intervening rights or to stay the case pending the outcome of reexamination. Susman Godfrey LLC. Nov. 2, 2011.
Document 1092—Samsung's reply in support of its motion to determine intervening rights in view of new Federal Circuit case law or, in the alternative, to stay the case pending the outcome of reexamination. Defendants. Nov. 14, 2011.
Oral and videotaped deposition of Dr. Stuart Long—vol. 1. Mar. 11, 2011.
Oral and videotaped deposition of Dr. Stuart Long—vol. 2. Mar. 13, 2011.
Oral and videotaped deposition of Dr. Stuart Long—vol. 3. Mar. 14, 2011.
Oral and videotaped deposition of Dr. Warren L. Stutzman—vol. 1. Mar. 3, 2011.
Oral and videotaped deposition of Dr. Warren L. Stutzman—vol. 2. Mar. 4, 2011.
Office Action of U.S. Appl. No. 13/020,034 dated on Nov. 8, 2011. USPTO.
Office Action of U.S. Appl. No. 12/347,462 dated on Dec. 7, 2011. USPTO.
Office Action of U.S. Appl. No. 13/044,207 dated on Dec. 5, 2011. USPTO.
USPTO Action Closing Prosecution; Transmittal of Communication of Third Party Requester Inter Partes Reexamination (of US Patent No. 7,148,850) for re-examination application No. 95/001,413; Apr. 20, 2012.
USPTO Action Closing Prosecution; Transmittal of Communication of Third Party Requester Inter Partes Reexamination (of US Patent No. 7,202,822) for re-examination application No. 95/001,414; Apr. 20, 2012.
U.S. Appl. No. 95/001,413—U.S. Appl. No. 95/000,593—Right of appeal notice for the US7148850, dated on Dec. 13, 2012.
U.S. Appl. No. 95/001,414—U.S. Appl. No. 95/000,592—Right of appeal notice for the US7202822, dated on Dec. 17, 2012.
U.S. Appl. No. 12/498,090—Notice of allowance dated on Apr. 13, 2012.
U.S. Appl. No. 12/347,462—Notice of allowance dated on Apr. 13, 2012.
U.S. Appl. No. 13/020,034—Notice of allowance dated Apr. 23, 2012.
U.S. Appl. No. 13/044,207—Notice of allowance dated May 1, 2012.
U.S. Appl. No. 13/020,034—Notice of allowance dated Jan. 15, 2013.
EP05012854—Decision of the Technical Board of Appeal of the European Patent Office dated Apr. 20, 2012.
95/001,414—95/000592—Action closing prosecution for US patent 7202822 dated Aug. 9, 2012.
U.S. Appl. No. 95/001,413, U.S. Appl. No. 95/000,593—Action closing prosecution for US patent 7148850 dated on Jul. 27, 2012.
U.S. Appl. No. 13/020,034—Communication to examiner and preliminary amendment, dated on Jul. 24, 2012.
U.S. Appl. No. 13/044,207—Communication to examiner and preliminary amendment, dated on Aug. 14, 2012.
U.S. Appl. No. 95/001,413—U.S. Appl. No. 95/000,593—Patent owner amendment in response to the Right of Appeal Notice mailed Dec. 13, 2012 for US patent 7148850, dated on Mar. 13, 2013.
U.S. Appl. No. 95/001,414—U.S. Appl. No. 95/000,592—Patent owner amendment in response to Right of Appeal Notice mailed on Dec. 13, 2012 for US patent 7202822, dated on Mar. 13, 2013.
U.S. Appl. No. 13/020,034—Notice of allowance dated on Apr. 3, 2013.
U.S. Appl. No. 13/044,207—Notice of Allowance dated on Apr. 2, 2013.
U.S. Appl. No. 95/001,413—U.S. Appl. No. 95/000,593—Inter partes reexamination certificate for US patent 7148850, dated on Jun. 6, 2013.
U.S. Appl. No. 13/044,207—Amendment to the claims and RCE, dated on Jun. 7, 2013.
U.S. Appl. No. 13/044,207—Office action dated on Jul. 2, 2013.
U.S. Appl. No. 13/044,207—Amendment and response to office action dated on Jul. 2, 2013. Howison and Arnott. Jul. 25, 2013.
U.S. Appl. No. 13/044,207—Notice of allowance. USPTO. Aug. 5, 2013.

* cited by examiner

SPACE-FILLING MINIATURE ANTENNAS

CROSS-REFERENCE TO RELATED APPLICATIONS

This application is a Continuation of U.S. patent application Ser. No. 12/498,090, filed Jul. 6, 2009, entitled SPACE-FILLING MINIATURE ANTENNAS which is a Continuation of U.S. patent application Ser. No. 12/347,462, filed Dec. 31, 2008, entitled SPACE-FILLING MINIATURE ANTENNAS, which is a Continuation of U.S. Pat. No. 7,554,490, issued Jun. 30, 2009, entitled SPACE-FILLING MINIATURE ANTENNAS, which is a Divisional Application of U.S. Pat. No. 7,202,822, issued Apr. 10, 2007, entitled SPACE-FILLING MINIATURE ANTENNAS, which is a Continuation Application of U.S. Pat. No. 7,148,850, issued on Dec. 12, 2006, entitled SPACE-FILLING MINIATURE ANTENNAS, which is a Continuation Application of U.S. patent application Ser. No. 10/182,635, filed on Nov. 1, 2002, now abandoned, entitled SPACE-FILLING MINIATURE ANTENNAS, which is a 371 of PCT/EP00/00411, filed on Jan. 19, 2000, entitled SPACE-FILLING MINIATURE ANTENNAS.

TECHNICAL FIELD

The present invention generally refers to a new family of antennas of reduced size based on an innovative geometry, the geometry of the curves named as Space-Filling Curves (SFC). An antenna is said to be a small antenna (a miniature antenna) when it can be fitted in a small space compared to the operating wavelength. More precisely, the radiansphere is taken as the reference for classifying an antenna as being small. The radiansphere is an imaginary sphere of radius equal to the operating wavelength divided by two times .pi.; an antenna is said to be small in terms of the wavelength when it can be fitted inside said radiansphere.

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

The invention is applicable to the field of the telecommunications and more concretely to the design of antennas with reduced size.

BACKGROUND

The fundamental limits on small antennas where theoretically established by H-Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of an small antenna.

Related to this phenomenon, it is also known that a small antenna features a large input reactance (either-capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radiansphere surrounding the antenna.

In the present invention, a novel set of geometries named Space-Filling Curves (hereafter SFC) are introduced for the design and construction of small antennas that improve the performance of other classical antennas described in the prior art (such as linear monopoles, dipoles and circular or rectangular loops).

Some of the geometries described in the present invention are inspired in the geometries studied already in the XIX century by several mathematicians such as Giusepe Peano and David Hilbert. In all said cases the curves were studied from the mathematical point of view but were never used for any practical-engineering application.

The dimension (D) is often used to characterize highly complex geometrical curves and structures such those described in the present invention. There exists many different mathematical definitions of dimension but in the present document the box-counting dimension (which is well-known to those skilled in mathematics theory) is used to characterize a family of designs. Those skilled in mathematics theory will notice that optionally, an Iterated Function System (IFS), a Multireduction Copy Machine (MRCM) or a Networked Multireduction Copy Machine (MRCM) algorithm can be used to construct some space-filling curves as those described in the present invention.

The key point of the present invention is shaping part of the antenna (for example at least a part of the arms of a dipole, at least a part of the arm of a monopole, the perimeter of the patch of a patch antenna, the slot in a slot antenna, the loop perimeter in a loop antenna, the horn cross-section in a horn antenna, or the reflector perimeter in a reflector antenna) as a space-filling curve, that is, a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, It is usually understood that a curve is always a one-dimension object; however when the curve is highly convoluted and its physical length is very large, the curve tends to fill parts of the surface which supports it; in that case the Haussdorf dimension can be computed over the curve (or at least an approximation of it by means of the box-counting algorithm) resulting in a number larger than unity. Such theoretical infinite curves can not be physically constructed, but they can be approached with SFC designs. The curves 8 and 17 described in and FIG. 2 and FIG. 5 are some examples of such SFC, that approach an ideal infinite curve featuring a dimension D=2.

The advantage of using SFC curves in the physical shaping of the antenna is two-fold: (a) Given a particular operating frequency or wavelength said SFC antenna can be reduced in size with respect to prior art. (b) Given the physical size of the SFC antenna, said SFC antenna can be operated at a lower frequency (a longer wavelength) than prior art.

BRIEF DESCRIPTION OF THE DRAWINGS

For a more complete understanding, reference is now made to the following description taken in conjunction with the accompanying Drawings in which.

DETAILED DESCRIPTION

Figure 1:
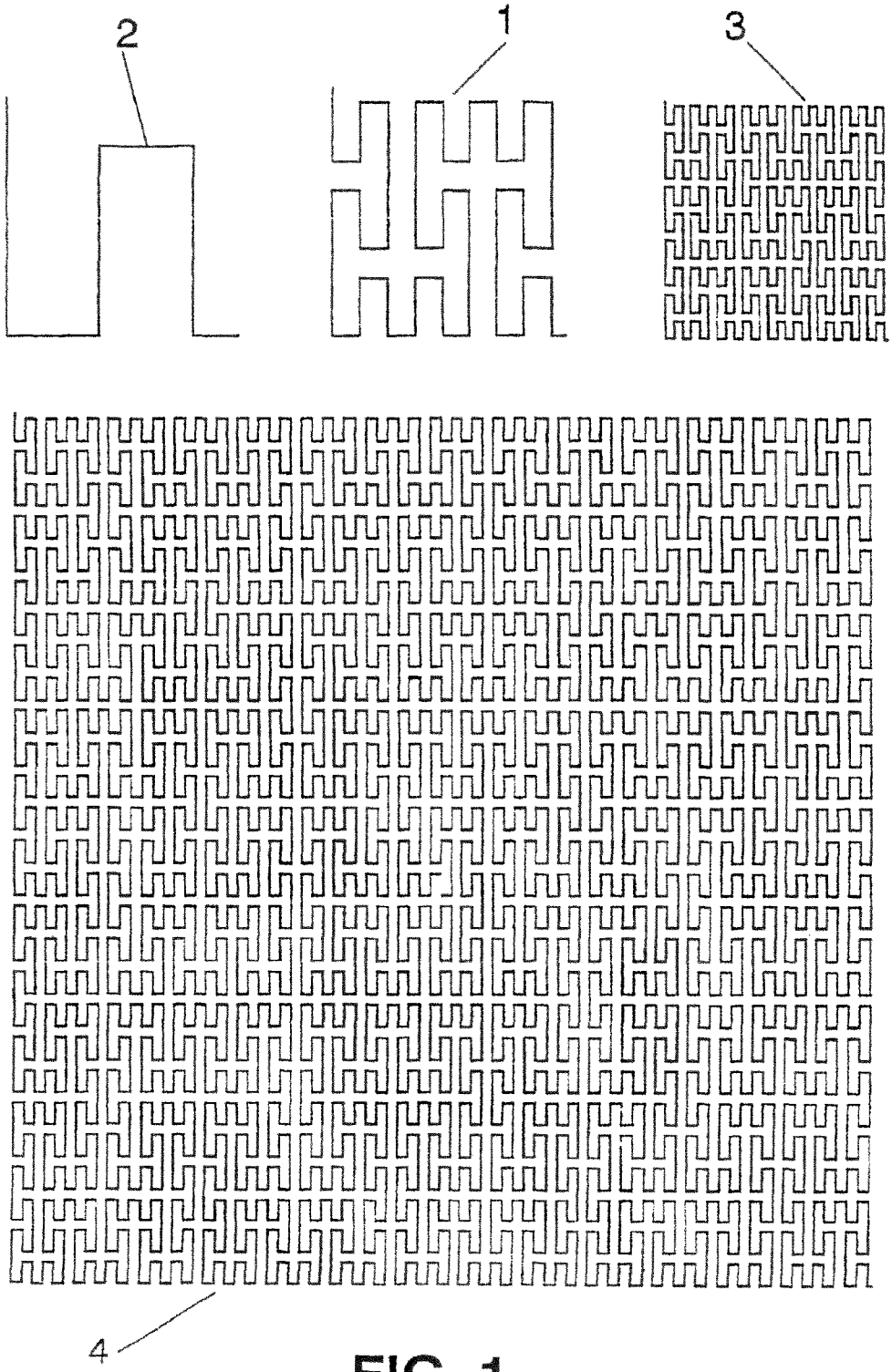
FIG. 1 shows some particular cases of SFC curves. From an initial curve (2), other curves (1), (3) and (4) with more than 10 connected segments are formed. This particular family of curves are named hereafter SZ curves.
Figure 2:
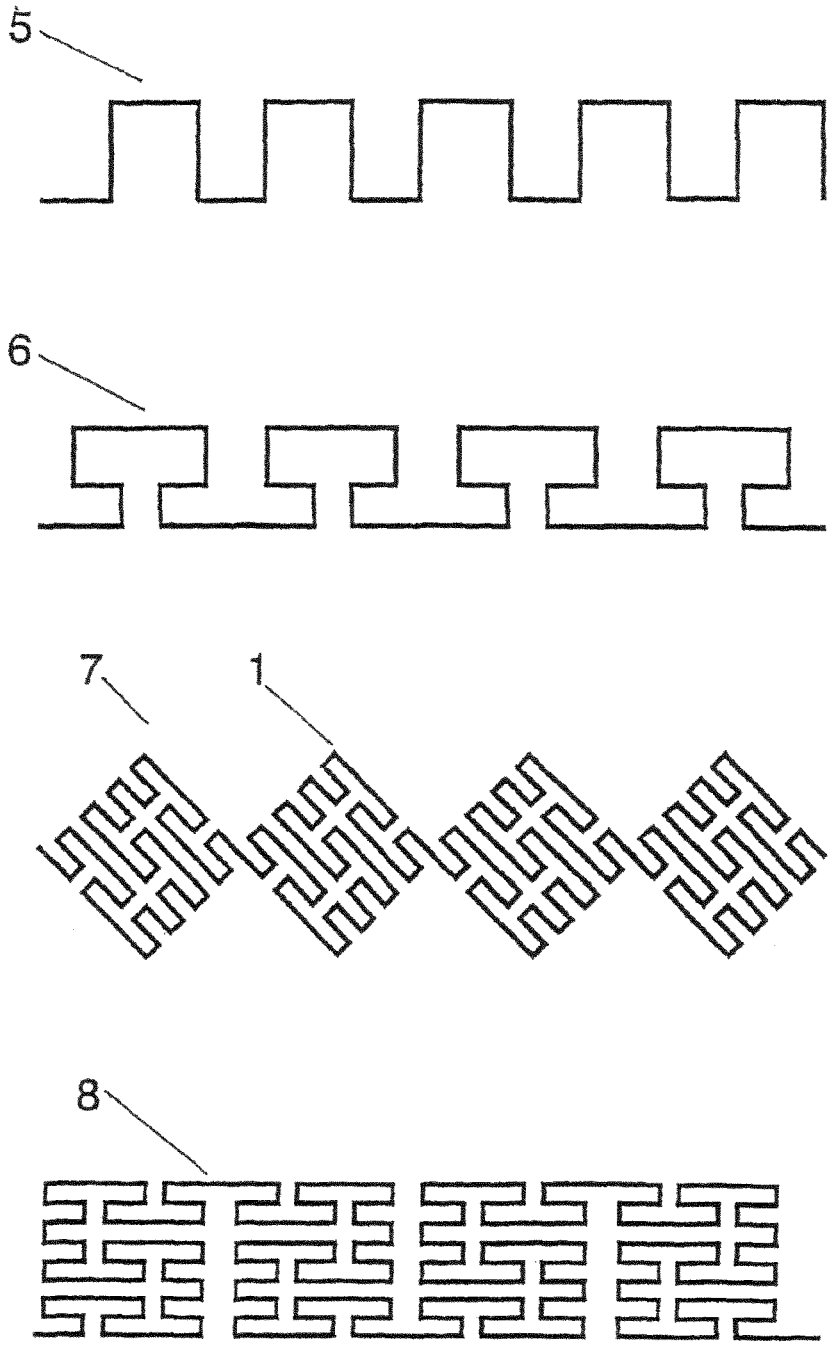
FIG. 2 shows a comparison between two prior art meandering lines and two SFC periodic curves, constructed from the SZ curve of drawing 1.

FIG. 1 and FIG. 2 show some examples of SFC curves. Drawings (1), (3) and (4) in FIG. 1 show three examples of SFC curves named SZ curves. A curve that is not an SFC since it is only composed of 6 segments is shown in drawing (2) for comparison. The drawings (7) and (8) in FIG. 2 show another two particular examples of SFC curves, formed from the periodic repetition of a motive including the SFC curve (1). It is important noticing the substantial difference between these examples of SFC curves and some examples of periodic, meandering and not SFC curves such as those in drawings (5) and (6) in FIG. 2. Although curves (5) and (6) are composed by more than 10 segments, they can be substantially considered periodic along a straight direction (horizontal direction) and the motive that defines a period or repetition cell is constructed with less than 10 segments (the period in drawing (5) includes only four segments, while the period of the curve (6) comprises nine segments) which contradicts the definition of SFC curve introduced in the present invention. SFC curves are substantially more complex and pack a longer length in a smaller space; this fact in conjunction with the fact that each segment composing and SFC curve is electrically short (shorter than a tenth of the free-space operating wavelength as claimed in this invention) play a key role in reducing the antenna size. Also, the class of folding mechanisms used to obtain the particular SFC curves described in the present invention are important in the design of miniature antennas.

Figure 3:
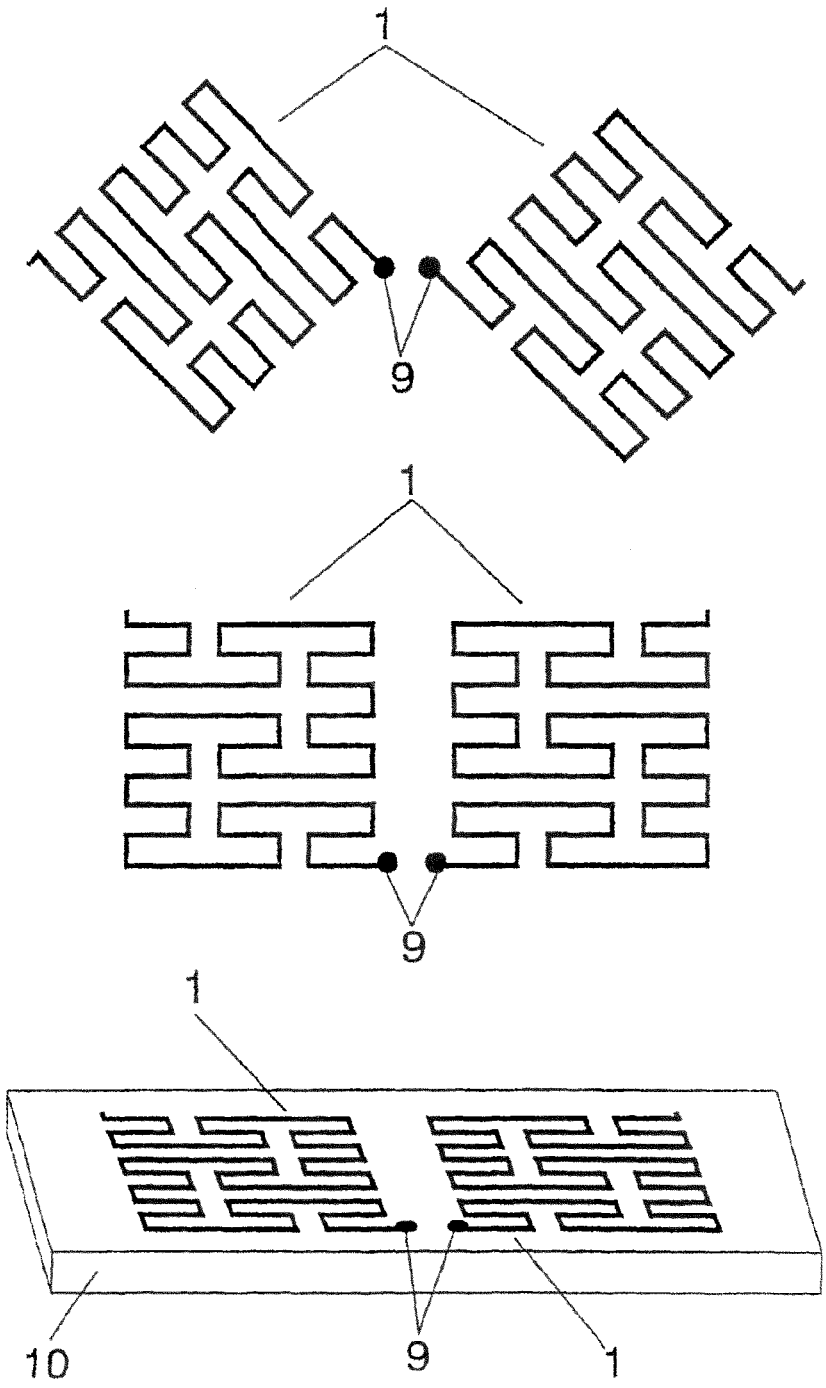
FIG. 3 shows a particular configuration of an SFC antenna. It consists on tree different configurations of a dipole wherein each of the two arms is fully shaped as an SFC curve (1)

FIG. 3 describes a preferred embodiment of an SFC antenna. The three drawings display different configurations of the same basic dipole. A two-arm antenna dipole is constructed comprising two conducting or superconducting parts, each part shaped as an SFC curve. For the sake of clarity but without loss of generality, a particular case of SFC curve (the SZ curve (1) of FIG. 1) has been chosen here; other SFC curves as for instance, those described in FIG. 1, 2, 6, 8, 14, 19, 20, 21, 22, 23, 24 or 25 could be used instead. The two closest tips of the two arms form the input terminals (9) of the dipole. The terminals (9) have been drawn as conducting or superconducting circles, but as it is clear to those skilled in the art, such terminals could be shaped following any other pattern as long as they are kept small in terms of the operating wavelength. Also, the arms of the dipoles can be rotated and folded in different ways to finely modify the input impedance or the radiation properties of the antenna such as, for instance, polarization. Another preferred embodiment of an SFC dipole is also shown in FIG. 3, where the conducting or superconducting SFC arms are printed over a dielectric substrate (10); this method is particularly convenient in terms of cost and mechanical robustness when the SFC curve is long. Any of the well-known printed circuit fabrication techniques can be applied to pattern the SFC curve over the dielectric substrate. Said dielectric substrate can be for instance a glass-fibre board, a teflon based substrate (such as Cuclad®) or other standard radiofrequency and microwave substrates (as for instance Rogers 4003® or Kapton®). The dielectric substrate can even be a portion of a window glass if the antenna is to be mounted in a motor vehicle such as a car, a train or an air-plane, to transmit or receive radio, TV, cellular telephone (GSM 900, GSM 1800, UMTS) or other communication services electromagnetic waves. Of course, a balun network can be connected or integrated at the input terminals of the dipole to balance the current distribution among the two dipole arms.

Figure 4:
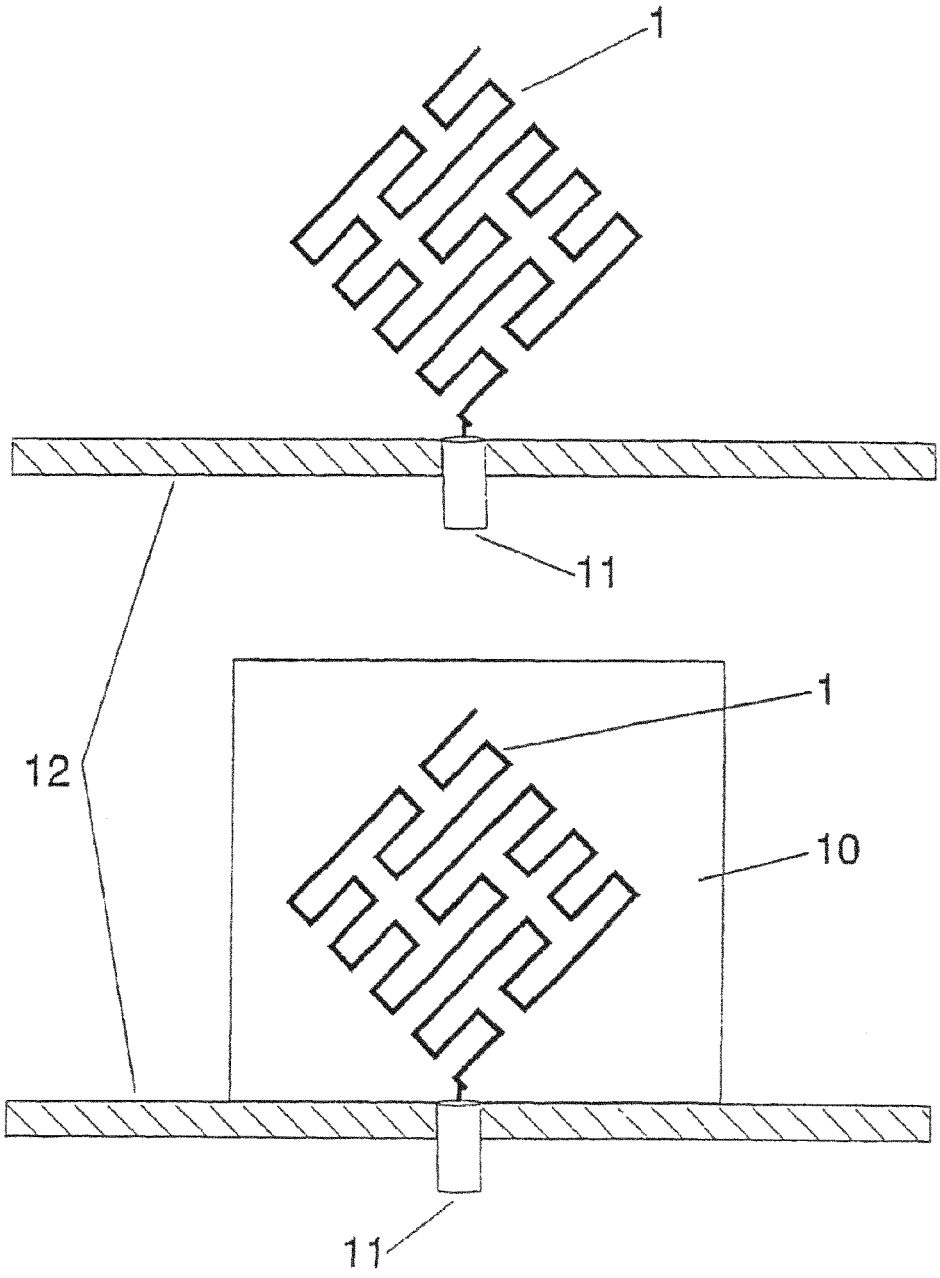
FIG. 4 shows other particular cases of SFC antennas. They consist on monopole antennas.

Another preferred embodiment of an SFC antenna is a monopole configuration as shown in FIG. 4. In this case one of the dipole arms is substituted by a conducting or superconducting counterpoise or ground plane (12). A handheld telephone case, or even a part of the metallic structure of a car, train or can act as such a ground counterpoise. The ground and the monopole arm (here the arm is represented with SFC curve (1), but any other SFC curve could be taken instead) are excited as usual in prior art monopoles by means of, for instance, a transmission line (11). Said transmission line is formed by two conductors, one of the conductors is connected to the ground counterpoise while the other is connected to a point of the SFC conducting or superconducting structure. In the drawings of FIG. 4, a coaxial cable (11) has been taken as a particular case of transmission line, but it is clear to any skilled in the art that other transmission lines (such as for instance a microstrip arm) could be used to excite the monopole. Optionally, and following the scheme described in FIG. 3, the SFC curve can be printed over a dielectric substrate (10).

Figure 5:
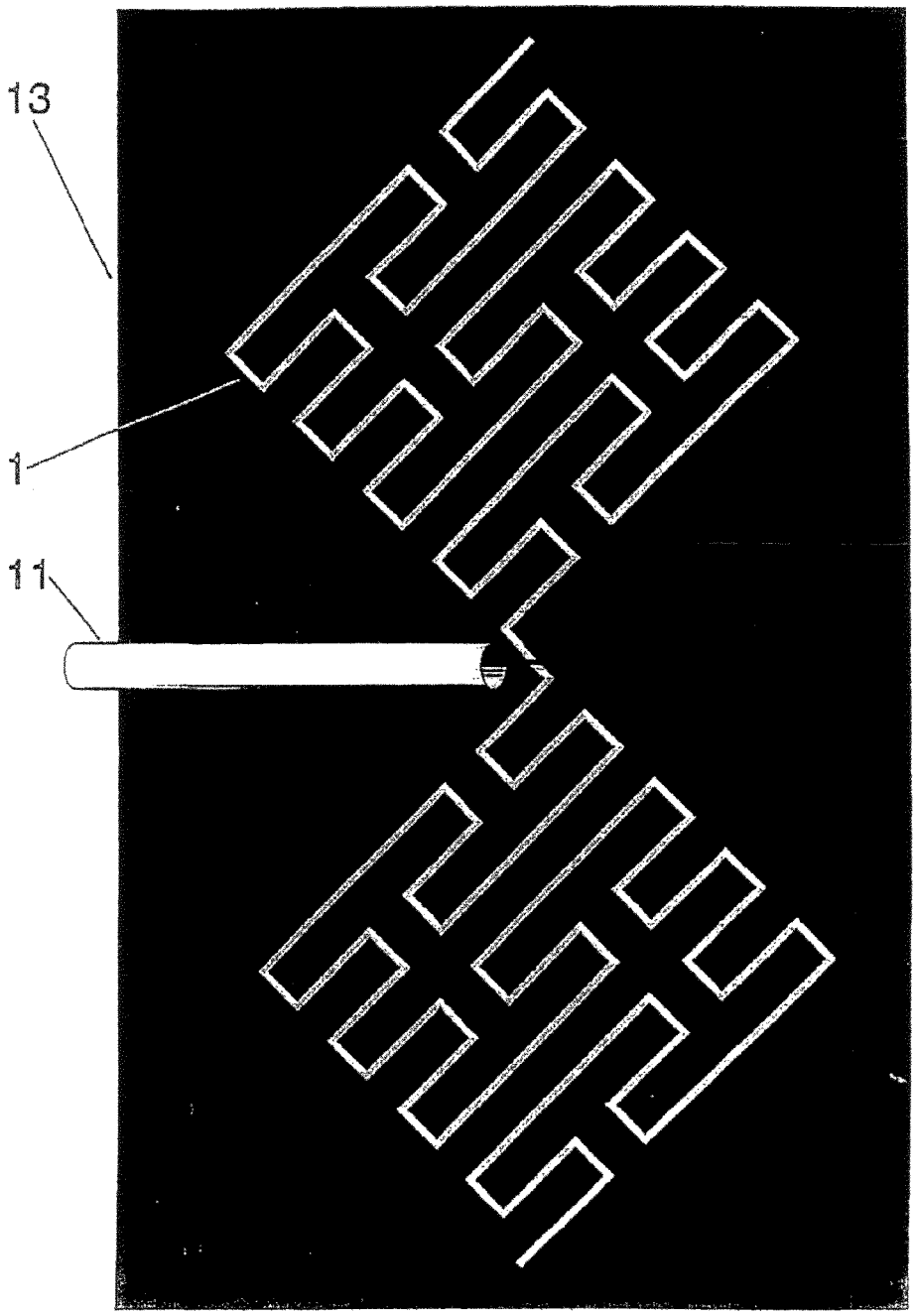
FIG. 5 shows an example of an SFC slot antenna where the slot is shaped as the SFC in drawing 1.
Figure 6:
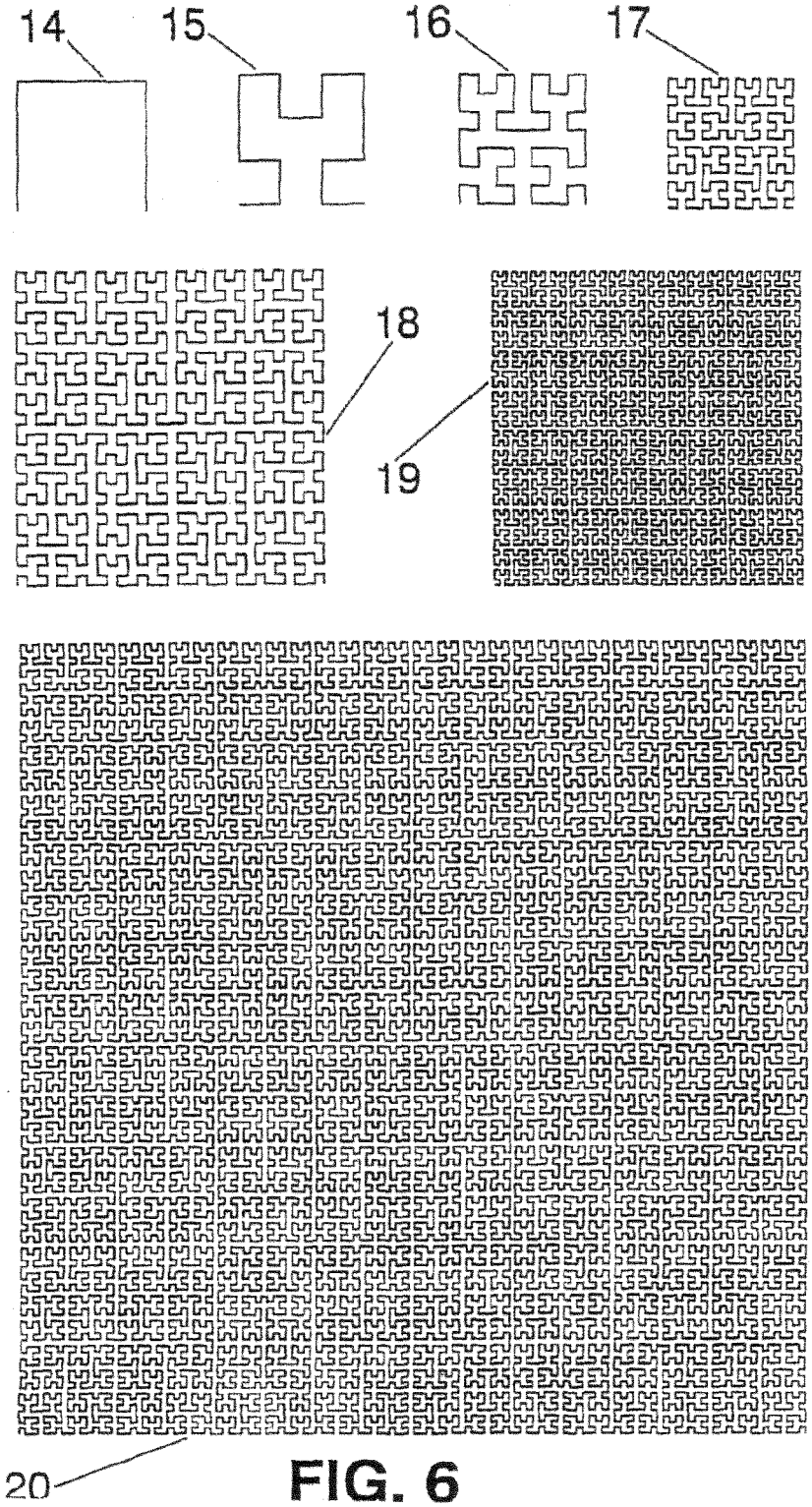
FIG. 6 shows another set of SFC curves (15-20) inspired on the Hilbert curve and hereafter named as Hilbert curves. A standard, non-SFC curve is shown in (14) for comparison.
Figure 7:
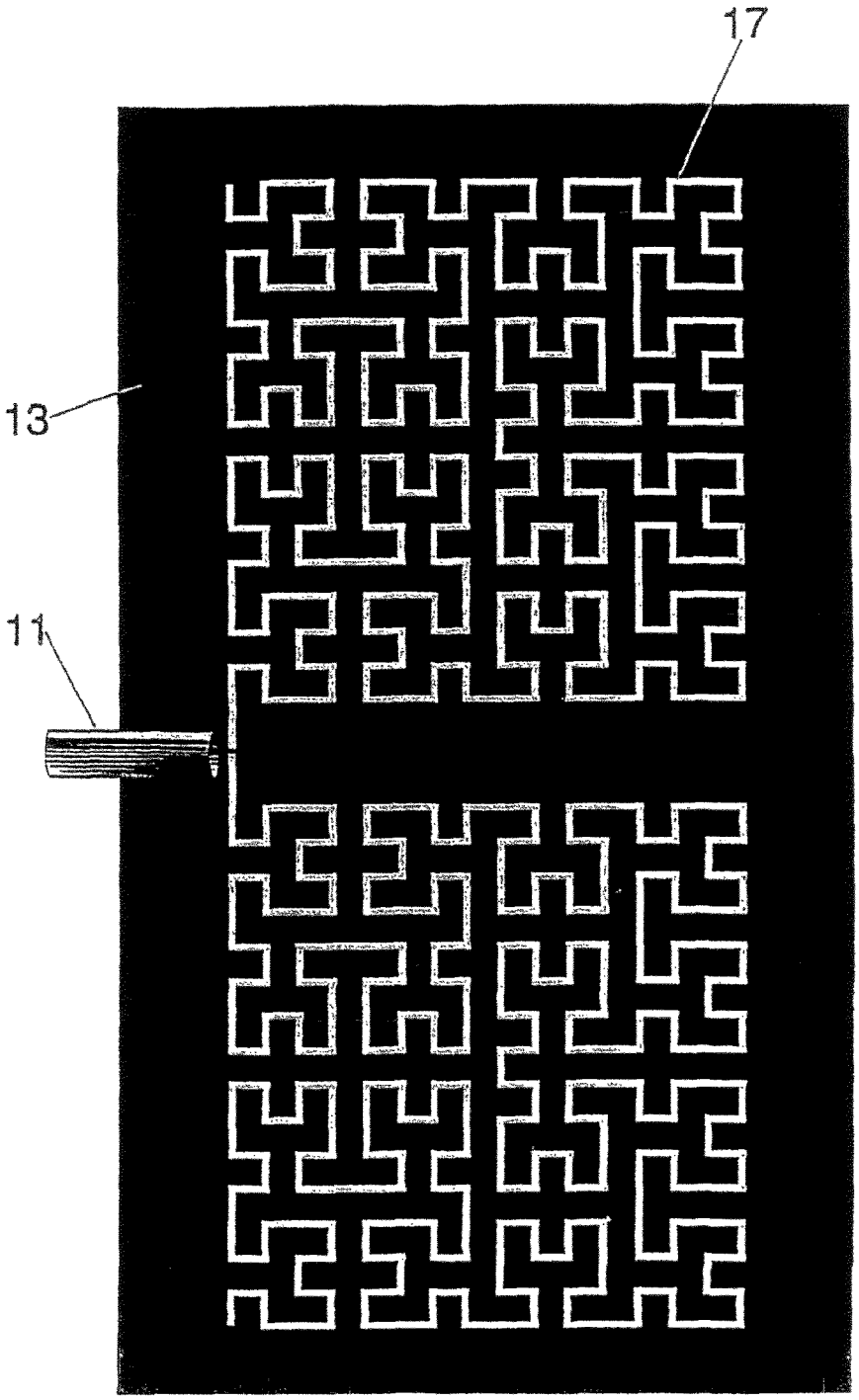
FIG. 7 shows another example of an SFC slot antenna based on the SFC curve (17) in drawing 6.
Figure 8:
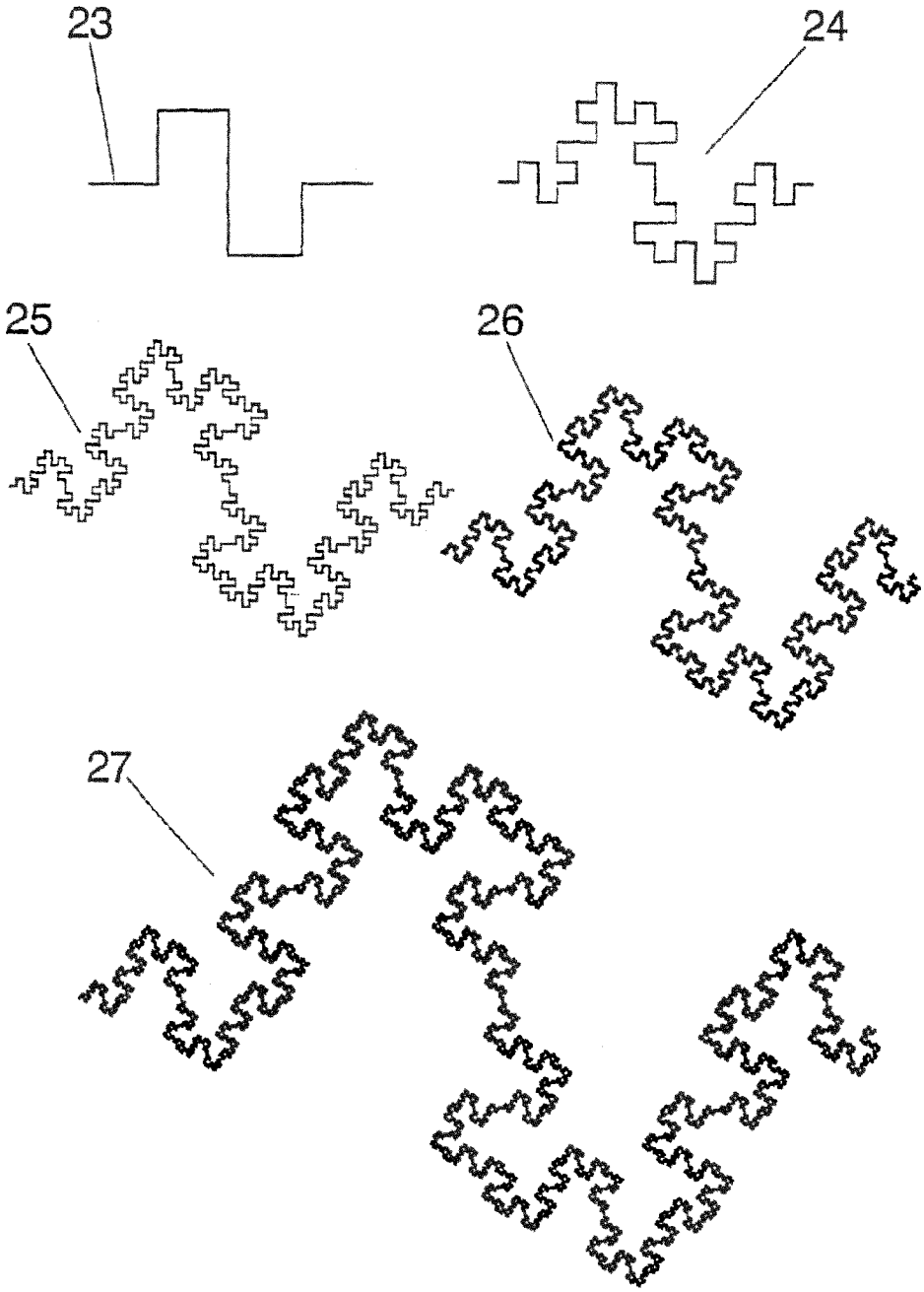
FIG. 8 shows another set of SFC curves (24, 25, 26, 27) hereafter known as ZZ curves. A conventional squared zigzag curve (23) is shown for comparison.
Figure 10:
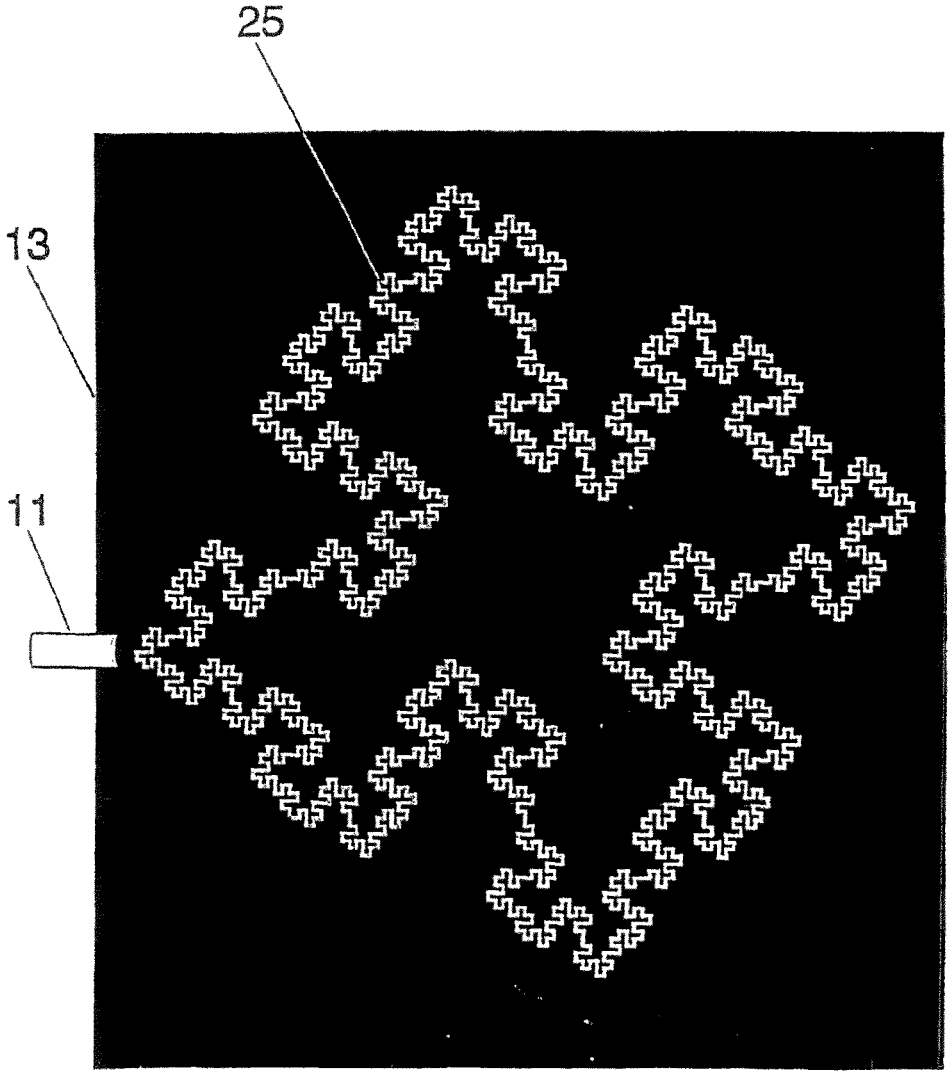
FIG. 10 shows a slot loop antenna based on the SFC (25) in drawing 8.

Another preferred embodiment of an SFC antenna is a slot antenna as shown, for instance in FIGS. 5, 7 and 10. In FIG. 5, two connected SFC curves (following the pattern (1) of FIG. 1) form an slot or gap impressed over a conducting or superconducting sheet (13). Such sheet can be, for instance, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or airplane. The exciting scheme can be any of the well known in conventional slot antennas and it does not become an essential part of the present invention. In all said three figures, a coaxial cable (11) has been used to excite the antenna, with one of the conductors connected to one side of the conducting sheet and the other one connected at the other side of the sheet across the slot. A microstrip transmission line could be used, for instance, instead of the coaxial cable.

To illustrate that several modifications of the antenna that can be done based on the same principle and spirit of the present invention, a similar example is shown in FIG. 7, where another curve (the curve (17) from the Hilbert family) is taken instead. Notice that neither in FIG. 5, nor in FIG. 7 the slot reaches the borders of the conducting sheet, but in another embodiment the slot can be also designed to reach the boundary of said sheet, breaking said sheet in two separate conducting sheets.

FIG. 10 describes another possible embodiment of a slot SFC antenna. It is also a slot antenna in a closed loop configuration. The loop is constructed for instance by connecting four SFC gaps following the pattern of SFC (25) in FIG. 8 (it is clear that other SFC curves could be used instead according to the spirit and scope of the present invention). The resulting closed loop determines the boundary of a conducting or superconducting island surrounded by a conducting or superconducting sheet. The slot can be excited by means of any of the well-known conventional techniques; for instance a coaxial cable (11) can be used, connecting one of the outside conductor to the conducting outer sheet and the inner conductor to the inside conducting island surrounded by the SFC gap. Again, such sheet can be, for example, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or air-plane. The slot can be even formed by the gap between two close but not co-planar conducting island and conducting sheet; this can be physically implemented for instance by mounting the inner conducting island over a surface of the optional dielectric substrate, and the surrounding conductor over the opposite surface of said substrate.

Figure 9:
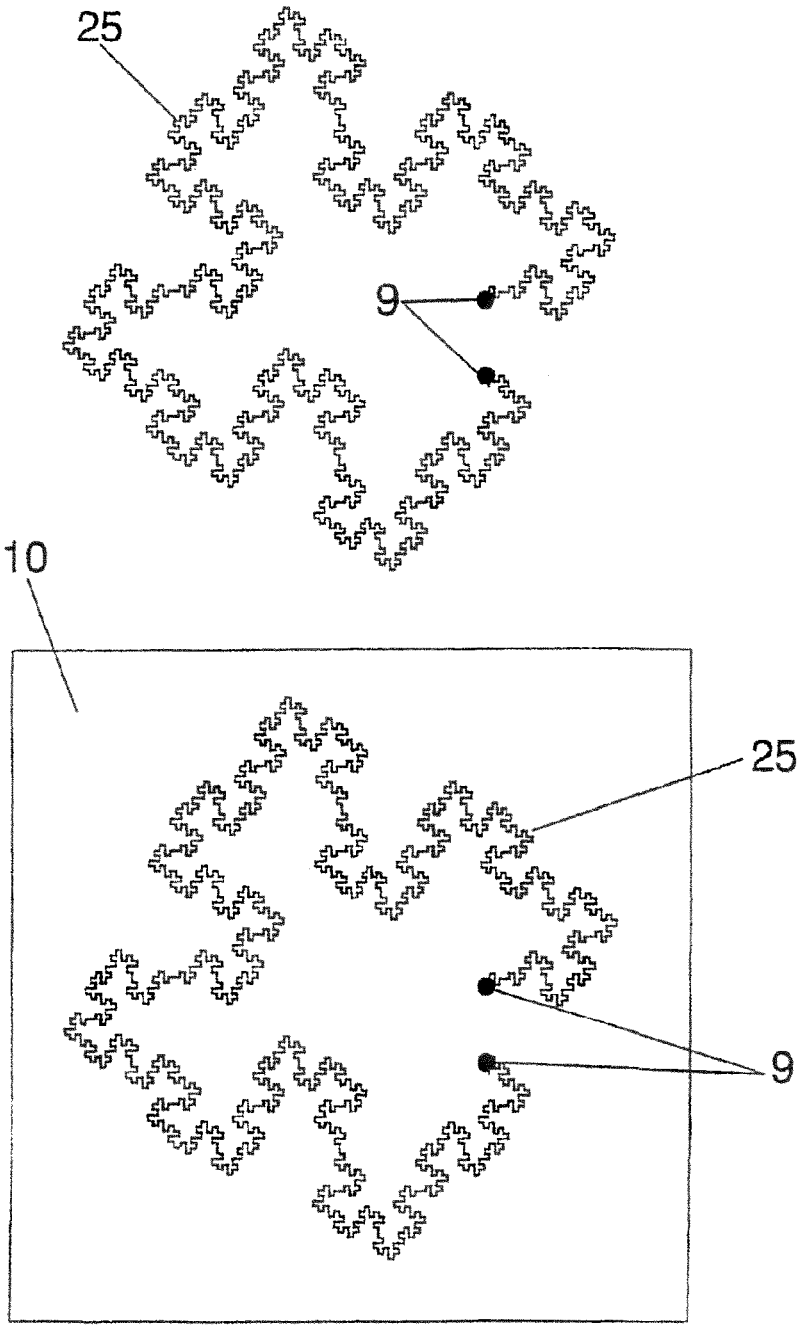
FIG. 9 shows a loop antenna based on curve (25) in a wire configuration (top). Below, the loop antenna 29 is printed over a dielectric substrate (10)

The slot configuration is not, of course, the only way of implementing an SFC loop antenna. A closed SFC curve made of a superconducting or conducting material can be used to implement a wire SFC loop antenna as shown in another preferred embodiment as that of FIG. 9. In this case, a portion of the curve is broken such as the two resulting ends of the curve form the input terminals (9) of the loop. Optionally, the loop can be printed also over a dielectric substrate (10). In case a dielectric substrate is used, a dielectric antenna can be also constructed by etching a dielectric SFC pattern over said substrate, being the dielectric permitivity of said dielectric pattern higher than that of said substrate.

Figure 11:
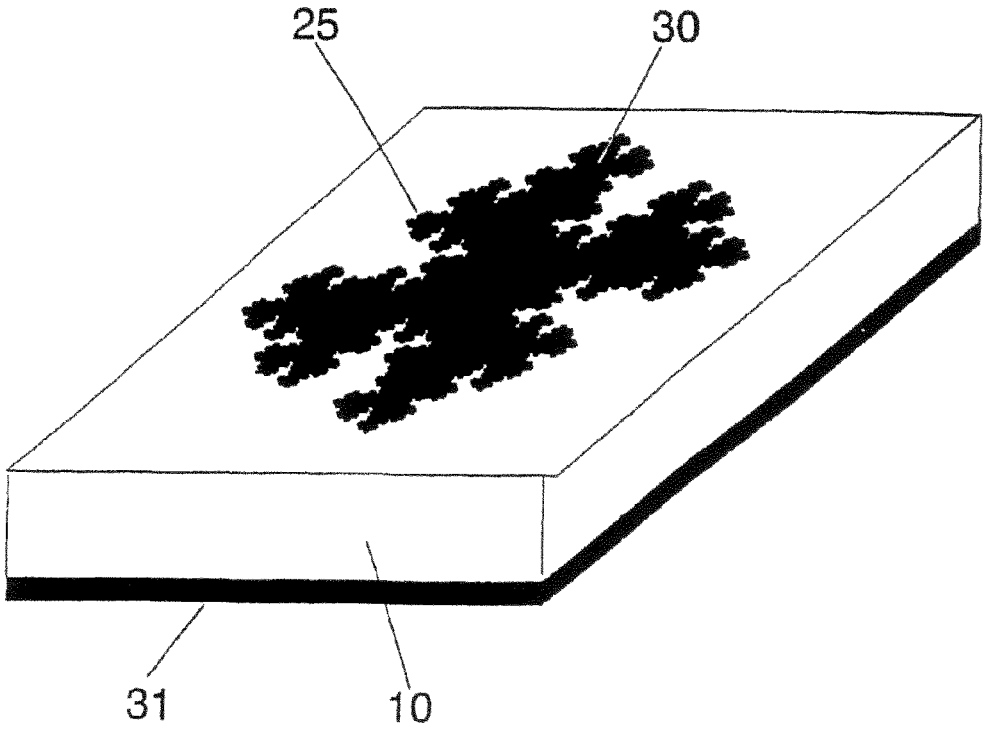
FIG. 11 shows a patch antenna wherein the patch perimeter is shaped according to SFC (25)

Another preferred embodiment is described in FIG. 11. It consists on a patch antenna, with the conducting or superconducting patch (30) featuring an SFC perimeter (the particular case of SFC (25) has been used here but it is clear that other SFC curves could be used instead). The perimeter of the patch is the essential part of the invention here, being the rest of the antenna conformed, for example, as other conventional patch antennas: the patch antenna comprises a conducting or superconducting ground-plane (31) or ground counterpoise, an the conducting or superconducting patch which is parallel to said ground-plane or ground-counterpoise. The spacing between the patch and the ground is typically below (but not restricted to) a quarter wavelength. Optionally, a low-loss dielectric substrate (10) (such as glass-fibre, a teflon substrate such as Cuclad® or other commercial materials such as Rogers® 4003) can be place between said patch and ground counterpoise. The antenna feeding scheme can be taken to be any of the well-known schemes used in prior art patch antennas, for instance: a coaxial cable with the outer conductor connected to the ground-plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on can be used as well); a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the strip co-planar to the patch. All these mechanisms are well known from prior art and do not constitute an essential part of the present invention. The essential part of the present invention is the shape of the antenna (in this case the SFC perimeter of the patch) which contributes to reducing the antenna size with respect to prior art configurations.

Figure 13:
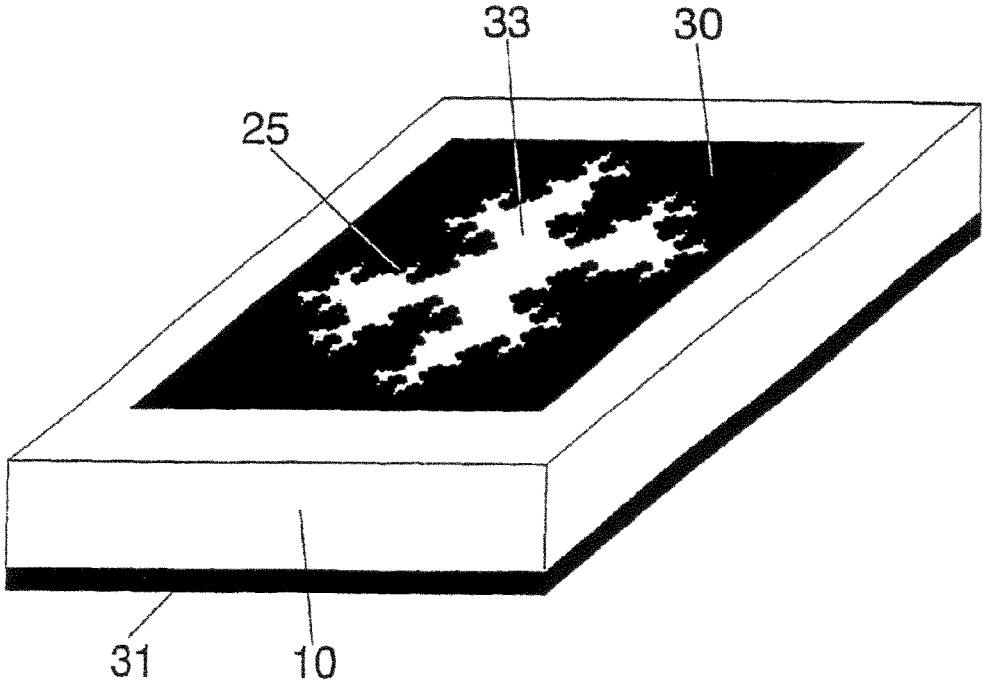
FIG. 13 shows a patch antenna with an aperture on the patch based on SFC (25)
Figure 14:
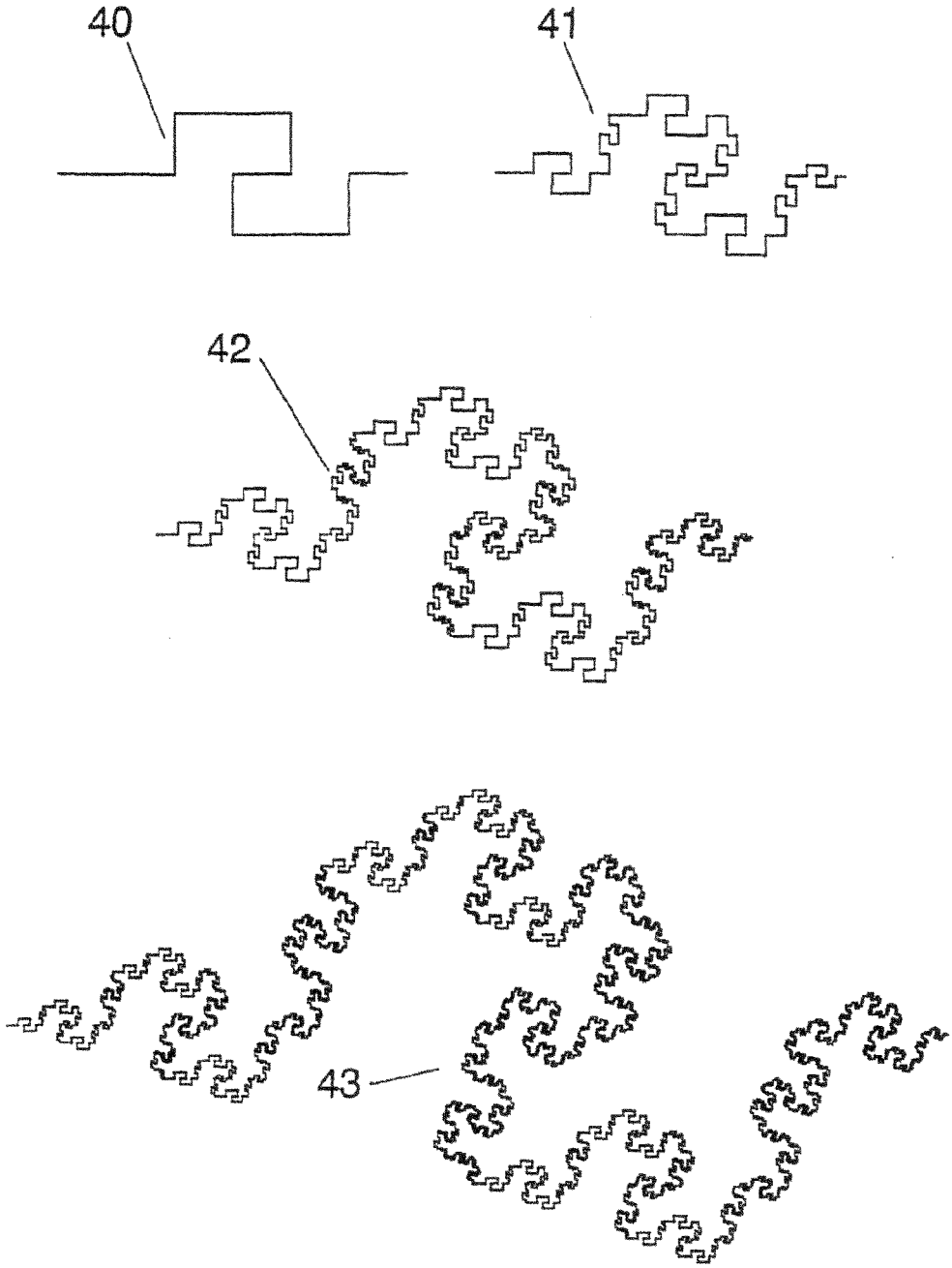
FIG. 14 shows another particular example of a family of SFC curves (41, 42, 43) based on the Giusepe Peano curve. A non-SFC curve formed with only 9 segments is shown for comparison.
Figure 15:
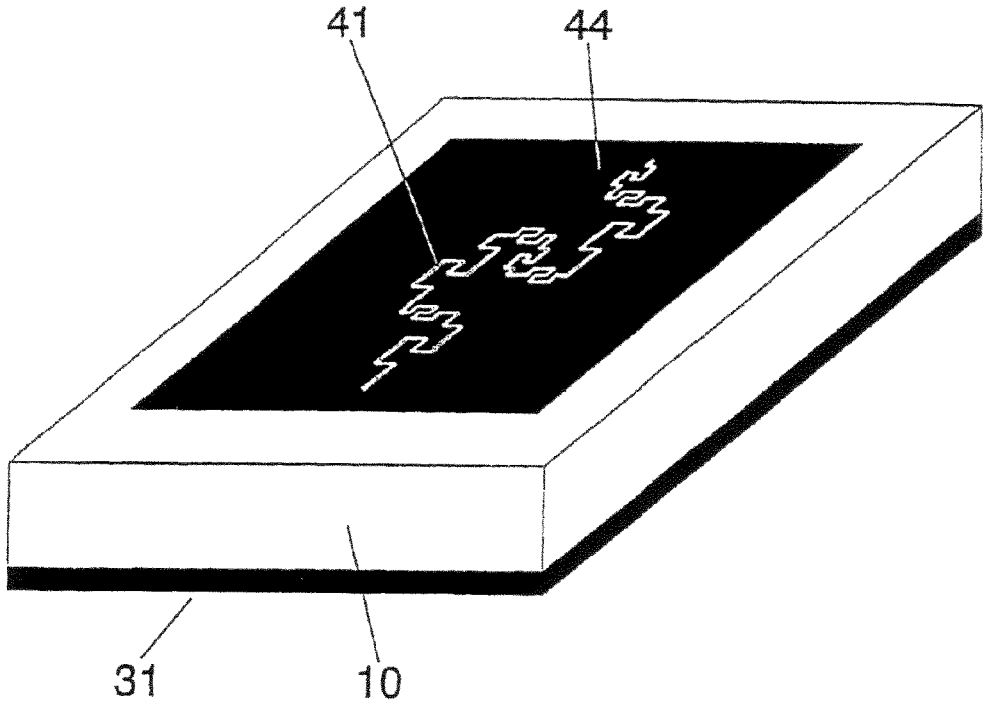
FIG. 15 shows a patch antenna with an SFC slot based on SFC (41)

Other preferred embodiments of SFC antennas based also on the patch configuration are disclosed in FIG. 13 and FIG. 15. They consist on a conventional patch antenna with a polygonal patch (30) (squared, triangular, pentagonal, hexagonal, rectangular, or even circular, to name just a few examples), with an SFC curve shaping a gap on the patch. Such an SFC line can form an slot or spur-line (44) over the patch (as seen in FIG. 15) contributing this way in reducing the antenna size and introducing new resonant frequencies for a multiband operation, or in another preferred embodiment the SFC curve (such as (25) defines the perimeter of an aperture (33) on the patch (30) (FIG. 13). Such an aperture contributes significantly to reduce the first resonant frequency of the patch with respect to the solid patch case, which significantly contributes to reducing the antenna size. Said two configurations, the SFC slot and the SFC aperture cases can of course be use also with SFC perimeter patch antennas as for instance the one (30) described in FIG. 11.

At this point it becomes clear to those skilled in the art what is the scope and spirit of the present invention and that the same SFC geometric principle can be applied in an innovative way to all the well known, prior art configurations. More examples are given in FIGS. 12, 16, 17 and 18.

Figure 12:
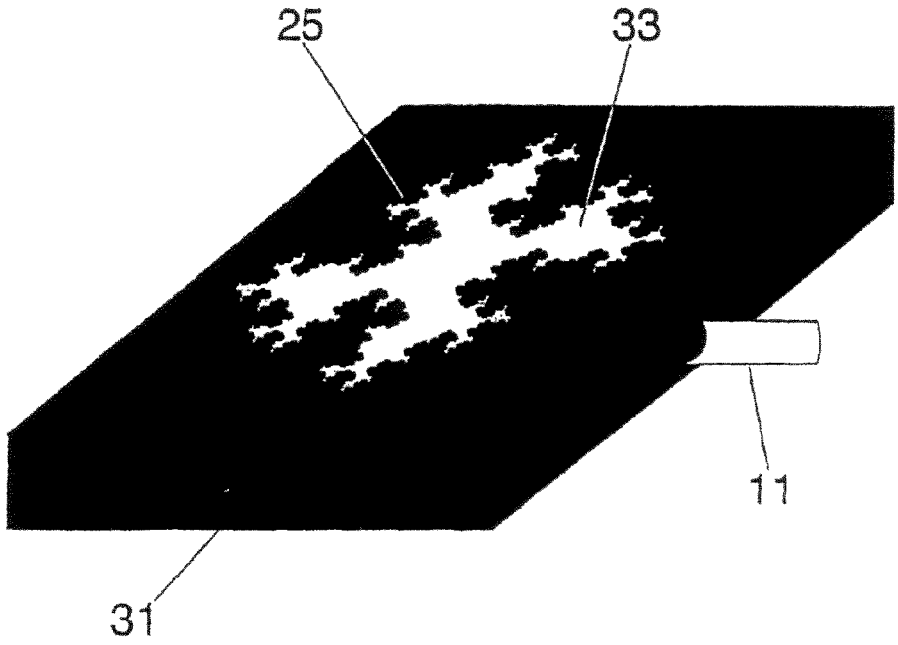
FIG. 12 shows an aperture antenna wherein the aperture (33) is practiced on a conducting or superconducting structure (31), said aperture being shaped with SFC (25)

FIG. 12 describes another preferred embodiment of an SFC antenna. It consists on an aperture antenna, said aperture being characterized by its SFC perimeter, said aperture being impressed over a conducting ground-plane or ground-counterpoise (34), said ground-plane of ground-counterpoise consisting, for example, on a wall of a waveguide or cavity resonator or a part of the structure of a motor vehicle (such as a car, a lorry, an airplane or a tank). The aperture can be fed by any of the conventional techniques such as a coaxial cable (11), or a planar microstrip or strip-line transmission line, to name a few.

Figure 16:
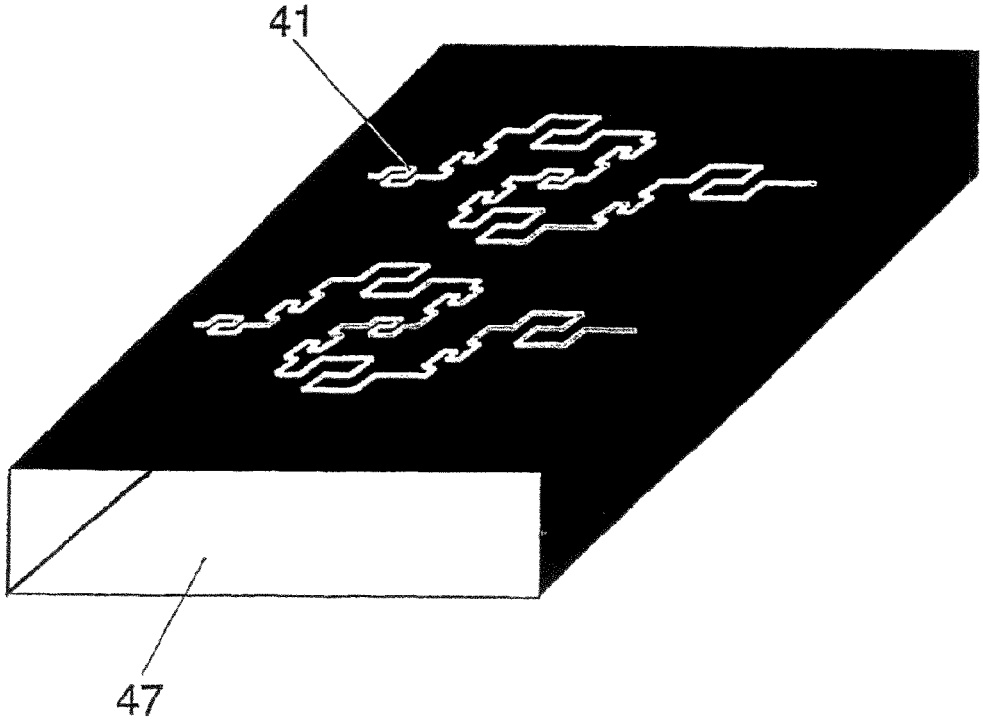
FIG. 16 shows a wave-guide slot antenna wherein a rectangular waveguide (47) has one of its walls slotted with SFC curve (41)

FIG. 16 shows another preferred embodiment where the SFC curves (41) are slotted over a wall of a waveguide (47) of arbitrary cross-section. This way and slotted waveguide array can be formed, with the advantage of the size compressing properties of the SFC curves.

Figure 17:
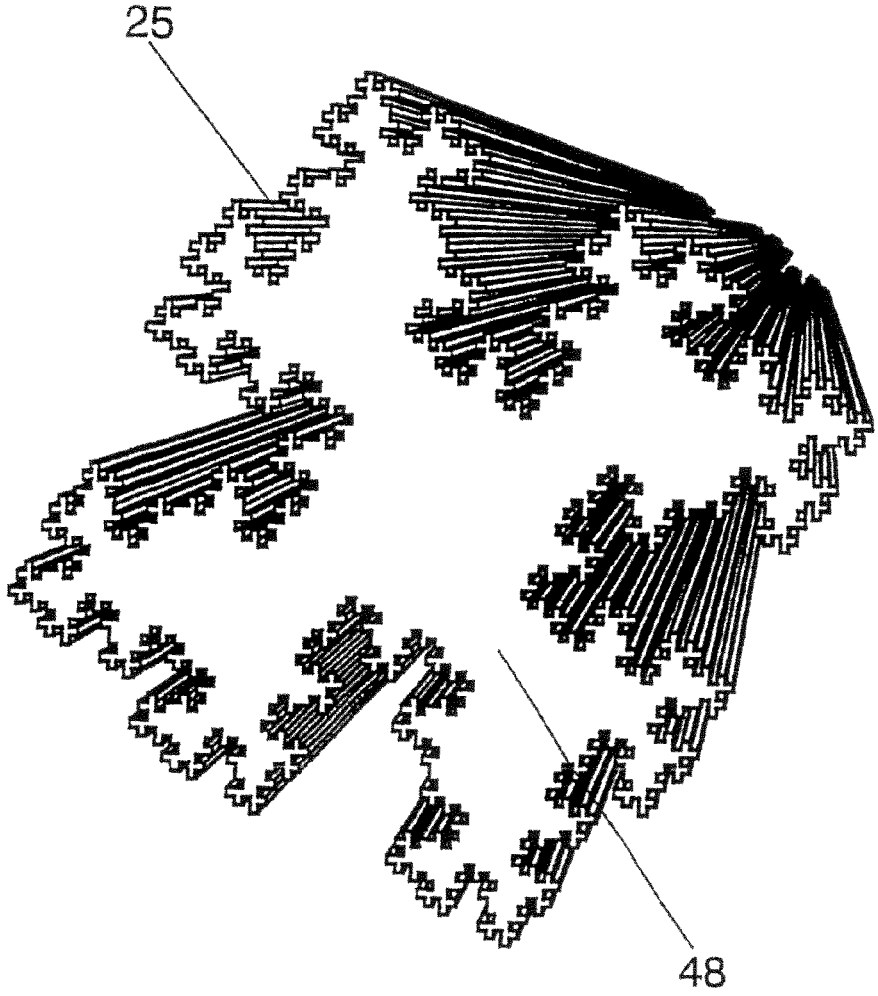
FIG. 17 shows a horn antenna, wherein the aperture and cross-section of the horn is shaped after SFC (25)

FIG. 17 depicts another preferred embodiment, in this case a horn antenna (48) where the cross-section of the antenna is an SFC curve (25). In this case, the benefit comes not only from the size reduction property of SFC Geometries, but also from the broadband behavior that can be achieved by shaping the horn cross-section. Primitive versions of these techniques have been already developed in the form of Ridge horn antennas. In said prior art cases, a single squared tooth introduced in at least two opposite walls of the horn is used to increase the bandwidth of the antenna. The richer scale structure of an SFC curve further contributes to a bandwidth enhancement with respect to prior art.

Figure 18:
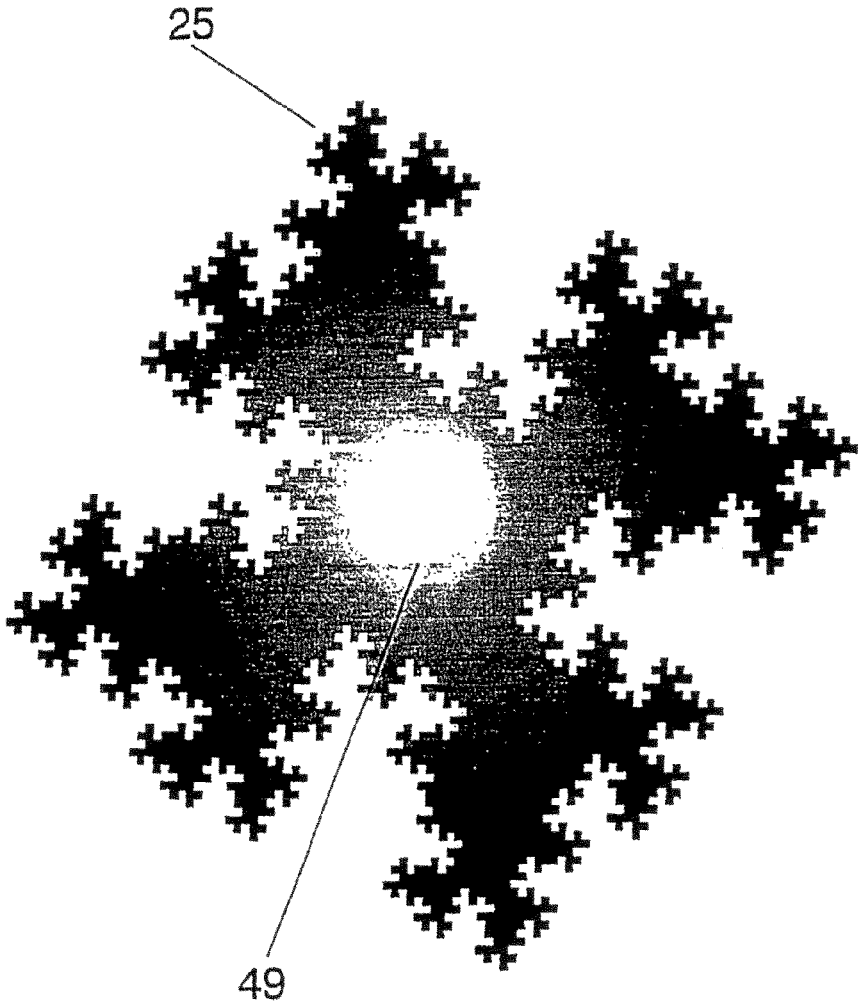
FIG. 18 shows a reflector of a reflector antenna wherein the perimeter of said reflector is shaped as SFC (25)
Figure 19:
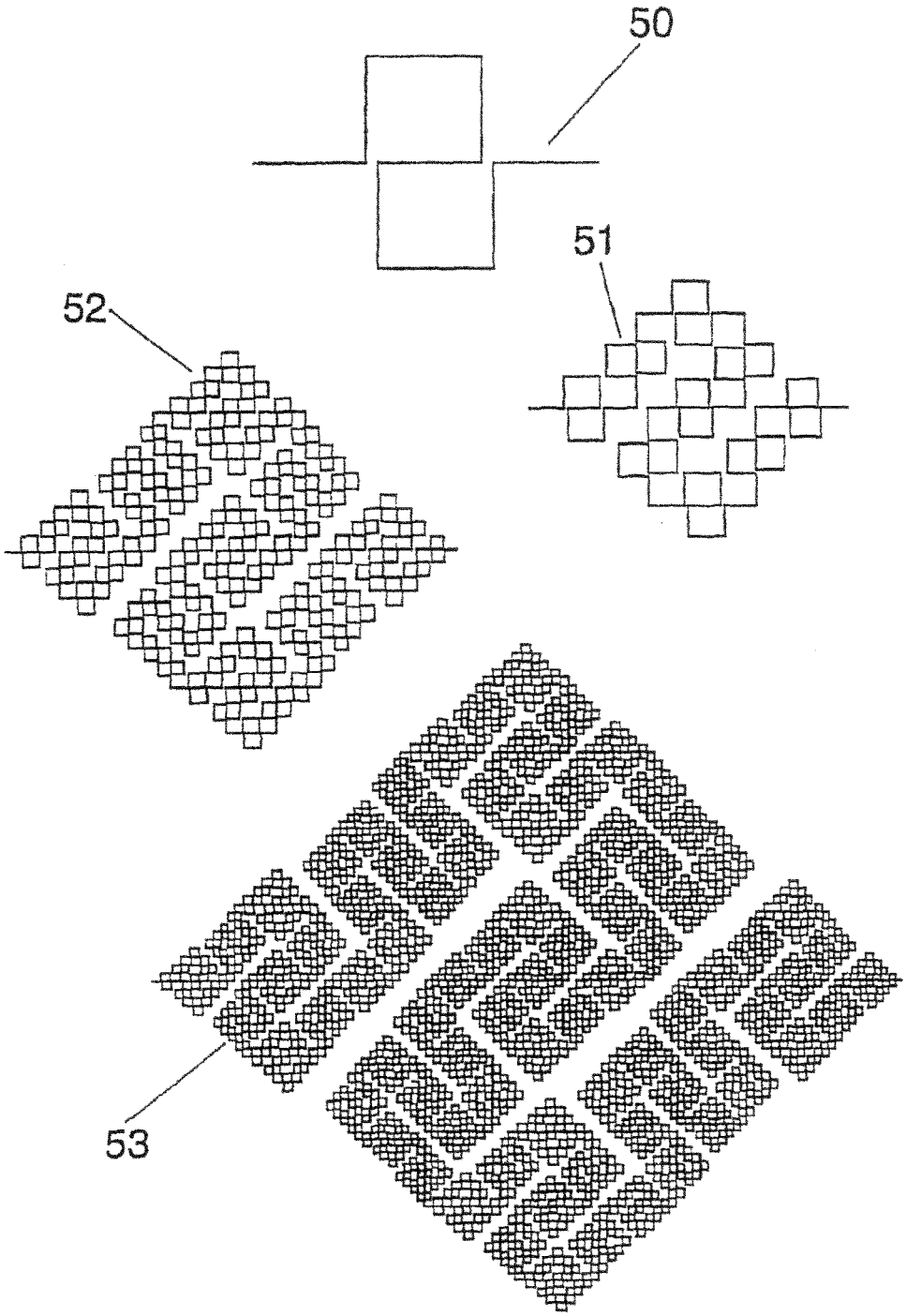
FIG. 19 shows a family of SFC curves (51, 52, 53) based on the Giusepe Peano curve. A non-SFC curve formed with only nine segments is shown for comparison (50)
Figure 20:
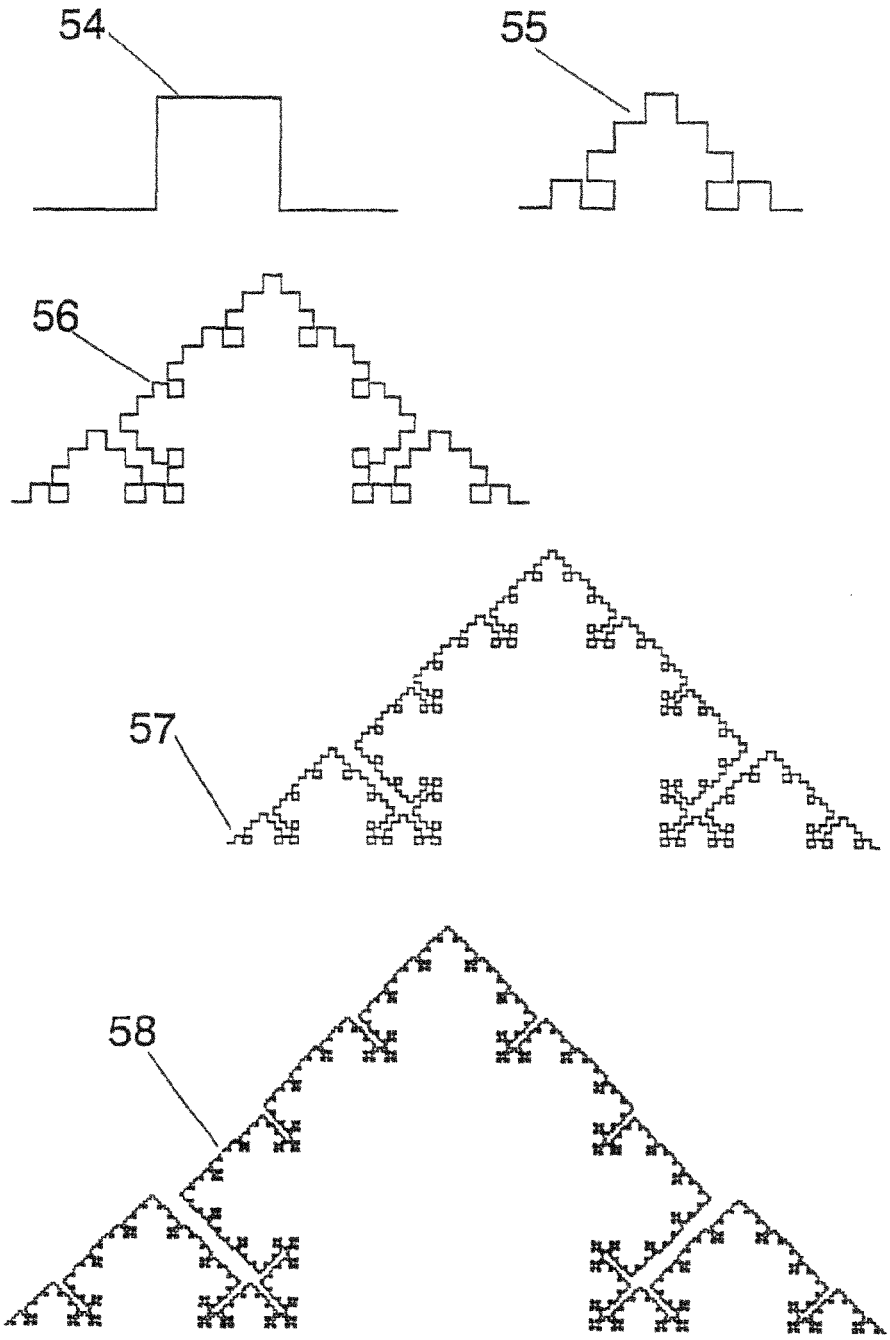
FIG. 20 shows another family of SFC curves (55, 56, 57, 58). A non-SFC curve (54) constructed with only five segments is shown for comparison.
Figure 21:
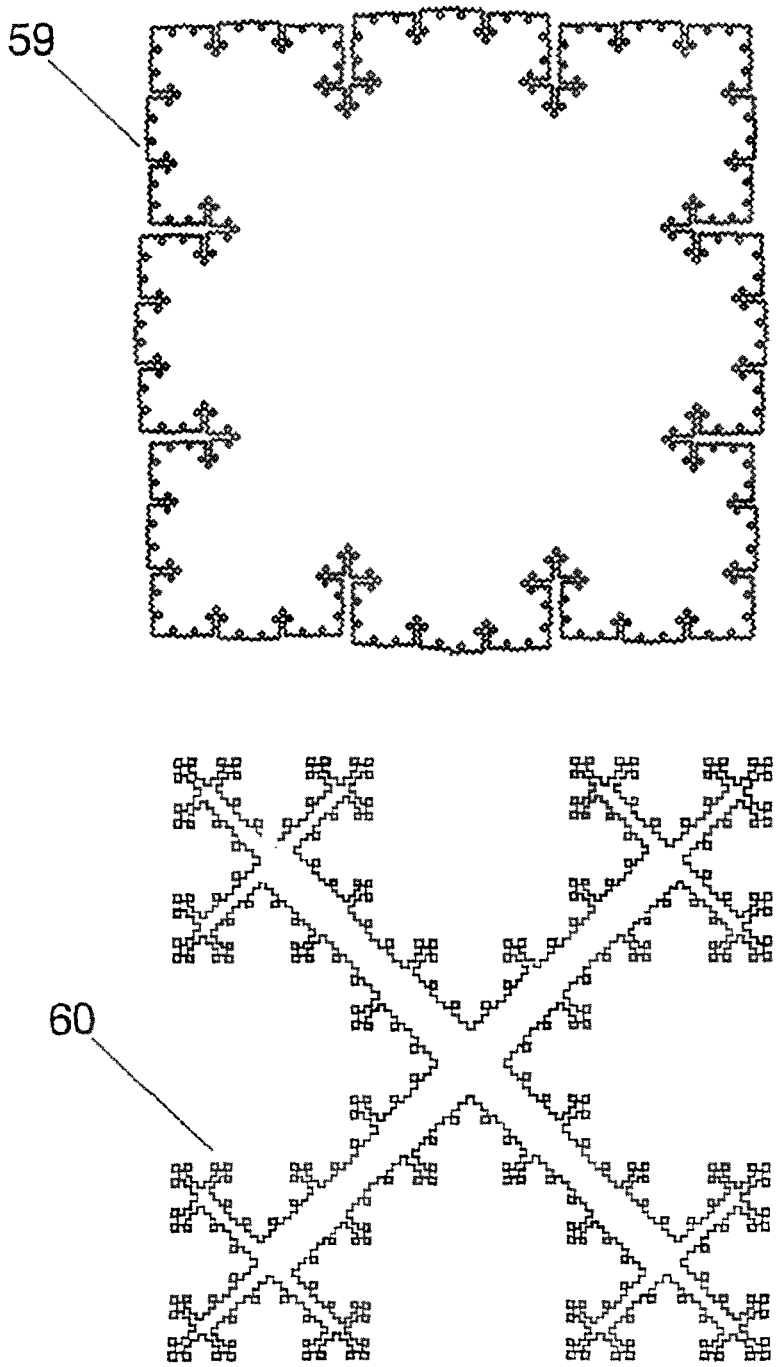
FIG. 21 shows two examples of SFC loops (59, 60) constructed with SFC (57)
Figure 22:
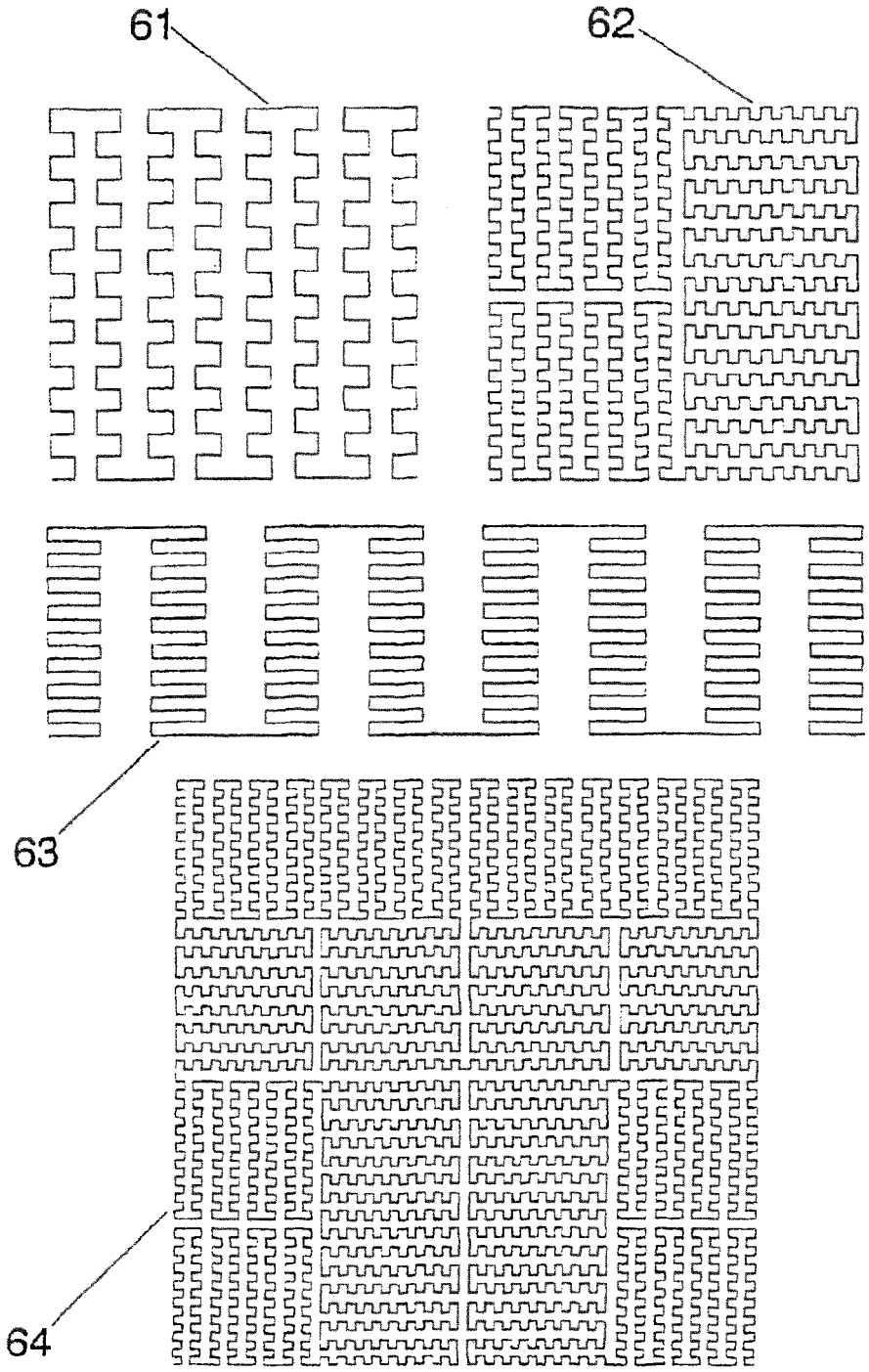
FIG. 22 shows a family of SFC curves (61, 62, 63, 64) named here as HilbertZZ curves.
Figure 23:
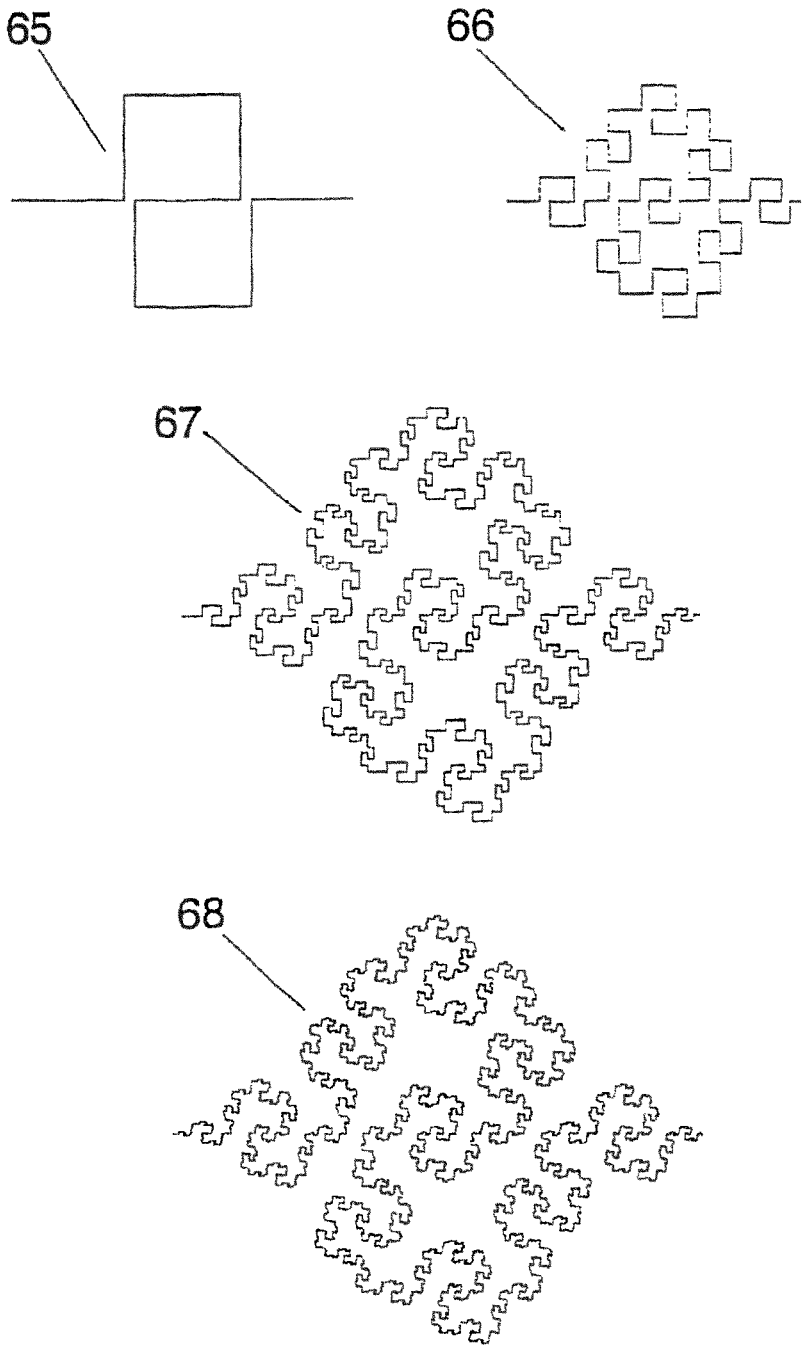
FIG. 23 shows a family of SFC curves (66, 67, 68) named here as Peanodec curves. A non-SFC curve (65) constructed with only nine segments is shown for comparison.
Figure 24:
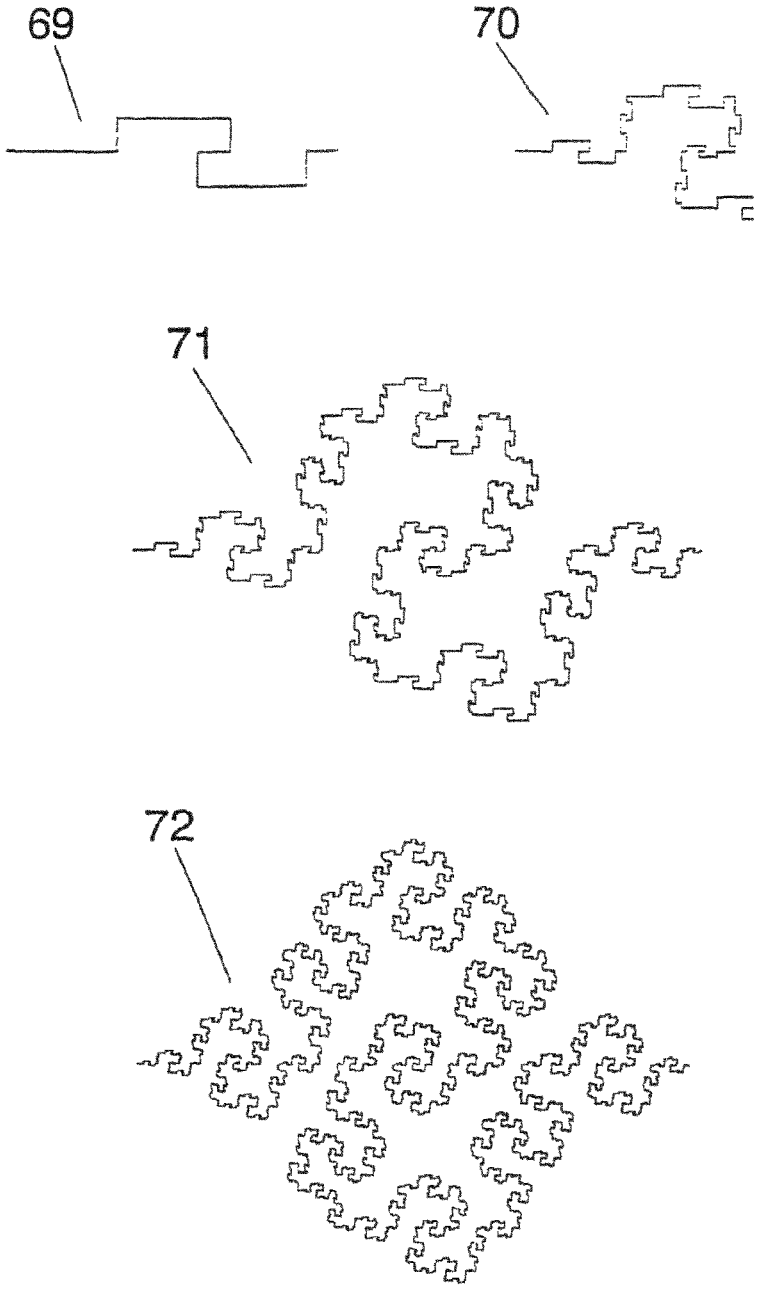
FIG. 24 shows a family of SFC curves (70, 71, 72) named here as Peanoinc curves. A non-SFC curve (69) constructed with only nine segments is shown for comparison.
Figure 25:
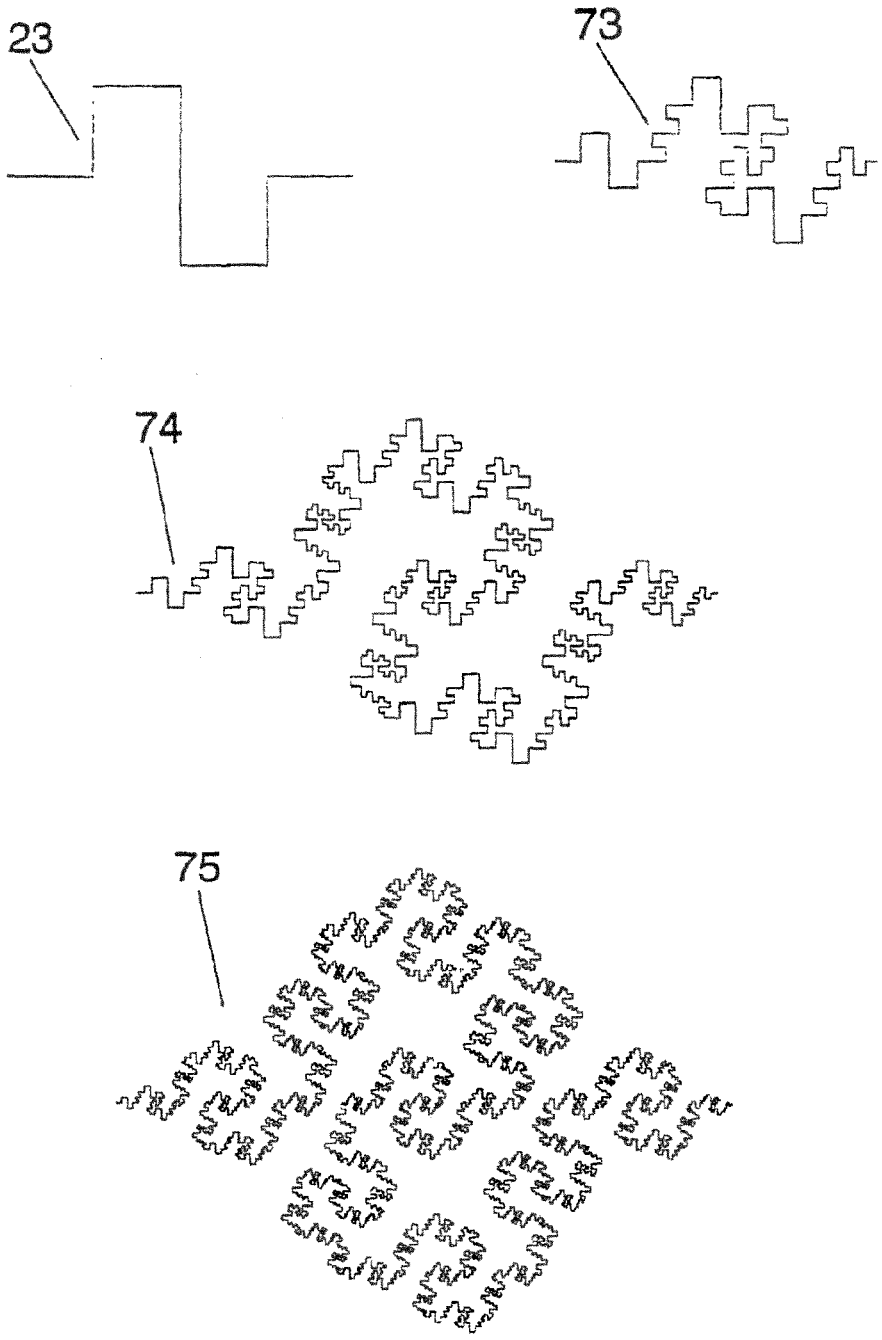
FIG. 25 shows a family of SFC curves (73, 74, 75) named here as PeanoZZ curves. A non-SFC curve (23) constructed with only nine segments is shown for comparison.

FIG. 18 describes another typical configuration of antenna, a reflector antenna (49), with the newly disclosed approach of shaping the reflector perimeter with an SFC curve. The reflector can be either flat or curve, depending on the application or feeding scheme (in for instance a reflectarray configuration the SFC reflectors will preferably be flat, while in focus fed dish reflectors the surface bounded by the SFC curve will preferably be curved approaching a parabolic surface). Also, within the spirit of SFC reflecting surfaces, Frequency Selective Surfaces (FSS) can be also constructed by means of SFC curves; in this case the SFC are used to shape the repetitive pattern over the FSS. In said FSS configuration, the SFC elements are used in an advantageous way with respect to prior art because the reduced size of the SFC patterns allows a closer spacing between said elements. A similar advantage is obtained when the SFC elements are used in an antenna array in an antenna reflect array.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

What is claimed is:

1. An apparatus comprising:

a portable communication device;

at least a first single antenna, the first single antenna being included entirely within the portable communication device;

said first single antenna having a surface that radiates and receives electromagnetic waves, an entirety of an edge enclosing the surface shaped as a substantially non-periodic curve;

said substantially non-periodic curve comprises a multiplicity of connected segments, each segment is shorter than one tenth of at least one operating free-space wavelength of the antenna;

the first single antenna radiates at multiple different operating Wavelengths with at least one of the operating wavelengths corresponding to an operating wavelength of a cellular telephone system;

the first single antenna radiates across each of at least two non-overlapping cellular telephone system frequency bands; and the first single antenna simultaneously receives electromagnetic waves corresponding to at least two non-overlapping cellular telephone system frequency bands.

2. The apparatus as set forth in claim 1, wherein said portable communication device is a cellular telephone.

3. The apparatus as set forth in claim 2, wherein the first single antenna comprises a matching network between an element and an input connector or transmission line.

4. The apparatus as set forth in claim 3, wherein said multiplicity of connected segments comprise an irregular arrangement of at least ten segments, and further wherein no two adjacent and connected segments of said multiplicity of connected segments form another longer straight segment.

5. The apparatus as set forth in claim 4, wherein each pair of adjacent segments forms a bend such that said substantially non-periodic curve has a physical length larger than that of any straight line that can be fitted in the same area in which the multiplicity of connected segments are arranged, and so that the substantially non-periodic curve can be fitted inside a radian sphere of said at least one operating free-space wavelength of the single antenna.

6. The apparatus as set forth in claim 5, wherein a first frequency band of said at least two cellular telephone system frequency bands is a frequency band that comprises 900 MHz.

7. The apparatus as set forth in claim 6, wherein a second frequency band of said at least two cellular telephone system frequency bands is a frequency band that comprises 1800 MHz.

8. The apparatus as set forth in claim 7, wherein the first single antenna is a patch antenna comprising:

a ground plane; and a conducting patch substantially parallel to the ground plane.

9. The apparatus as set forth in claim 8, wherein the substantially non-periodic curve features a box-counting dimension greater than 1.3, the box-counting dimension is computed as the slope of a substantially straight portion of a line in a log-log graph over at least an octave of scales on the horizontal axes of the log-log graph.

10. The apparatus as set forth in claim 8, wherein a distance between the conducting patch and the ground plane is below one quarter of said at least one operating free-space wavelength.

11. The apparatus as set forth in claim 5, wherein the single antenna radiates across a GSM 900 system frequency band, a GSM 1800 system frequency band and a UMTS system frequency band.

12. The apparatus as set forth in claim 11, wherein the single antenna is a monopole antenna having a radiating arm and a ground counterpoise said radiating arm comprising the surface.

13. The apparatus as set forth in claim 12, wherein the substantially non-periodic curve features a box-counting dimension greater than 1.4, the box-counting dimension is computed as the slope of a substantially straight portion of a line in a log-log graph over at least an octave of scales on the horizontal axes of the log-log graph.

14. The apparatus as set forth in claim 13, wherein said substantially non-periodic curve is shaped so that the arrangement of said multiplicity of connected segments is not self-similar with respect to the entire substantially non-periodic curve.

15. The apparatus as set forth in claim 14, wherein the substantially non-periodic curve extends across a surface lying on more than one plane.

16. The apparatus as set forth in claim 15, wherein the radiating arm is printed over a dielectric substrate.

17. The apparatus of claim 5, wherein the first single antenna comprises multiple electromagnetically coupled radiating elements.

18. The apparatus as set forth in claim 2, wherein the first single antenna radiates across each of at least three cellular telephone system frequency bands within the 800 MHz-3600 MHz frequency range.

19. The apparatus as set forth in claim 18, wherein a first frequency band of said at least three cellular telephone system frequency bands is at approximately 1800 MHz and a second frequency band of said at least three cellular telephone system frequency bands is at approximately 2100 MHz.

20. The apparatus as set forth in claim 19, wherein the surface of said first single antenna comprises a printed conductive sheet on a printed circuit board.

21. An apparatus comprising:

a portable communication device;

at least a first single antenna, the first single antenna being entirely included within the portable communication device;

the first single antenna comprises a radiating element a perimeter of which is defined by a multi-segment, irregular curve including a plurality of segments, each of said segments being spatially arranged such that no two adjacent and connected segments form another longer straight segment and none of said segments intersects with another segment other than at the beginning and at the end of said multi-segment, irregular curve to form a closed loop;

the first single antenna radiates at multiple different operating wavelengths;

each segment of said plurality of segments is shorter than one tenth of a longest operating free-space wavelength of said multiple different operating wavelengths;

the multi-segment curve has a box-counting dimension larger than one with the box-counting dimension computed as the slope of a substantially straight portion of a line in a log-log graph over at least one octave of scales on a horizontal axis of the log-log graph;

a first of the multiple different operating wavelengths corresponds to an operating wavelength of a first cellular telephone system; and a second of the multiple different operating wavelengths corresponds to an operating wavelength of a second cellular telephone system.

22. The apparatus as set forth in claim 21, wherein the first single antenna radiates across each of at least three cellular telephone system frequency bands.

23. The apparatus as set forth in claim 22, wherein said portable communication device is a cellular telephone.

24. The apparatus as set forth in claim 23, wherein the first single antenna comprises a matching network between the radiating element and an input connector or transmission line.

25. The apparatus as said forth in claim 23, wherein said multi-segment, irregular curve features a box-counting dimension larger than 1.4.

26. The apparatus as said forth in claim 23, wherein the multi-segment, irregular curve includes at least 25 segments.

27. The apparatus as set forth in claim 23, wherein the radiating element is a radiating arm of a monopole antenna.

28. The apparatus as set forth in claim 23, wherein the radiating element is a conducting patch of a patch antenna.

29. The apparatus as set forth in claim 23, wherein said multi-segment, irregular curve is shaped so that the arrangement of said plurality of segments is not self-similar with respect to the entire multi-segment, irregular curve.

30. The apparatus as set forth in claim 21, wherein each pair of adjacent segments forms a bend such that said multi-segment, irregular curve has a physical length larger than that of any straight line that can be fitted in the same area in which the plurality of segments are arranged, and so that the resulting multi-segment, irregular curve can be fitted inside a radian sphere of said longest operating free-space wavelength of the single antenna.

31. The apparatus as set forth in claim 30, wherein said portable communication device is a cellular telephone.

32. The apparatus as set forth in claim 31, wherein the first single antenna radiates across each of at least three cellular telephone system frequency bands.

33. The apparatus as set forth in claim 31, wherein the first single antenna radiates and radiates electromagnetic waves across each of at least four cellular telephone system frequency bands.

34. The apparatus as said forth in claim 31, wherein said multi-segment, irregular curve features a box-counting dimension larger than 1.3.

35. The apparatus as said forth in claim 31, wherein the multi-segment, irregular curve includes at least 20 segments.

36. The apparatus as set forth in claim 31, wherein the multiple different operating wavelengths include GSM 850 and GSM 900.

37. The apparatus as set forth in claim 30, wherein the first single antenna comprises a matching network between the radiating element and an input connector or transmission line.

38. The apparatus as said forth in claim 37, wherein said multi-segment, irregular curve features a box-counting dimension larger than 1.2.

39. The apparatus as set forth in claim 37, wherein the first single antenna radiates across each of at least three cellular telephone system frequency bands.

40. The apparatus as set forth in claim 37, wherein the first single antenna radiates and receives electromagnetic waves across each of at least four cellular telephone system frequency bands.

41. The apparatus as set forth in claim 37, wherein the first single antenna radiates electromagnetic waves across each of at least five cellular telephone system frequency bands.

42. The apparatus of claim 37, wherein the first single antenna comprises multiple electromagnetically coupled radiating elements.

43. An apparatus comprising:

a cellular telephone;

at least a first single antenna, the antenna being included entirely within the cellular telephone;

the first single antenna comprising a radiating element having a surface, an entirety of an edge enclosing the surface shaped as a substantially non-periodic curve;

said substantially non-periodic curve comprises a multiplicity of connected segments, each segment is shorter than one tenth of at least one operating free-space wavelength of the antenna;

the first single antenna radiates at multiple different operating wavelengths with at least one of the operating wavelengths corresponding to an operating wavelength of a cellular telephone system;

the first single antenna simultaneously radiates across each of at least three non-overlapping cellular telephone system frequency bands; and the first single antenna comprising a matching network between the radiating element and an input connector or transmission line.

44. The apparatus of claim 43, wherein the single antenna operates in a frequency band comprising 850 MHz.

45. The apparatus of claim 43, wherein a first of said multiple different operating wavelengths corresponds to an operating wavelength within a first frequency band of a first cellular telephone system and a second of said multiple different operating wavelengths corresponds to an operating wavelength within a second frequency band of a second cellular telephone system.

46. The apparatus of claim 43, wherein the first single antenna operates in a frequency band that comprises 1900 MHz.

47. The apparatus of claim 46, wherein the substantially non-periodic curve is arranged over two or more surfaces.

48. The apparatus of claim 46, wherein said substantially non-periodic curve features a box-counting dimension larger than 1.3, the box-counting dimension is computed as the slope of a substantially straight portion of a line in a log-log graph over at least an octave of scales on the horizontal axes of the log-log graph.

49. The apparatus of claim 43, wherein the first single antenna operates in at least four cellular telephone system frequency bands.

50. The apparatus of claim 49, wherein said substantially non-periodic curve features a box-counting dimension larger than 1.2, the box-counting dimension is computed as the slope of a substantially straight portion of a line in a log-log graph over at least an octave of scales on the horizontal axes of the log-log graph.

51. The apparatus of claim 43, wherein the first single antenna radiates electromagnetic waves across each of at least five cellular telephone system frequency bands.

52. The apparatus of claim 51, wherein the first single antenna comprises Multiple electromagnetically coupled radiating elements.

53. The apparatus of claim 52, wherein one of the multiple electromagnetically coupled radiating elements comprises a ground plane.

* * * * *